US010060195B2

(12) United States Patent
Moeny

(10) Patent No.: US 10,060,195 B2
(45) Date of Patent: Aug. 28, 2018

(54) REPETITIVE PULSED ELECTRIC DISCHARGE APPARATUSES AND METHODS OF USE

(71) Applicant: SDG, LLC, Albuquerque, NM (US)

(72) Inventor: William M. Moeny, Bernalillo, NM (US)

(73) Assignee: SDG LLC, Minden, NV (US)

( * ) Notice: Subject to any disclaimer, the term of this patent is extended or adjusted under 35 U.S.C. 154(b) by 419 days.

(21) Appl. No.: 14/743,664

(22) Filed: Jun. 18, 2015

(65) Prior Publication Data

US 2016/0017663 A1 Jan. 21, 2016

Related U.S. Application Data

(63) Continuation-in-part of application No. PCT/US2013/076262, filed on Dec. 18, 2013, and a continuation-in-part of application No. 13/935,995, filed on Jul. 5, 2013, now abandoned.

(60) Provisional application No. 61/738,753, filed on Dec. 18, 2012, provisional application No. 61/738,837, filed on Dec. 18, 2012, provisional application No. 61/739,144, filed on Dec. 19, 2012, provisional (Continued)

(51) Int. Cl.
*E21B 17/00* (2006.01)
*E21B 7/15* (2006.01)

(52) U.S. Cl.
CPC ..... *E21B 17/003* (2013.01); *E21B 7/15* (2013.01)

(58) Field of Classification Search
CPC ..... E21B 7/15; E21B 17/003
See application file for complete search history.

(56) References Cited

U.S. PATENT DOCUMENTS 2,623,921 A 12/1952 Smits
2,818,020 A 12/1957 Burklund (Continued)

FOREIGN PATENT DOCUMENTS

CA 2262581 1/2006
CA 2581701 10/2013

(Continued)

OTHER PUBLICATIONS

"Dielektrol-I Fluid", GE Company Material Safety Data Sheet, Mar. 25, 1996.

(Continued)

*Primary Examiner* — Jennifer H Gay
(74) *Attorney, Agent, or Firm* — Peacock Law P.C.; Philip Askenazy; Deborah Peacock

(57) ABSTRACT

Electrocrushing drill bits comprising one or more high voltage electrodes surrounded by a ground or current return structure, which can be a ring or a comprise rod shaped (i.e. cylindrical) electrodes. Openings in the rim of the current return structure facilitate removal of drilling debris and bubbles created by the electrocrushing process out from the bottom face of the bit and up the wellbore. The high voltage electrodes can be arranged in a circle. The current return structure may partially cover the bottom face of the drill bit, thereby enclosing the high voltage electrodes in openings that may be sector shaped. Also a method and apparatus for dividing a flow of drilling fluid both to sweep drilling debris and bubbles out of the drill bit and hole and to cool high power electrical components.

33 Claims, 77 Drawing Sheets

Related U.S. Application Data application No. 61/739,172, filed on Dec. 19, 2012, provisional application No. 61/739,187, filed on Dec. 19, 2012, provisional application No. 61/740,812, filed on Dec. 21, 2012, provisional application No. 61/749,071, filed on Jan. 4, 2013, provisional application No. 61/905,060, filed on Nov. 15, 2013, provisional application No. 61/668,304, filed on Jul. 5, 2012, provisional application No. 61/738,837, filed on Dec. 18, 2012, provisional application No. 61/739,172, filed on Dec. 19, 2012.

(56) References Cited

U.S. PATENT DOCUMENTS 2,821,637 A 1/1958 Roberts et al.
2,822,148 A 2/1958 Murray
2,953,353 A 9/1960 Allen
3,076,513 A 2/1963 Heaphy
3,158,207 A 11/1964 Rowley
3,173,787 A 3/1965 Clement et al.
3,179,187 A * 4/1965 Sarapuu ..... E21B 7/15 175/101
3,183,390 A 5/1965 Grader et al.
3,468,387 A * 9/1969 Benson ..... E21B 7/15 175/16
3,500,942 A 3/1970 Smith
3,506,076 A 4/1970 Angona
3,510,676 A 5/1970 Pierce, Jr.
3,539,406 A 11/1970 Lissant
3,621,916 A 11/1971 Smith, Jr.
3,679,007 A 7/1972 O'Hare
3,680,431 A 8/1972 Papp
3,700,169 A 10/1972 Naydan et al.
3,708,022 A 1/1973 Woodruff
3,715,082 A 2/1973 Carley-Macauly et al.
3,796,463 A 3/1974 Naydan et al.
3,829,816 A 8/1974 Barry et al.
3,840,078 A 10/1974 Allgood et al.
3,881,559 A 5/1975 Allgood et al.
3,957,118 A 5/1976 Barry et al.
3,974,116 A 8/1976 Lissant
4,040,000 A 8/1977 Dwivedi
4,122,387 A 10/1978 Ajam et al.
4,169,503 A 10/1979 Scott et al.
4,328,458 A 5/1982 Hiromitsu
4,335,465 A 6/1982 Christiansen et al.
4,345,650 A 8/1982 Wesley
4,412,967 A 11/1983 Winterberg et al.
4,479,680 A 10/1984 Wesley et al.
4,523,194 A 6/1985 Hyde
4,525,287 A 6/1985 Carstensen
4,540,127 A 9/1985 Andres
4,740,319 A 4/1988 Patel et al.
4,741,405 A 5/1988 Moeny et al.
4,899,834 A 2/1990 Weldon
4,937,832 A 6/1990 Rocca
4,975,917 A 12/1990 Villa
5,004,050 A 4/1991 Sizonenko et al.
5,019,119 A 5/1991 Hare, Sr.
5,027,264 A 6/1991 Dedoncker et al.
5,088,568 A 2/1992 Simuni
5,091,819 A 2/1992 Christiansen et al.
5,106,164 A 4/1992 Kitzinger et al.
5,126,638 A 6/1992 Dethlefsen
5,146,141 A 9/1992 Rohde
5,179,541 A 1/1993 Weido
5,228,011 A 7/1993 Owen
5,272,022 A 12/1993 Takami et al.
5,336,647 A 8/1994 Nae et al.
5,386,877 A 2/1995 Codina et al.
5,394,411 A 2/1995 Milchberg et al.
5,398,217 A 3/1995 Cannelli et al.
5,399,941 A 3/1995 Grothaus et al.
5,425,570 A 6/1995 Wilkinson
5,432,756 A 7/1995 Bryden
5,502,356 A 3/1996 McGeoch
5,556,832 A 9/1996 Van Slyke
5,568,448 A 10/1996 Tanigushi et al.
5,573,307 A * 11/1996 Wilkinson ..... E21B 7/15 166/299
5,586,608 A 12/1996 Clark et al.
5,646,561 A 7/1997 Fanini et al.
5,658,860 A 8/1997 Clark et al.
5,685,377 A 11/1997 Arstein et al.
5,864,064 A 1/1999 Kano et al.
5,896,938 A 4/1999 Moeny et al.
5,967,816 A 10/1999 Sampa et al.
6,026,099 A 2/2000 Young
6,104,022 A 8/2000 Young et al.
6,116,357 A 9/2000 Wagoner et al.
6,123,561 A 9/2000 Turner et al.
6,145,934 A 11/2000 Arai et al.
6,164,388 A 12/2000 Martunovich et al.
6,173,787 B1 1/2001 Wittrisch
6,215,734 B1 4/2001 Moeny et al.
6,280,519 B1 8/2001 Yezrielev et al.
6,280,659 B1 8/2001 Sundin
6,457,778 B1 10/2002 Chung et al.
6,510,899 B1 1/2003 Sheiretov et al.
6,608,005 B2 8/2003 Palmer et al.
6,620,769 B1 9/2003 Juppe et al.
6,658,968 B2 12/2003 Linden et al.
6,666,274 B2 12/2003 Hughes
6,719,068 B2 4/2004 Jonsson
6,761,416 B2 7/2004 Moeny et al.
6,770,603 B1 8/2004 Sawdon et al.
6,787,505 B1 9/2004 Maitland et al.
6,909,667 B2 6/2005 Shah et al.
6,935,702 B2 8/2005 Okazaki et al.
7,156,676 B2 1/2007 Reynolds, Jr.
7,247,604 B2 7/2007 Dalmazzone et al.
7,270,195 B2 9/2007 MacGregor et al.
7,384,009 B2 * 6/2008 Moeny ..... B23H 1/08 241/1
7,416,032 B2 * 8/2008 Moeny ..... B23H 1/08 175/16
7,527,108 B2 5/2009 Moeny
7,530,406 B2 * 5/2009 Moeny ..... B23H 1/08 175/16
7,559,378 B2 7/2009 Moeny
7,784,563 B2 * 8/2010 Rodland ..... E21B 7/15 175/16
7,959,094 B2 * 6/2011 Moeny ..... E21B 7/15 241/1
8,083,008 B2 * 12/2011 Moeny ..... B23H 1/08 175/16
8,109,345 B2 2/2012 Jeffryes
8,172,006 B2 * 5/2012 Moeny ..... E21B 10/00 175/16
8,186,454 B2 * 5/2012 Moeny ..... E21B 7/15 175/16
8,567,522 B2 * 10/2013 Moeny ..... E21B 7/15 175/16
8,616,302 B2 * 12/2013 Moeny ..... E21B 10/00 175/1
8,789,772 B2 * 7/2014 Moeny ..... B02C 19/18 241/1
8,922,048 B2 12/2014 Giesler
9,010,458 B2 * 4/2015 Moeny ..... B23H 1/08 175/16
9,016,359 B2 * 4/2015 Moeny ..... E21B 7/15 166/65.1
9,190,190 B1 11/2015 Moeny
2002/0002933 A1 1/2002 Yezrielev et al.
2002/0005346 A1 1/2002 Babington
2003/0069110 A1 4/2003 Chang
2004/0106523 A1 6/2004 Stridde et al.
2005/0029476 A1 2/2005 Biester et al.
2005/0150688 A1 7/2005 MacGregor et al.
2006/0037516 A1 * 2/2006 Moeny ..... B23H 1/08 106/486

(56) References Cited

U.S. PATENT DOCUMENTS

| | | | | |
|---|---|---|---|---|
| 2006/0037779 | A1* | 2/2006 | Moeny | B23H 1/08 175/16 |
| 2006/0038045 | A1* | 2/2006 | Moeny | B23H 1/08 241/1 |
| 2006/0038437 | A1* | 2/2006 | Moeny | B23H 1/08 299/14 |
| 2006/0137909 | A1 | 6/2006 | Moeny | |
| 2006/0151211 | A1 | 7/2006 | Coenen et al. | |
| 2006/0243486 | A1 | 12/2006 | Moeny | |
| 2007/0137893 | A1* | 6/2007 | Moeny | B23H 1/08 175/1 |
| 2007/0152494 | A1* | 7/2007 | Moeny | B23H 1/08 299/14 |
| 2007/0167051 | A1 | 7/2007 | Reynolds, Jr. | |
| 2008/0277508 | A1* | 11/2008 | Moeny | E21B 7/15 241/1 |
| 2009/0050371 | A1* | 2/2009 | Moeny | E21B 7/15 175/57 |
| 2009/0105955 | A1 | 4/2009 | Castillo et al. | |
| 2009/0120689 | A1 | 5/2009 | Zaeper et al. | |
| 2009/0133929 | A1* | 5/2009 | Rodland | E21B 10/60 175/16 |
| 2010/0000790 | A1* | 1/2010 | Moeny | E21B 7/15 175/16 |
| 2010/0300756 | A1 | 12/2010 | Bergstrom et al. | |
| 2011/0036560 | A1 | 2/2011 | Vail, III et al. | |
| 2011/0278382 | A1* | 11/2011 | Moeny | B02C 19/18 241/1 |
| 2012/0024600 | A1 | 2/2012 | Bittar et al. | |
| 2012/0043075 | A1 | 2/2012 | Abramova et al. | |
| 2012/0103693 | A1 | 5/2012 | Jeffryes | |
| 2012/0132466 | A1* | 5/2012 | Moeny | B23H 1/08 175/16 |
| 2012/0168177 | A1* | 7/2012 | Moeny | E21B 7/15 166/380 |
| 2012/0217064 | A1* | 8/2012 | Moeny | E21B 7/15 175/16 |
| 2012/0256634 | A1 | 10/2012 | Morys | |
| 2013/0112482 | A1* | 5/2013 | Armistead | E21B 21/08 175/57 |
| 2013/0140086 | A1* | 6/2013 | Moeny | E21B 7/15 175/16 |
| 2014/0008968 | A1* | 1/2014 | Moeny | E21B 17/003 307/2 |
| 2014/0367502 | A1 | 12/2014 | Moeny | |
| 2015/0083491 | A1 | 3/2015 | Moeny et al. | |
| 2015/0308235 | A1* | 10/2015 | Moeny | E21B 7/15 166/244.1 |
| 2016/0017663 | A1* | 1/2016 | Moeny | E21B 17/003 175/327 |
| 2017/0204668 | A1* | 7/2017 | Lehr | E21B 7/04 |
| 2017/0204669 | A1* | 7/2017 | Lehr | E21B 7/15 |
| 2017/0362490 | A1* | 12/2017 | Van Slyke | C09K 8/36 |

FOREIGN PATENT DOCUMENTS

| | | | | |
|---|---|---|---|---|
| CA | 2658570 | | 3/2015 | |
| CA | 2661026 | | 2/2016 | |
| DE | 3150430 | | 7/1983 | |
| DE | 3942307 | | 7/1991 | |
| EP | 0453076 | | 10/1991 | |
| EP | 0921270 | | 6/1999 | |
| FR | 2574559 | | 6/1986 | |
| JP | WO-9807960 | A1 * | 2/1998 | E21B 7/15 |
| RU | 2150326 | | 6/2000 | |
| WO | 92/11546 | | 7/1992 | |
| WO | 94/03949 | | 2/1994 | |
| WO | 97/03796 | | 2/1997 | |
| WO | 98/06234 | | 2/1998 | |
| WO | 99/14286 | | 3/1999 | |
| WO | 02/078441 | | 10/2002 | |
| WO | 03/069110 | | 8/2003 | |
| WO | 2005/054620 | | 6/2005 | |
| WO | 2006/023998 | | 3/2006 | |
| WO | 2007/024263 | | 3/2007 | |
| WO | 2008/003092 | | 1/2008 | |
| WO | 2008/097101 | | 8/2008 | |
| WO | 2010/027866 | | 3/2010 | |
| WO | 2012/094676 | | 7/2012 | |
| WO | 2012/173969 | | 12/2012 | |
| WO | 2014/008483 | | 1/2014 | |
| WO | 2014/100255 | | 6/2014 | |
| WO | 2015/042608 | | 3/2015 | |

OTHER PUBLICATIONS

"Dielektrol-II Fluid", GE Company Material Safety Data Sheet, Mar. 25, 1996.

"Dielektrol-III Fluid", GE Company Material Safety Data Sheet, Mar. 25, 1996.

"Dielektrol-IV Fluid", GE Company Material Safety Data Sheet, May 23, 1996.

"Dielektrol-V Fluid", GE Company Material Safety Data Sheet, Mar. 25, 1996.

"Dielektrol-VI Fluid", GE Company Material Safety Data Sheet, Dec. 7, 1999.

"Dielektrol-VII Fluid", GE Company Material Safety Data Sheet, Nov. 2, 1999.

"Drilling Research on the Electrical Detonation and Subsequent Cavitation in a Liquid Technique (Spark Drilling)", SAND75-0417, Jul. 1975, 1-57.

"Electrical Properties of Various UCON Lubricants", ChemPoint.com, 21-26.

"Geconol", GE Company Material Safety Data Sheet, Mar. 25, 1996.

"ICOA Technical Bulletins", www.icoa.org/someback.thm, 2005.

"Plasma Blasting in the Canadian Mining Industry", Energy, Mines and Resources, Energy Diversification Research Laboratory, Varennes, Quebec, Canada, Cadet Newsletter No. 4, 1990, 1-4.

"Polycin TC", Caschem, Apr. 2004.

"Series SW50K High Precision Spark Gap Switches", Physics International Company Olin Defense Systems Group, Easylink 62100323, 1.

Akhmetov, et al., "The effect of a hydroelectric discharge on the capacitance and filtration properties of rocks", Izv. Akad. Nauk Az. SSR, Ser. Nauk Zemie, 1983, 128-131.

Andres, "Electrical Disintegration of Rock", Mineral Processing and Extractive Metallurgy Review, 1995, vol. 14, 1995, 87-110.

Andres, et al., "Liberation of Mineral Constituents by High-Voltage Pulses", Powder Technology, 48, 1986, 269-277.

Andres, et al., "Liberation of minerals by high-voltage electrical pulses", Powder Technology, vol. 104, 1999, 37-49.

Andres, "Liberation Study of Apatite Nepheline Ore Comminuted by Penetrating Electrical Discharges", International Journal of Mineral Processing, vol. 4, 1977, 33-38.

Andres, "Parameters of disintegration of rock by electrical pulses", Powder Technology vol. 58, No. 4, 1989, 265-269.

Aso, et al., "Temporary Ventilation Shaft Structure of Abo Tunnel on Chubu Thruway, Ewquipment Taking into Consideration Cold District and Winter Storage", Kensetsu No Kikaika, No. 555, May 25, 1996, 32-38.

Biela, et al., "Solid State Modulator for Plasma Channel Drilling", IEEE Transactions on Dielectrics and Electrical Insulation, vol. 16, No. 4, 2009, 1093-1099.

Bindeman, "Fragmentation phenomena in populations of magmatic crystals", American Mineralogist, vol. 90, 2005, 1801-1815.

Bluhm, et al., "Application of Pulsed HV Discharges to Material Fragmentation and Recycling", IEEE Transactions on Dielectrics and Electrical Insulation, vol. 7, No. 5, 2000, 625-636.

Bommakanti, et al., "Design of a Travelling Wave Tube Feedthrough—Insulator Material Considerations", University of South Carolina, Unknown, 200-204.

Brady, et al., "Pulsed Plasma Thruster Ignitor Plug Ignition Characteristics", J. Spacecraft, vol. 20, No. 5, 1983, 450-451.

(56) References Cited

OTHER PUBLICATIONS

Broyer, et al., "New discharge circuit using high voltage transmission line for efficient shock wave generation; application to lithotripsy", IEEE Ultrasonics Symposium v 3, 1994, 1883-1886.
Budenstein, "On the Mechanism of Dielectric Breakdown of solids", IEEE Transactions on Electrical Insulation vol. EI-15, No. 3, Jun. 1980, 225-240.
Chernyak, "Dielectric Constant, Dipole Moment, and Solubility Parameters of some Cyclic Acid Esters", J. Chem, Eng. Data, vol. 51, 2006, 416-418.
Cook, et al., "Rock Fragmentation by Mechanical, Chemical and Thermal Methods", VI International Mining Congress, 1970, 1-5.
Dean, "Lange's Handbook of Chemistry", 15th Edition, Section 5, 1999, 5.112.
Dubovenko, et al., "Underwater electrical discharge characteristics at high values of initial pressure and temperature", IEEE International Conference on Plasma Science 1998, 1998.
Filatov, et al., "Nanosecond-Discharge-Assisted Selective Separation of Fine Inclusions not Involved in the Impurity Lattice", IEEE, 1997, 1103-1105.
Furujo, "Current Trends of Plasma Cutting Technology", Yosetsu Gakkai-Shi (Journal of the Japan Welding Society), Vo. 66, No. 7, Oct. 5, 1997, 33-37.
Goldfarb, et al., "Removal of Surface Layer of Concrete by a Pulse-Periodical Discharge", IEEE, 1977, 1078-1084.
Goldstein, "Electric Cartridge Guns Using Fluids Heated by a Capillary Plasma Jet—An Extension of Classical Gun Technology to High Velocities", Abstract—GT-Devices Inc., Alexandria, VA, Sep. 1983.
Hamelin, et al., "Hard Rock Fragmentation with Pulsed Power", 1993 Pulsed Power Conference, 1993, 11-14.
Hasebe, et al., "Focusing of Shock Wave by Underwater Discharge, On Nonlinear Reflection and Focusing Effect", Zairyo (Journal of the Society of Materials Science, Japan), vol. 45., No. 10, Oct. 15, 1996, 1151-1156.
Hawrylewicz, "Cutting and Fragmentation of Hard Rocks by Electrohydraulic Discharge: An Experiemental Study", Intel Symposium on Jet Cutting Technology, 1984, 583-588.
Hawrylewicz, et al., "Experiment with electric discharge in rock splitting", Symposium on Rock Mechanics, vol. 27, Jun. 1986, 429-435.
Hogeland, et al., "Aluminum-Enhanced Underwter Electrical Discharges for Steam Explosion Triggering", Sandia National Labs., SAND99-0796, 1999.
Huang, et al., "Separation and preconcentration combined with glow discharge atomic emission spectrometry for the determination of rate earth elements (a, Nd< Eu, Dy, Y) in geological samples", Fresenius' Journal of Analytical Chemistry. vol. 367, No. 3, 2000, 254-258.
Huismann, et al., "Arc Voltage Measurements of the Hyperbaric MIG Process", OMAE 1996—Proceedings of the 15. International Conference on Offshore Mechanics and artic Engineering. vol. 3: Materials Engineering, Jun. 1996, 133-140.
Inoue, et al., "Drilling of Hard Rocks by Pulsed Power", IEEE Electrical Insulation Magazine, vol. 16, No. 3, 2000, 19-25.
Inoue, et al., "Pulsed Electric Breakdown and Destruction of Granite", Jp. J. Appl. Phys. vol. 38, Part 1, No. 11, 1999, 6502-6505.
Ivanov, et al., "Discharge-pulse technology of development of sulphidic ores at the bottom of ocean. The Part II. (Problems if electrodischarge-chemical explosions)", Elektronnaya Obrabotka Materialov, No. 1, 2002, 57-63.
Kalyatskij, et al., "Optimization of wear of electrode systems under rock crushing by discharge-producing electrical pulses", Elektron Obr Mater n 01 Jan.-Feb. 1991, 1991, 43-45.
Kil'keyev, et al., "Aspects of absorption of microwave energy by frozen rock", 5. Competition of Young Scientists and Specialists at the Faculty of Gas and Oil, Geology and Geophysics Meeting, May 1, 1981, 20-21.
Komatsubara, "Recent trend of new flue gas treating technology", R and D News Kansai, 1993, 33-35.
Kudo, et al., "Application of the Electric Discharge Logging System", Proceeding of the 97th (Fall, Fiscal 1997) SEGJ Conference, 1997, 326-330.
Kudo, et al., "Features of the Electric Discharge Logging System", Proceeding of the 97th (Fall, Fiscal 1997) SEGJ Conference, 1997, 321-325.
Kumazaki, et al., "Production of Artificial Fulgurite by Utilizing Rocket Triggered Lightning", Denki Gakkai Ronbunshi, A (Transactions of the Institute of Electrical Engineers of Japan, Fundamentals and Materials), vol. 117, No. 10, 1997, 1013-1020.
Kurihara, et al., "Inventigation of Phenomena of Sourthem Hyogo Earthquake, and Observation of Thunderbolts in Winter Using the Integrated Thunderbolt Observation System", Denryoku Chuo Kenkyusho Kenkyu Nenpo, 1996, 50-53.
Lisitsyn, et al., "Breakdown and Destruction of Heterogeneous Solid Dielectrics by High Voltage Pulses", Journal of Applied Physics, vol. 84, No. 11, 1998, 6262-6267.
Lisitsyn, et al., "Drilling and Demolition of Rocks by Pulsed Power", IEEE, 1999, 169-172.
Lisitsyn, et al., "Role of electron clusters-Ectons-in the breakdown of solid dielectrics", Physics of Plasma, vol. 5, No. 12, 1998, 4484-4487.
Madhavan, et al., "Modeling of shock-wave generation in water by electrical discharges", IEEE Trans Plasma Sci, vol. 28, No. 5, 2000, 1552-1557.
Malyushevskij, et al., "Discharge-pulse technology of mining of sulfidic ores at the bottom of ocean. Part I. (The problem of deep-water electric explosion)", Elektronnaya Obrabotka Materialov No. 6, 2001, 41-49.
Malyushevskij, et al., "Discharge-pulse technology of mining of sulphide ores on the bottom of the Ocean. The Part III (Ecological electrodischarge-chemical explosions)", Elektronnaya Obrabotka Meterialov, No. 2, 2002, 45-57.
Matsumoto, "Acceleration Methods of Itonic Clusters", Proceedings of the 25th Linear Accelerator Meeting in Japan, 2000, 77-79.
Matsumoto, "Feasibility of X-ray Laser by Underwater Spark Discharges", Proceedings of the First Symposium on Advanced Photon Research, 1999, 149-152.
Maurer, "Advanced Drilling Techniques", Petroleum Publishing Co., 139-146.
Maurer, "Spark Drilling", Rock Mechanics-Theory and Practice, Chapter 33, 1969, 687-703.
Maurer, "Spark Drills", Advanced Drilling Techniques, Chapter 21, Petroleum Publishing Co., 1980, 508-541.
McClung, "The feasibility of developing a borehole sparker for geothermal wells", EG and G Energy Measurements, Inc., 1997.
Mozumi, et al., "Tunnel blasting with non-electric detonators in the Kamioka mine", Kogyo Kayaku (Japan, vol. 54, No. 1, Feb. 25, 1993, 44-49.
No Author, "Proceedings of the 23rd International Conference of Safety in Mines Research Institutes; Abstracts", International Conference of Safety in Mines Research Institutes, 1989.
No Author, "Proceedings of the eighteenth annual conference on explosives and blasting technique", International Society of Explosives Engineers, 1992.
Park, et al., "Recent Results on Development of a Table-Top Soft X-Ray Laser", Applied Physics B, vol. 58, No. 1, 1994, 19-55.
Pierce, et al., "Advanced Drilling Systems Study", Sand95-0331, 1996, 1-IX-26.
Ploeger, et al., "Optimisation of the core shroud bypass flow in the nuclear power plant Unterweser, Part 2: Hardware Implementation", 9, International Conference on Nuclear Engineering, Nice Acropolis (France), 2001.
Pronko, et al., "Megajoule Pulsed Power Experiments for Plasma Blasting Mining Applications", 1993 Pulsed Power Conference, 1993, 15-18.
Puharic, et al., "Overvoltage Analysis on Submarine Cables of Atmospheric Origins and Due to Switching Operations", CIRED: 14th International Conference and Exhibition on Electricity Distribution. Proceedings. Part. 1: Contrubutions, 1997, 2.44.1-2.44.5.
Res, et al., "Disintegration of hard rocks by the electrohydrodynamic method", Mining Engineering, 1987, 44-47.

(56) References Cited

OTHER PUBLICATIONS

Rocca, et al., "Demonstration of Discharge Pumped Table-Top Soft-X-Ray Laser", Physical Review Letters, vol. 73, No. 16, 1994, 2192-2195.
Rocca, et al., "Discharge-Driven 46.9-nm Amplifier with Gain-Length Approaching Saturation", IEEE Journal-Topics in Quantum Electronics, vol. 1, No. 3, 1995, 945-948.
Rocca, et al., "Discharge-Pumped Soft-X-Ray Laser in Neon-Like Argon", Phys. Plasma, vol. 2, No. 6, 1995, 2547-2554.
Rocca, et al., "Fast Discharge Excitation of Hot Capillary Plasmas for Soft-X-Ray Amplifiers", Physical Review E, vol. 47, No. 2, 1993, 1299-1304.
Saini-Eidukat, et al., "Liberation of Fossils Using High Voltage Electric Pulses", Curator, vol. 39, 1996, 139-144.
Saprykin, et al., "Deformation of a spherical shell under internal loading by a shock generated by an underwater electrical discharge", Sov Appl Mech, Oct. 1988, 392-396.
Timoshkin, et al., "Plasma Channel Microhole Drilling Technology", Applied Electrical Technologies Group, Institute for Energy and Environment Department of Electronic & Electrical Engineering, University of Strathclyde, Abstract No. 10774, Jun. 2003, 1336-1339.
Timoshkin, et al., "Plasma Channel Miniature Hole Drilling Technology", IEEE Transactions on Plasma Science, vol. 32, No. 5, Oct. 2004, 2055-2061.
Vovchenko, et al., "Underwater pulse discharge (UPD) and its technological applications", Proc 3 Int Conf Prop Appl Dielectr Mater. Publ by IEEE, 1991, 1254-1257.
Ward, et al., "Identification of frictional ignition potential for rocks in Australian coal mines", Safety in Mines: the Role of Geology, 1997, 169-175.
Weise, et al., "Experimental investigations on rock fractioning by replacing explosives with electrically generated pressure pulses", IEEE International Pulsed Power Conference—Digest of Technical papers v 1, 1993, 19-22.
Yan, et al., "A 10 kW high-voltage pulse generator for corona plasma generation", Rev. Sci. Instrum. 72, 2001, 2443.
Yokawa, et al., "Pulse energization system applied for fluidized bed combustors", Sumitomo Jukikai Giho, Apr. 20, 1993, 85-89.
Ziemer, et al., "Performance Characterization of a High Efficiency Gas-Fed Pulsed Plasma Thruster", 33rd Joint—Propulsion Conference, Seattle, Washing, Jul. 1997, 1-12.
Ziemer, et al., "Performance Scaling of Gas-Fed Pulsed Plasma Thrusters", A Dissertation presented to the Faculty of Princeton University, Jun. 2001, 1-232.
Zorin, et al., "Breaking of Coal", Institute of Geotechnical Mechanics, 1989, 242-244.

* cited by examiner

REPETITIVE PULSED ELECTRIC DISCHARGE APPARATUSES AND METHODS OF USE

CROSS-REFERENCES TO RELATED APPLICATIONS

This application is a continuation-in-part application of International Patent Application PCT/US13/76262, entitled "Repetitive Pulsed Electric Discharge Apparatuses and Methods of Use, filed on Dec. 18, 2013, which claims priority to and the benefit of U.S. Provisional Patent Application Ser. No. 61/738,753, entitled "Repetitive Pulsed Electric Discharge Instrumentation Apparatus and Method of Use", filed on Dec. 18, 2012; U.S. Provisional Patent Application Ser. No. 61/738,837, entitled "Repetitive Pulsed Electric Discharge Power Generation and Control Apparatus and Method of Use", filed on Dec. 18, 2012; U.S. Provisional Patent Application Ser. No. 61/739,144, entitled "Repetitive Pulsed Electric Discharge Nutating Bit Apparatus and Method of Use", filed on Dec. 19, 2012; U.S. Provisional Patent Application Ser. No. 61/739,172, entitled "Repetitive Pulsed Electric Discharge Apparatus and Method of Use", filed on Dec. 19, 2012; U.S. Provisional Patent Application Ser. No. 61/739,187, entitled "Repetitive Pulsed Electric Discharge Fluid Flow Control Apparatus and Method of Use", filed on Dec. 19, 2012; U.S. Provisional Patent Application Ser. No. 61/740,812, entitled "Repetitive Pulsed Electric Discharge Drill Bit Apparatus and Method of Use", filed on Dec. 21, 2012; U.S. Provisional Patent Application Ser. No. 61/749,071, entitled "Apparatus and Method for Producing Electromagnetic Energy", filed on Jan. 4, 2013; and U.S. Provisional Patent Application Ser. No. 61/905,060, entitled "Repetitive Pulsed Electric Discharge Apparatuses and Methods of Use", filed on Nov. 15, 2013. The specification and claims of these applications are incorporated herein by reference.

International Patent Application PCT/US13/76262, entitled "Repetitive Pulsed Electric Discharge Apparatuses and Methods of Use", filed on Dec. 18, 2013, is also a continuation in part application of U.S. patent application Ser. No. 13/935,995, entitled "Apparatuses and Methods for Supplying Electrical Power to an Electrocrushing Drill", filed on Jul. 5, 2013, which claims priority to and the benefit of U.S. Provisional Patent Application Ser. No. 61/668,304, entitled "Apparatus and Method for Supplying Electrical Power to an Electrocrushing Drill", filed on Jul. 5, 2012; U.S. Provisional Patent Application Ser. No. 61/738,837, entitled "Repetitive Pulsed Electric Discharge Power Generation and Control Apparatus and Method of Use", filed on Dec. 18, 2012; and U.S. Provisional Patent Application Ser. No. 61/739,172, entitled "Repetitive Pulsed Electric Discharge Apparatus and Method of Use", filed on Dec. 19, 2012, the specification and claims of which are incorporated herein by reference.

This application is related to U.S. patent application Ser. No. 14/694,517, entitled "Apparatus and Method for Supplying Electrical Power to an Electrocrushing Drill", filed on Apr. 23, 2015, which is a divisional application of U.S. patent application Ser. No. 13/346,452, entitled "Apparatus and Method for Supplying Electrical Power to an Electrocrushing Drill", filed Jan. 9, 2012, and issued as U.S. Pat. No. 9,016,359 on Apr. 28, 2015, which is a continuation-in-part application and claims the benefit and priority of U.S. patent application Ser. No. 12/502,977, filed Jul. 14, 2009, entitled "Apparatus and Method for Electrocrushing Rock"; which is a continuation-in-part application and claims priority of U.S. patent application Ser. No. 11/479,346, filed Jun. 29, 2006, entitled "Portable and Directional Electrocrushing Drill", and issued as U.S. Pat. No. 7,559,378 on Jul. 14, 2009; which is a continuation-in-part application and claims priority to U.S. Pat. No. 7,527,108, entitled "Portable Electrocrushing Drill", filed on Feb. 22, 2006 and issued on May 5, 2009; which is a continuation-in-part application and claims priority to U.S. Pat. No. 7,416,032, entitled "Pulsed Electric Rock Drilling Apparatus", filed on Aug. 19, 2005, and issued on Aug. 26, 2008; and U.S. Pat. No. 7,530,406, entitled "Method of Drilling Using Pulsed Electric Drilling", filed Nov. 20, 2006, and issued on May 12, 2009, which claim priority to Provisional Application Ser. No. 60/603,509, entitled "Electrocrushing FAST Drill and Technology, High Relative Permittivity Oil, High Efficiency Boulder Breaker, New Electrocrushing Process, and Electrocrushing Mining Machine", filed on Aug. 20, 2004; and the specification and claims of these foregoing applications and patents are incorporated herein by reference. This application is also related to U.S. patent application Ser. No. 11/208,671 entitled "Pulsed Electric Rock Drilling Apparatus," filed Aug. 19, 2005, U.S. Utility application Ser. No. 11/561,840 entitled "Method of Drilling Using Pulsed Electric Drilling;" filed Nov. 20, 2006; U.S. Utility application Ser. No. 11/360,118 entitled "Portable Electrocrushing Drill;" filed Feb. 22, 2006; PCT Patent Application PCT/US06/006502 entitled "Portable Electrocrushing Drill;" filed Feb. 23, 2006; U.S. Utility application Ser. No. 11/479,346 entitled "Method of Drilling Using Pulsed Electric Drilling;" filed Jun. 29, 2006; PCT Patent Application PCT/US07/72565 entitled "Portable Directional Electrocrushing Drill; filed Jun. 29, 2007; U.S. Utility application Ser. No. 11/561,852 entitled "Fracturing Using a Pressure Pulse," filed Nov. 20, 2006; U.S. patent application Ser. No. 13/466,296 entitled "Pulsed Electric Rock Drilling Apparatus with Non-Rotating Bit and Directional Control", filed May 8, 2012, which is a divisional of U.S. patent application Ser. No. 12/198,868, entitled "Pulsed Electric Rock Drilling Apparatus with Non-Rotating Bit and Directional Control", filed on Aug. 26, 2008, which is a continuation-in-part application of U.S. Pat. No. 7,416,032, entitled "Pulsed Electric Rock Drilling Apparatus", filed on Aug. 19, 2005 and issued on Aug. 26, 2008, and U.S. Pat. No. 7,530,406, entitled "Method of Drilling Using Pulsed Electric Drilling", filed Nov. 20, 2006 and issued on May 12, 2009; which claim priority to Provisional Application Ser. No. 60/603,509, entitled "Electrocrushing FAST Drill and Technology, High Relative Permittivity Oil, High Efficiency Boulder Breaker, New Electrocrushing Process, and Electrocrushing Mining Machine", filed on Aug. 20, 2004; and the specification and claims of these applications and patents are incorporated herein by reference. This application is also related to U.S. patent application Ser. No. 11/208,579, entitled "Pressure Pulse Fracturing System", filed on Aug. 19, 2005; U.S. patent application Ser. No. 11/208,766, entitled "High Permittivity Fluid", filed on Aug. 19, 2005; and U.S. Pat. No. 7,384,009, entitled "Virtual Electrode Mineral Particle Disintegrator", filed on Aug. 19, 2005, and issued on Jun. 10, 2008; and the specification and claims of these patent applications and patents are incorporated herein by reference.

BACKGROUND OF THE INVENTION

Field of the Invention (Technical Field)

The present invention relates to an electrocrushing drill, particularly a portable drill that utilizes an electric spark, or plasma, within a substrate to fracture the substrate. An embodiment of the present invention comprises two pulsed power systems coordinated to fire one after the other.

Description of Related Art

Note that where the following discussion refers to a number of publications by author(s) and year of publication, because of recent publication dates certain publications are not to be considered as prior art vis-a-vis the present invention. Discussion of such publications herein is given for more complete background and is not to be construed as an admission that such publications are prior art for patentability determination purposes.

Processes using pulsed power technology are known in the art for breaking mineral lumps. Typically, an electrical potential is impressed across the electrodes which contact the rock from a high voltage electrode to a ground electrode. At sufficiently high electric field, an arc or plasma is formed inside rock from the high voltage electrode to the low voltage or ground electrode. The expansion of the hot gases created by the arc fractures the rock. When this streamer connects one electrode to the next, the current flows through the conduction path, or arc, inside the rock. The high temperature of the arc vaporizes the rock and any water or other fluids that might be touching, or are near, the arc. This vaporization process creates high-pressure gas in the arc zone, which expands. This expansion pressure fails the rock in tension, thus creating rock fragments.

It is advantageous in such processes to use an insulating liquid that has a high relative permittivity (dielectric constant) to shift the electric fields in to the rock in the region of the electrodes.

Water is often used as the fluid for mineral disintegration process. The drilling fluid taught in U.S. patent Ser. No. 11/208,766 titled "High Permittivity Fluid" is also applicable to the mineral disintegration process.

Another technique for fracturing rock is the plasma-hydraulic (PH), or electrohydraulic (EH) techniques using pulsed power technology to create underwater plasma, which creates intense shock waves in water to crush rock and provide a drilling action. In practice, an electrical plasma is created in water by passing a pulse of electricity at high peak power through the water. The rapidly expanding plasma in the water creates a shock wave sufficiently powerful to crush the rock. In such a process, rock is fractured by repetitive application of the shock wave. U.S. Pat. No. 5,896,938, to the present inventor, discloses a portable electrohydraulic drill using the PH technique.

The rock fracturing efficiency of the electrocrushing process is much higher than either conventional mechanical drilling or electrohydraulic drilling. This is because both of those methods crush the rock in compression, where rock is the strongest, while the electrocrushing method fails the rock in tension, where it is relatively weak. There is thus a need for a portable drill bit utilizing the electrocrushing methods described herein to, for example, provide advantages in underground hard-rock mining, to provide the ability to quickly and easily produce holes in the ceiling of mines for the installation of roofbolts to inhibit fall of rock and thus protect the lives of miners, and to reduce cost for drilling blast holes. There is also a need for an electrocrushing method that improves the transfer of energy into the substrate, overcoming the impedance of a conduction channel in a substrate.

BRIEF SUMMARY OF THE INVENTION

One embodiment of the present invention comprises an apparatus for controlling power delivered to a down-hole pulsed power system in a bottom hole assembly. The apparatus of this embodiment preferably comprises a cable for providing power from a surface to the pulsed power system, a command charge switch disposed between an end of the cable and a prime power system on the surface. The command charge switch is fired on command to control when power produced by the primary power system is fed into the cable thereby controlling power provided to the pulsed power system in the bottom hole assembly. The bottom hole assembly preferably comprises a non-rotating drill bit. The pulsed power system comprises at least one capacitor disposed near the drill bit. The prime power system preferably produces a medium voltage DC power to charge at least one prime power system capacitor that is connected by the command charge switch to the cable. The command charge switch preferably controls when the medium voltage DC power on the prime power capacitor is switched on to the cable and transmitted to the pulsed power system. The command charge switch preferably controls a duration of a charge voltage on the pulsed power system in the bottom hole assembly. The command charge switch can control a voltage waveform on the cable. The prime power system preferably dampens cable oscillations. The prime power system preferably incorporates a diode-resistor set to dampen cable oscillations.

Another embodiment of the present invention comprises a method for controlling power delivered to a pulsed power system using a command control switch. This method comprises disposing the pulsed power system in a bottom hole assembly, providing power to the pulsed power system via a cable, disposing a command charge switch between an end of the cable and a prime power system on the surface, and firing the command charge switch thereby controlling when the power produced by the prime power system is fed into the cable and controlling the power delivered to the pulsed power system in the bottom hole assembly. The bottom hole assembly comprises a non-rotating drill bit. The prime power system produces a medium voltage DC power to charge at least one prime power system capacitor that is connected to the cable by the command charge switch. The command control switch controlling when the medium voltage DC power on the prime power capacitor is switched on to the cable, controlling a duration of charge voltage on the pulsed power system in the bottom hole assembly, and controlling a voltage waveform on the cable. The pulsed power system dampening cable oscillations.

Yet another embodiment of the present invention comprises an apparatus for conducting electric current from a top-hole environment to a down-hole pulsed power system in a bottom hole assembly. This apparatus preferably comprises a drill pipe comprising first and second connectable sections, the drill pipe sections comprising a plurality of embedded conductors, male contacts disposed on the embedded conductors of a first connectable section, female contacts disposed on the embedded conductors of a second connectable section, the male contacts and female contacts capable of alignment, at least one drill pipe connector for connecting the first connectable section to the second connectable section to form at least a portion of the drill pipe, the connector isolating one embedded conductor from another conductor. The apparatus can also comprise additional connectable sections alternating between embedded connectors comprising male contacts and embedded connectors comprising female contacts. The drill pipe of this embodiment is preferably non-conductive except the embedded conductors and does not carry mechanical high torque loads. The connector of this embodiment preferably comprises a non-rotating connector, such as for example, a stab-type connector or a turnbuckle connector. The conductors of this embodiment comprise a conduction of current of at least about 1 amp average current. The conductors can also carry high-voltage current. For example, the current can be a voltage of at least about 1 kV. The apparatus of this embodiment can also comprise low voltage conductors for carrying low-voltage data signal. The low-voltage conductors can carry current at a voltage of about 1 to about 500 volts. The low-voltage conductors are preferably isolated from the high voltage conductors. The connectors can optionally comprise disconnect devices. The connectors enable connection of the drill pipe sections without relative rotation to enable alignment of the electrical conductors. At least a portion of the drill pipe can comprise a dielectric material, a metallic material and/or a combination of dielectric materials and metallic materials. The apparatus can further comprise additional connectable sections alternating between embedded connectors comprising male contacts and embedded connectors comprising female contacts.

One embodiment of the present invention comprises a method of conducting electric current from a top-hole environment to a down-hole pulsed power system in a bottom hole assembly. The method preferably comprises providing a drill pipe comprising two or more connectable sections and a plurality of embedded conductors, disposing male electrical connectors on the plurality of embedded conductors of a first connectable section, disposing female electrical connectors on the plurality of embedded conductors of a second connectable section, aligning the male electrical connectors with the female electrical connectors, connecting the connectable sections together using at least one drill pipe connector, isolating the embedded conductors from each other, and conducting electrical current from a top-hole environment to a down-hole pulsed power system in a bottom hole assembly. Current is preferably conducted at about 1 amp average current. High-voltage current can be carried in at least some of the plurality of embedded conductors. The high-voltage current is preferably at least about 1 kV. Low-voltage current can also be carried in at least some of the plurality of embedded conductors. The embedded conductors are preferably insulated. The connectable sections are preferably connected without relative rotation. This method can also comprise alternating between embedded connectors comprising male contacts and embedded connectors comprising female contacts.

Another embodiment of the present invention is an apparatus for providing power to a down-hole pulsed power system, the apparatus comprising an above-ground power supply, a down-hole pulsed power system, and a cable directly connected to the above-ground power supply and the down-hole pulsed power system. The cable is optionally between approximately 500 feet and approximately 30,000 feet in length. The down-hole pulsed power system preferably comprises one or more capacitors which are directly charged from the power supply. The power supply optionally comprises a switching power supply, which preferably utilizes controlled high-frequency current pulses to progressively increase a voltage of the one or more capacitors and preferably measures the voltage and adjusting the current to achieve a desired end state voltage on the capacitors. The power supply preferably comprises a DC power supply, and preferably comprises both a separate second cable for monitoring the capacitor voltage to control the end state voltage and a high voltage probe for monitoring the capacitor voltage, the probe located in the down-hole and transmitting control signals to the surface via the separate second cable. The power supply optionally comprises an AC power supply, in which case the apparatus preferably further comprises a rectifier in the down-hole pulsed power system and a separate second cable for monitoring voltage and/or transmitting voltage monitoring data at a different frequency along the second cable. The apparatus preferably further comprises above-ground voltage control circuitry for receiving voltage data from the capacitors and controlling a current output and/or voltage output from the power supply.

Another embodiment of the present invention is a method for providing power to a down-hole pulsed power system, the method comprising directly charging one or more capacitors in a down-hole pulsed power system from an above-ground power supply. The method preferably further comprises connecting a cable between the above-ground power supply and the down-hole pulsed power system. The power supply optionally comprises a switching power supply in which case the method preferably further comprises utilizing controlled high-frequency current pulses to progressively increase a voltage of the one or more capacitors and preferably further comprises measuring the voltage and adjusting the current to achieve a desired end state voltage on the capacitors. The power supply preferably comprises a DC power supply in which case the method further comprises monitoring the capacitor voltage to control the end state voltage, transmitting control signals to the surface via a signal cable, or alternatively transmitting control signals to the surface on the power cable as an AC signal superimposed on the DC power current, preferably by inductively coupling the control signals into the power cable down-hole and inductively extracting the control signals from the power cable at the surface. The power supply optionally comprises an AC power supply in which case the method comprises rectifying the AC power down-hole and monitoring voltage and/or transmitting voltage monitoring data at a different frequency along a signal cable. The method preferably further comprises receiving voltage data from the capacitors and controlling a current output and/or voltage output from the power supply.

Yet another embodiment of the present invention is a method for providing power to a down-hole pulsed power system, the method comprising transmitting microwaves from an above-ground microwave transmitter to a down-hole microwave receiver and charging one or more capacitors in a down-hole pulsed power system. The method preferably further comprises providing a microwave bandwidth sufficient for transmitting both data and bower to the down-hole pulsed power system. The method preferably further comprises transmitting data back to the surface using a down-hole low power transmitter. The method preferably further comprises using a metallic drill pipe used to provide drilling fluid as a microwave waveguide, thereby minimizing losses and improving power transmission. The method preferably further comprises using a drilling fluid comprising a property selected from the group consisting of non-conductive, non-aqueous, insulating, and dielectric.

Another embodiment of the present invention is an electrocrushing drill bit comprising one or more high voltage electrodes surrounded by a current return structure comprising a plurality of circumferential openings for facilitating removal of drilling debris from the drill bit. The drill bit preferably comprises a plurality of rod shaped high voltage electrodes arranged in at least a portion of a circle. The high voltage electrodes optionally surround one or more rod shaped central current return electrodes, which optionally are arranged in at least a portion of a circle concentric with the high voltage electrodes. The current return structure optionally comprises a current return ring which is preferably sufficiently strong to structurally support a drill string. The current return structure optionally comprises a plurality of rod shaped circumferential current return electrodes located at an outer rim of the drill bit and the circumferential openings comprise spaces between the circumferential current return electrodes. The circumferential current return electrodes are preferably concentric with a plurality of high voltage electrodes arranged in at least a portion of a circle. The drill bit may optionally further comprise a central current return electrode located approximately at a center of the circle. The drill bit may optionally comprise a wall connecting the circumferential current return electrodes, the wall preferably thinner than a diameter of each the circumferential current return electrode and disposed so that the wall extends radially outwardly as far as or beyond the circumferential current return electrode, thereby longitudinally extending an outer wall of the drill bit, but does not extend past the circumferential current return electrodes radially inwardly. The height of the wall is preferably shorter than a length of the circumferential current return electrodes. The wall and the circumferential current return electrodes are preferably manufactured together to form a single structure. The wall optionally comprises a plurality of additional openings to facilitate removal of drilling debris from the drill bit. The circumferential current return electrodes preferably comprise a cross-sectional shape selected from the group consisting of circle, ellipse, wedge, and airfoil. The drill bit optionally comprises a single high voltage electrode surrounded by a plurality of circumferential current return electrodes and optionally comprises a plurality of channels running longitudinally along an outer surface of the drill bit to facilitate transport of drilling debris up and out of a drilling hole.

The current return structure optionally partially covers a bottom face of the drill bit, the current return structure comprising one or more bottom openings along the bottom face, wherein one or more of the high voltage electrodes is disposed within each the bottom opening. The drill bit preferably comprises a channel at approximately a center of the bottom face for flowing drilling fluid into the bit. The current return structure preferably comprises a solid portion disposed near the channel, thereby forcing at least some of the flowing drilling fluid to flow radially from the channel toward and around each the high voltage electrode. The flowing drilling fluid preferably sweeps drilling debris and bubbles in the fluid created by operation of the electrodes out of the drill bit. The high voltage electrodes are optionally rod shaped and arranged to form at least a portion of a circle centered on a center of the bottom face. Each the high voltage electrode is preferably compressible and/or extends out from the bottom face. Two or more of the high voltage electrodes are optionally electrically connected to form one or more sets of connected electrodes, each set powered by a separate pulsed power system. Preferred operation of one or more of the sets over one or more other of the sets preferably results in directional control of the drill bit. The electrodes in each set are optionally mechanically linked to move together. Each bottom opening is preferably sector-shaped or substantially triangular. The high voltage electrodes are optionally substantially triangular or sector shaped and are circumferentially arranged around a center of the bottom face, each high voltage electrode oriented so that one of its vertices is pointing toward the center. The drill bit is preferably connected to a bottom hole assembly via a rotational joint and a motor for nutating the drill bit. Nutation of the drill bit preferably results in more uniform drilling despite non-uniform electric field distributions produced by the high voltage electrodes.

The present invention is also a method for imaging a formation ahead of an electrocrushing drill bit, the method comprising providing a current pulse to a conducting loop disposed on or in an electrocrushing drill bit assembly, thereby generating a pulsed magnetic field which penetrates the formation ahead of the drill bit. Providing the pulse preferably comprises operating a pulsed power circuit operating at tens of kilovolts and a few kiloamps and a separate pulsed power subsystem generating the current pulse. The separate pulsed power subsystem preferably uses the same power source, instrumentation, charging system, and control system used during operation of the electrocrushing drill bit. The conducting loop is optionally oriented so that a plane of the conducting loop is either perpendicular to or parallel to the axis of the drill bit assembly. Providing a current pulse preferably comprises using current from one or more electrocrushing electrodes during operation of the electrocrushing drill bit. The conducting loop is preferably connected in series or in parallel with the one or more electrocrushing electrodes. The method optionally further comprises changing phasing of current through each of a plurality of current loops, thereby steering a maxima of the produced magnetic field through the formation.

The present invention is also an apparatus for imaging a formation ahead of an electrocrushing drill bit, the apparatus comprising: a current pulse source and a conducting loop disposed on or in an electrocrushing drill bit assembly for generating a magnetic field which penetrates the formation ahead of the drill bit. The current pulse source preferably comprises a separate pulsed power subsystem which preferably uses the same power source, instrumentation, charging system, and control system used during operation of the electrocrushing drill bit and preferably comprises a pulsed power circuit operating at tens of kilovolts and a few kiloamps. The current pulse source optionally also powers one or more electrocrushing electrodes, in which case the conducting loop is optionally connected in series or in parallel with the one or more electrocrushing electrodes. The plane of the conducting loop is optionally oriented substantially perpendicular or parallel to the axis of the electrocrushing drill bit assembly. The apparatus optionally comprises a plurality of conducting loops having different orientations. The apparatus preferably further comprises one or more sensors for sensing the magnetic field.

The present invention is also a method for operating an electrocrushing drill, the method comprising sending a signal from a control and data acquisition system on the surface to fire one or more pulsed power systems driving one or more electrodes of an electrocrushing drill bit; ceasing transmitting data from a downhole data acquisition and communication system to the surface controller; producing a firing pulse to fire the one or more pulsed power systems; the downhole data acquisition and communication system acquiring data produced by the firing step; and transmitting the data to the control and data acquisition system after completion of the firing pulse. The data preferably comprises one or more parameters selected from the group consisting of peak current, peak voltage, spiker current, spiker voltage, sustainer current, sustainer voltage, drill geophysical location, average power consumption of the drill, temperature of circuit pulsed power components and fluid systems, fluid flow pressure at one or more downhole locations, fluid flow rate, ambient temperature, and ambient pressure. The ceasing and firing steps are optionally performed simultaneously. The signal is preferably sent over a direct connection between the control and data acquisition system and the data acquisition and downhole communication system. The transmitting step preferably comprises transmitting the data sufficiently fast to enable a drill operator to protect against a blowout, enabling the operator to slow progress of the bit before a blowout occurs. The data acquisition and communication system preferably stores the data until completion of the firing pulse.

The present invention is also an apparatus for operating an electrocrushing drill, the apparatus comprising a control and data acquisition system on the surface for sending a firing pulse to fire one or more pulsed power systems driving one or more electrodes of an electrocrushing drill bit; a downhole data acquisition and communication system for acquiring and storing data from one or more downhole sensors during the firing pulse; a direct connection between the control and data acquisition system and the downhole data acquisition and communication system; wherein the downhole data acquisition and communication system is configured to transmit the data over the direct connection to the control and data acquisition system after completion of the firing pulse. The direct connection comprises a cable, or conductors embedded in pipe, or a fiber optic connection. The downhole data acquisition and communication system connects to the cable through a rotating interface at the center of a cable reel or through a side entry sub so, thereby enabling the cable to run on the outside and/or partially inside of a drill pipe. The downhole data acquisition and communication system is preferably located near a top of a bottom hole assembly. The sensors are preferably selected from the group consisting of packaged MEMS gyroscope device, solid-state ring laser gyroscope, fiber optic gyroscope, temperature sensor, pressure sensor, B-dot probe, resistive probe, capacitive probe, probe utilizing optical effects, current transformer, E-dot probe, rotating flow meter, capacitive flow meter, inductive flow meter, venturi-type meter, and rotational pump speed sensor. A connection between the one or more downhole sensors and the downhole data acquisition and communication system is preferably shielded from noise, preferably comprising a coaxial cable, a fiber optic link, RF data transmission, and/or direct laser data transmission.

The present invention is also a method for cooling an electrocrushing drill, the method comprising flowing a first portion of a fluid stream adjacent to high power electrical components and using a second portion of the fluid stream to sweep drilling debris and bubbles out from an electrocrushing bit. The method preferably further comprises controlling a flow velocity of the first portion. The method preferably further comprises combining the first portion and the second portion to form a merged flow. The method preferably further comprises flowing the second portion and/or the merged flow radially outward from the center of the bit. The present invention is also an apparatus for cooling an electrocrushing bit, the apparatus comprising one or more conduits for receiving a first portion of a fluid flow; one or more plenums or passages in fluid connection with the one or more conduits, the one or more plenums in thermal contact with or enclosing one or more high power electrical components; and one or more channels for flowing a second portion of the fluid flow to an electrocrushing bit. The apparatus preferably further comprises a controller for controlling a flow velocity of the first portion. The apparatus preferably further comprises a flow diverter shield for protecting the components from direct flow of the second portion. The apparatus preferably further comprises one or more tubes disposed in the one or more plenums or passages for enclosing electrical lines. The apparatus preferably further comprises a flow combiner for combining the first portion and the second portion.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
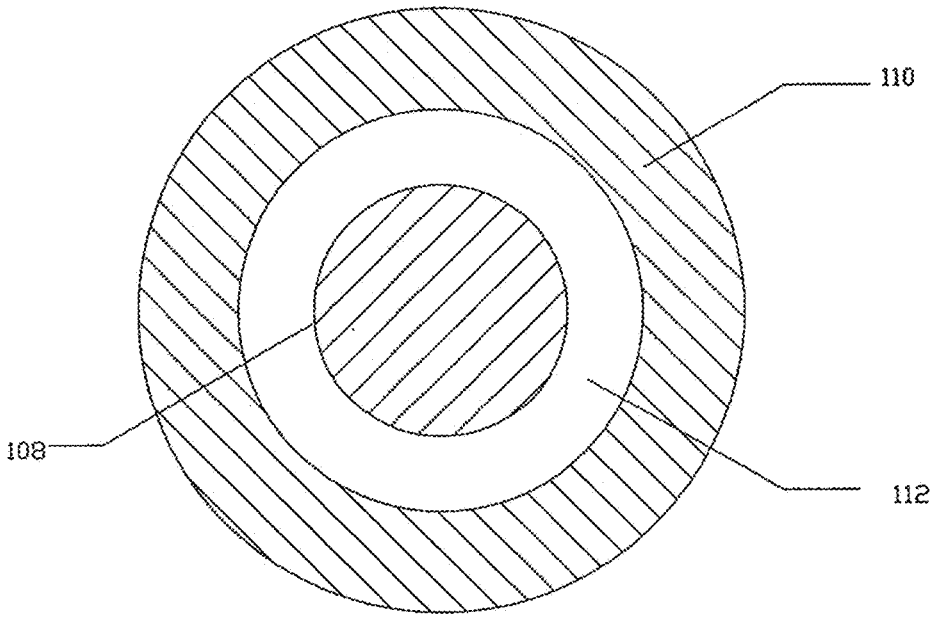
FIG. 1 shows an end view of a coaxial electrode set for a cylindrical bit of an embodiment of the present invention.

The present invention provides for pulsed power breaking and drilling apparatuses and methods. A pulsed power breaking and drill apparatus is also known as a repetitive pulsed electric discharge apparatus. As used herein, "drilling" is defined as excavating, boring into, making a hole in, or otherwise breaking and driving through a substrate. As used herein, "bit" and "drill bit" are defined as the working portion or end of a tool that performs a function such as, but not limited to, a cutting, drilling, boring, fracturing, or breaking action on a substrate (e.g., rock). As used herein, the term "pulsed power" is that which results when electrical energy is stored (e.g., in a capacitor or inductor) and then released into the load so that a pulse of current at high peak power is produced. "Electrocrushing" ("EC") is defined herein as the process of passing a pulsed electrical current through a mineral substrate so that the substrate is "crushed" or "broken".

Electrocrushing Bit

An embodiment of the present invention provides a drill bit on which is disposed one or more sets of electrodes. In this embodiment, the electrodes are disposed so that a gap is formed between them and are disposed on the drill bit so that they are oriented along a face of the drill bit. In other words, the electrodes between which an electrical current passes through a mineral substrate (e.g., rock) are not on opposite sides of the rock. Also, in this embodiment, it is not necessary that all electrodes touch the mineral substrate as the current is being applied. In accordance with this embodiment, at least one of the electrodes extending from the bit toward the substrate to be fractured and may be compressible (i.e., retractable) into the drill bit by any means known in the art such as, for example, via a spring-loaded mechanism.

Generally, but not necessarily, the electrodes are disposed on the bit such that at least one electrode contacts the mineral substrate to be fractured and another electrode that usually touches the mineral substrate but otherwise may be close to, but not necessarily touching, the mineral substrate so long as it is in sufficient proximity for current to pass through the mineral substrate. Typically, the electrode that need not touch the substrate is the central, not the surrounding, electrode.

Therefore, the electrodes are disposed on a bit and arranged such that electrocrushing arcs are created in the rock. High voltage pulses are applied repetitively to the bit to create repetitive electrocrushing excavation events. Electrocrushing drilling can be accomplished, for example, with a flat-end cylindrical bit with one or more electrode sets. These electrodes can be arranged in a coaxial configuration.

The electrocrushing (EC) drilling process does not require rotation of the bit. The electrocrushing drilling process is capable of excavating the hole out beyond the edges of the bit without the need of mechanical teeth. In addition, by arranging many electrode sets at the front of the bit and varying the pulse repetition rate or pulse energy to different electrode sets, the bit can be steered through the rock by excavating more rock from one side of the bit than another side. The bit turns toward the electrode sets that excavate more rock relative to the other electrode sets.

Figure 2A:
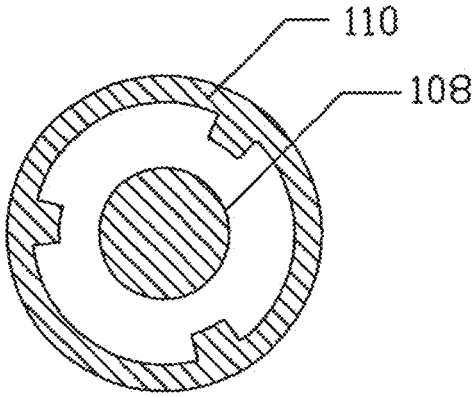
FIGS. 2A, 2B and 2C each show an alternate embodiment of FIG. 1.
Figure 2B:
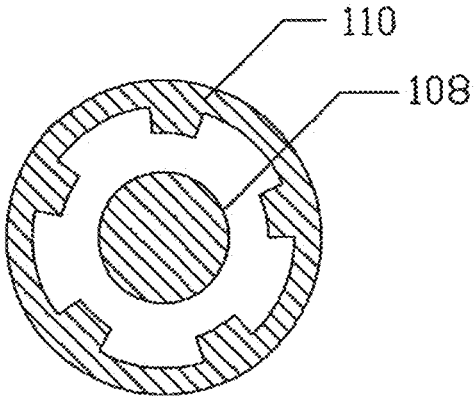
Figure 2C:
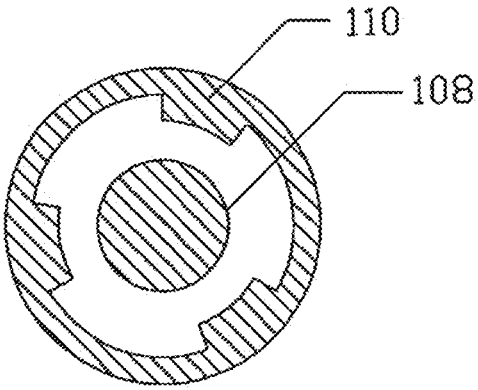
Figure 3:
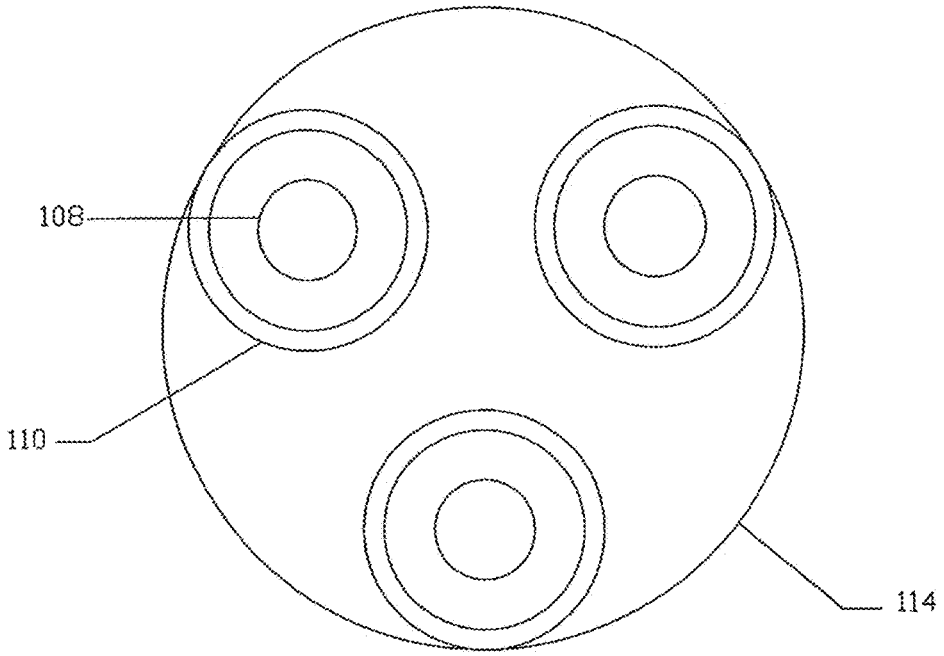
FIG. 3 shows an alternate embodiment of a plurality of coaxial electrode sets.

FIG. 1 shows an end view of such a coaxial electrode set configuration for a cylindrical bit, showing high voltage or center electrode 108, ground or surrounding electrode 110, and gap 112 for creating the arc in the rock. Variations on the coaxial configuration are shown in FIGS. 2A, 2B and 2C. A non-coaxial configuration of electrode sets arranged in bit housing 114 is shown in FIG. 3. FIGS. 2A, 2B, 2C and FIG. 3 show ground electrodes that are completed circles. Other embodiments may comprise ground electrodes that are partial circles, partial or compete ellipses, or partial or complete parabolas in geometric form.

Figure 4:
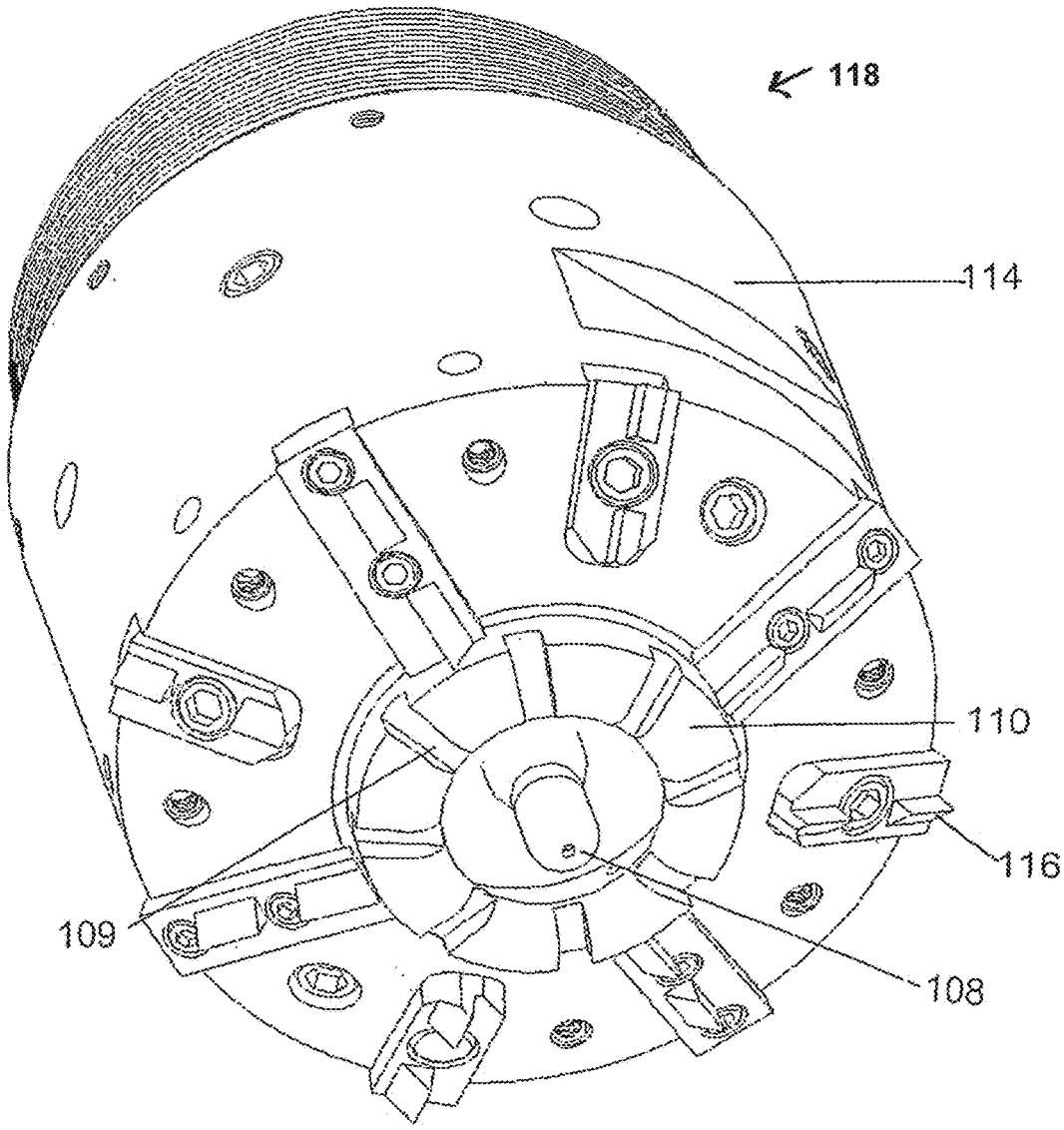
FIG. 4 shows a conical bit of an embodiment of the present invention.

For drilling larger holes, a conical bit may be utilized, especially if controlling the direction of the hole is important. Such a bit may comprise one or more sets of electrodes for creating the electrocrushing arcs and may comprise mechanical teeth to assist the electrocrushing process. One embodiment of the conical electrocrushing bit has a single set of electrodes, may be arranged coaxially on the bit, as shown in FIG. 4. In this embodiment, conical bit 118 comprises a center electrode 108, the surrounding electrode 110, the bit case or housing 114 and mechanical teeth 116 for drilling the rock. Either, or both, electrodes may be compressible. The surrounding electrode may have mechanical cutting teeth 109 incorporated into the surface to smooth over the rough rock texture produced by the electrocrushing process. In this embodiment, the inner portion of the hole is drilled by the electrocrushing portion (i.e., electrodes 108 and 110) of the bit, and the outer portion of the hole is drilled by mechanical teeth 116. This results in high drilling rates, because the mechanical teeth have good drilling efficiency at high velocity near the perimeter of the bit, but very low efficiency at low velocity near the center of the bit. The geometrical arrangement of the center electrode to the ground ring electrode is conical with a range of cone angles from 180 degrees (flat plane) to about 75 degrees (extended center electrode).

An alternate embodiment is to arrange a second electrode set on the conical portion of the bit. In such an embodiment, one set of the electrocrushing electrodes operates on just one side of the bit cone in an asymmetrical configuration as exemplified in FIG. 5 which shows a dual-electrode set conical bit, each set of electrodes comprising center electrode 108, surrounding electrode 110, bit case or housing 114, mechanical teeth 116, and drilling fluid passage 120.

The combination of the conical surface on the bit and the asymmetry of the electrode sets results in the ability of the dual-electrode bit to excavate more rock on one side of the hole than the other and thus to change direction. For drilling a straight hole, the repetition rate and pulse energy of the high voltage pulses to the electrode set on the conical surface side of the bit is maintained constant per degree of rotation. However, when the drill is to turn in a particular direction, then for that sector of the circle toward which the drill is to turn, the pulse repetition rate (and/or pulse energy) per degree of rotation is increased over the repetition rate for the rest of the circle. In this fashion, more rock is removed by the conical surface electrode set in the turning direction and less rock is removed in the other directions (See FIG. 8, discussed in detail below).

Because of the conical shape of the bit, the drill tends to turn into the section where greater amount of rock was removed and therefore control of the direction of drilling is achieved.

Figure 5:
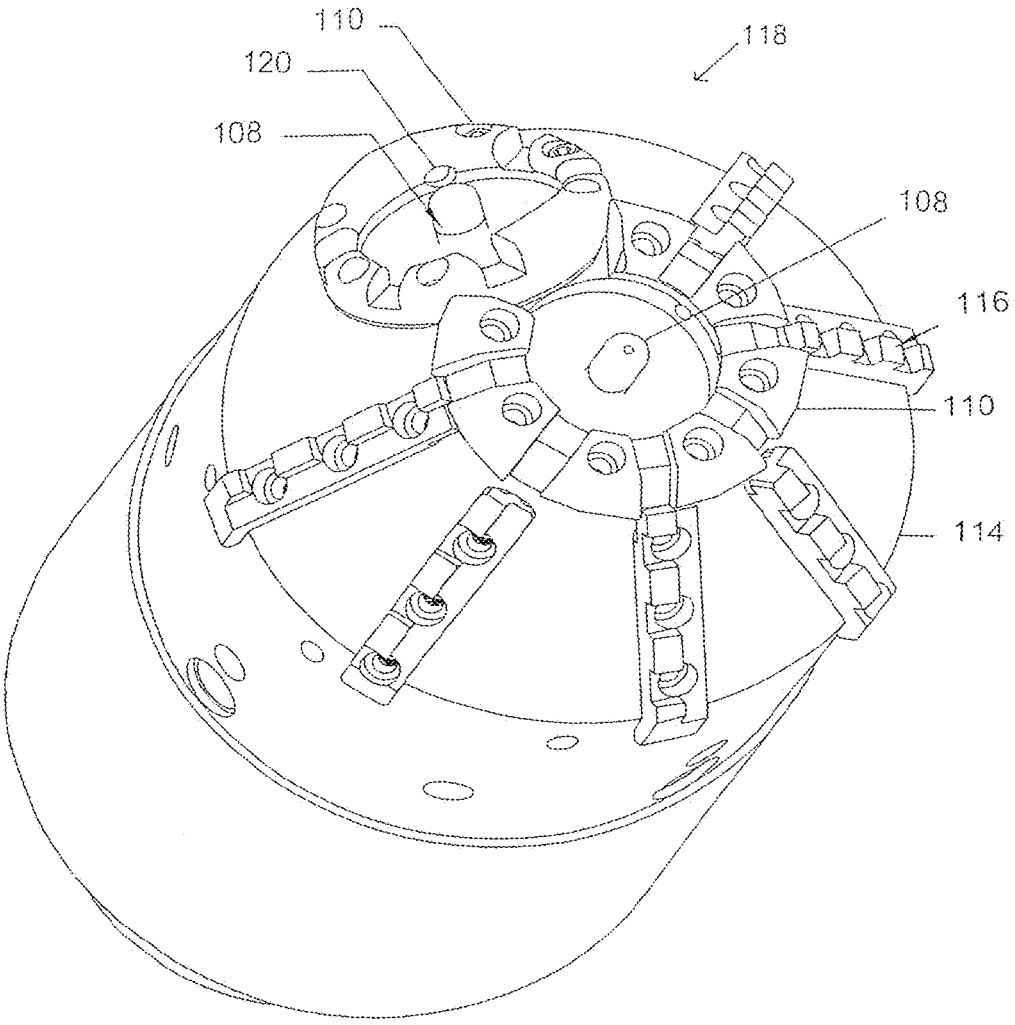
FIG. 5 is of a dual-electrode set bit of an embodiment of the present invention.

In the embodiment shown in FIG. 5, most of the drilling is accomplished by the electrocrushing (EC) electrodes, with the mechanical teeth serving to smooth the variation in surface texture produced by the electrocrushing process. The mechanical teeth 116 also serve to cut the gauge of the hole, that is, the relatively precise, relatively smooth inside diameter of the hole. An alternate embodiment has the drill bit of FIG. 5 without mechanical teeth 116, all of the drilling being done by the electrode sets 108 and 110 with or without mechanical teeth 109 in the surrounding electrode 110.

Figure 6:
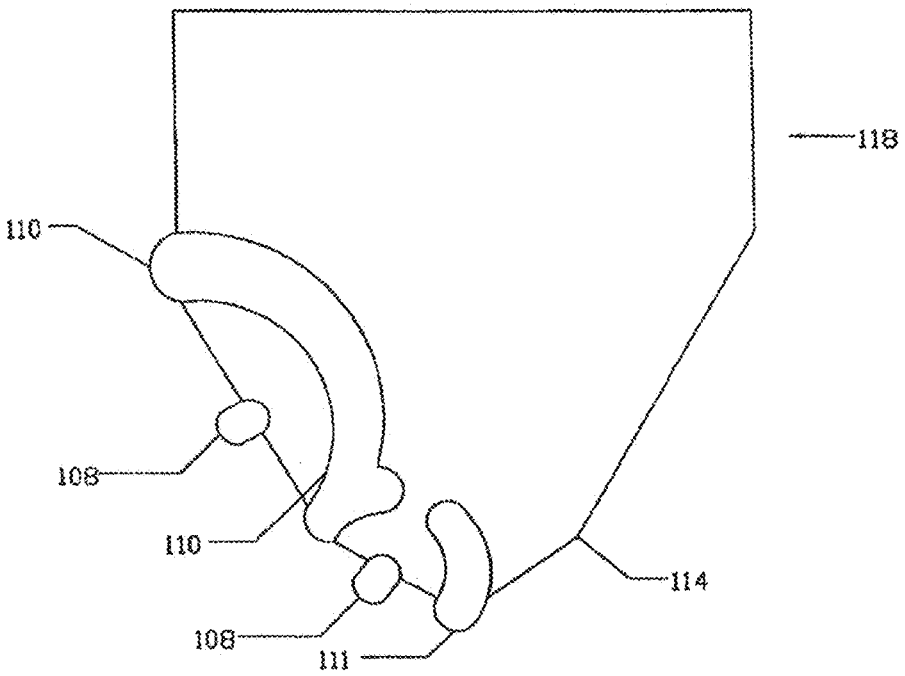
FIG. 6 is of a dual-electrode conical bit with two different cone angles of an embodiment of the present invention.

Alternative embodiments include variations on the configuration of the ground ring geometry and center-to-ground ring geometry as for the single-electrode set bit. For example, FIG. 6 shows such an arrangement in the form of a dual-electrode conical bit comprising two different cone angles with center electrodes 108, surrounding or ground electrodes 110, and bit case or housing 114. In the embodiment shown, the ground electrodes are tip electrode 111 and conical side ground electrodes 110 which surround, or partially surround, high voltage electrodes 108 in an asymmetric configuration.

Figure 7A:
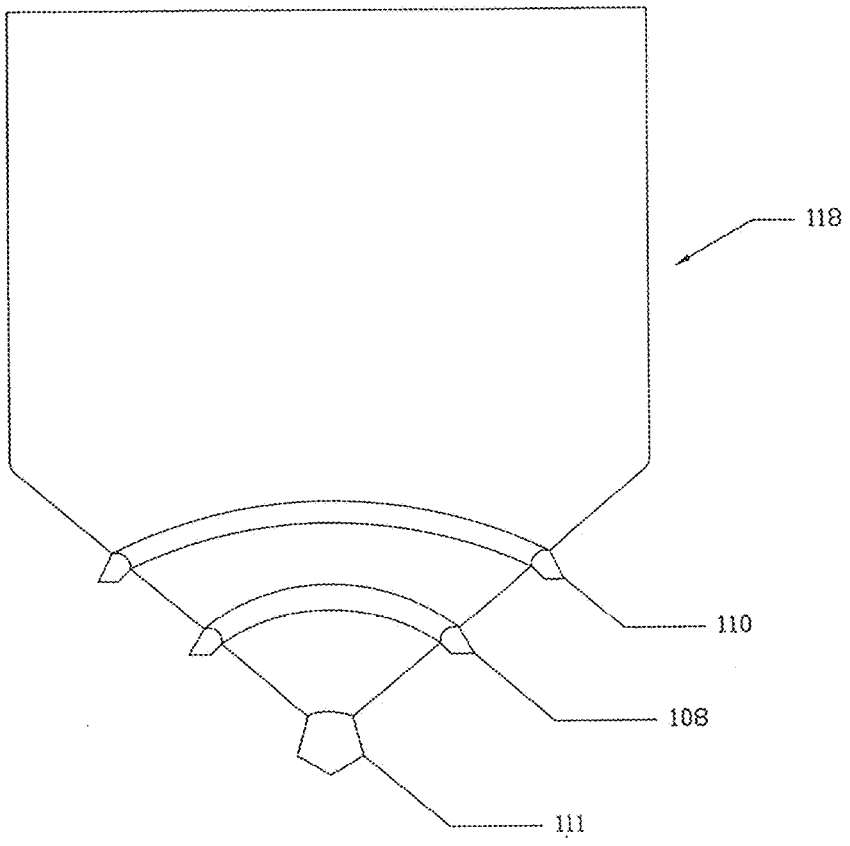
FIGS. 7A and 7B show an embodiment of a drill bit of the present invention wherein one ground electrode is the tip of the bit and the other ground electrode has the geometry of a great circle of the cone.
Figure 7B:
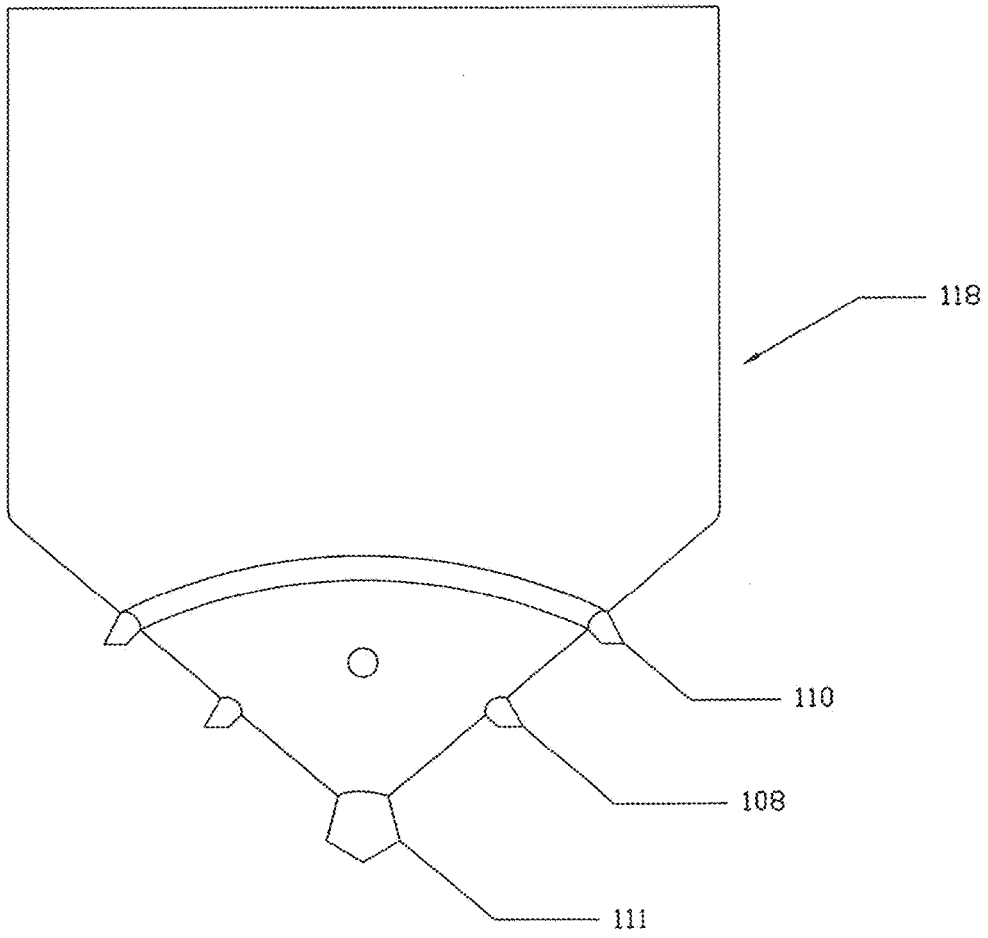

As shown in FIG. 6, the bit may comprise two or more separate cone angles to enhance the ability to control direction with the bit. The electrodes can be laid out symmetrically in a sector of the cone, as shown in FIG. 4 or in an asymmetric configuration of the electrodes utilizing ground electrode 111 as the center of the cone as shown in FIG. 6. Another configuration is shown in FIG. 7A in which ground electrode 111 is at the tip of the bit and hot electrode 108 and other ground electrode 110 are aligned in great circles of the cone. FIG. 7B shows an alternate embodiment wherein ground electrode 111 is the tip of the bit, other ground electrode 110 has the geometry of a great circle of the cone, and hot electrodes 108 are disposed there between. Also, any combination of these configurations may be utilized.

It should be understood that the use of a bit with an asymmetric electrode configuration can comprise one or more electrode sets and need not comprise mechanical teeth. It should also be understood that directional drilling can be performed with one or more electrode sets.

The electrocrushing drilling process takes advantage of flaws and cracks in the rock. These are regions where it is easier for the electric fields to breakdown the rock. The electrodes used in the bit of the present invention are usually large in area in order to intercept more flaws in the rock and therefore improve the drilling rate, as shown in FIG. 4. This is an important feature of the invention because most electrodes in the prior art are small to increase the local electric field enhancement.

Figure 8:
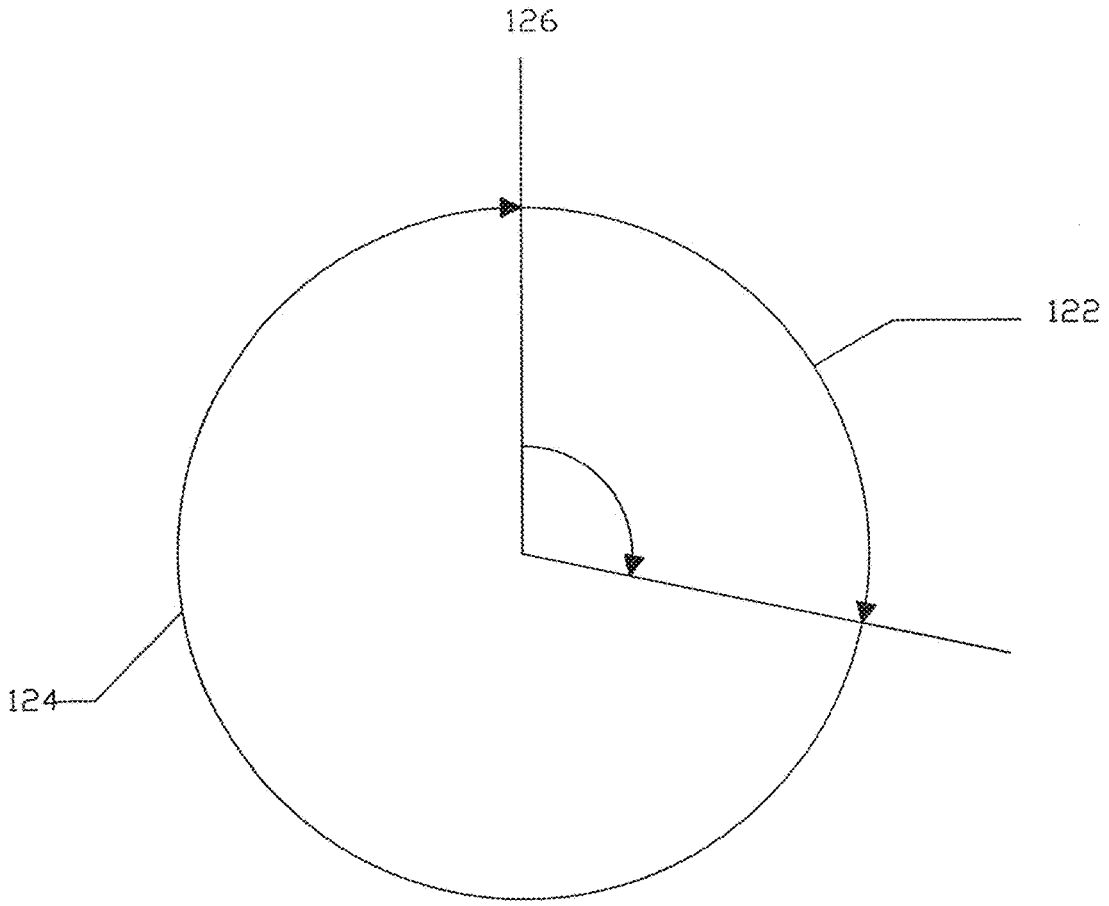
FIG. 8 shows the range of bit rotation azimuthal angle of an embodiment of the present invention.

FIG. 8 shows the range of bit rotation azimuthal angle 122 where the repetition rate or pulse energy is increased to increase excavation on that side of the drill bit, compared to the rest of the bit rotation angle that has reduced pulse repetition rate or pulse energy 124. The bit rotation is referenced to a particular direction relative to the formation 126, often magnetic north, to enable the correct drill hole direction change to be made. This reference is usually achieved by instrumentation provided on the bit. When the pulsed power system provides a high voltage pulse to the electrodes on the side of the bit (See FIG. 5), an arc is struck between one hot electrode and one ground electrode. This arc excavates a certain amount of rock out of the hole. By the time the next high voltage pulse arrives at the electrodes, the bit has rotated a certain amount, and a new arc is struck at a new location in the rock. If the repetition rate of the electrical pulses is constant as a function of bit rotation azimuthal angle, the bit will drill a straight hole. If the repetition rate of the electrical pulses varies as a function of bit rotation azimuthal angle, the bit will tend to drift in the direction of the side of the bit that has the higher repetition rate. The direction of the drilling and the rate of deviation can be controlled by controlling the difference in repetition rate inside the high repetition rate zone azimuthal angle, compared to the repetition rate outside the zone (See FIG. 8). Also, the azimuthal angle of the high repetition rate zone can be varied to control the directional drilling. A variation of the invention is to control the energy per pulse as a function of azimuthal angle instead of, or in addition to, controlling the repetition rate to achieve directional drilling.

FAST Drill System

Another embodiment of the present invention provides a drilling system/assembly utilizing the electrocrushing bits described herein and is designated herein as the FAST Drill system. A limitation in drilling rock with a drag bit is the low cutter velocity at the center of the drill bit. This is where the velocity of the grinding teeth of the drag bit is the lowest and hence the mechanical drilling efficiency is the poorest. Effective removal of rock in the center portion of the hole is the limiting factor for the drilling rate of the drag bit. Thus, an embodiment of the FAST Drill system comprises a small electrocrushing (EC) bit (alternatively referred to herein as a FAST bit or FAST Drill bit) disposed at the center of a drag bit to drill the rock at the center of the hole. Thus, the EC bit removes the rock near the center of the hole and substantially increases the drilling rate. By increasing the drilling rate, the net energy cost to drill a particular hole is substantially reduced. This is best illustrated by the bit shown in FIG. 4 (discussed above) comprising EC process electrodes 108 and 100 set at the center of bit 114, surrounded by mechanical drag-bit teeth 116. The rock at the center of the bit is removed by the EC electrode set, and the rock near the edge of the hole is removed by the mechanical teeth, where the tooth velocity is high and the mechanical efficiency is high.

As noted above, the function of the mechanical drill teeth on the bit is to smooth off the tops of the protrusions and recesses left by the electrocrushing or plasma-hydraulic process. Because the electrocrushing process utilizes an arc through the rock to crush or fracture the rock, the surface of the rock is rough and uneven. The mechanical drill teeth smooth the surface of the rock, cutting off the tops of the protrusions so that the next time the electrocrushing electrodes come around to remove more rock, they have a larger smoother rock surface to contact the electrodes.

The electrocrushing bit comprises passages for the drilling fluid to flush out the rock debris (i.e., cuttings) (See FIG. 5). The drilling fluid flows through passages inside the electrocrushing bit and then out] through passages 120 in the surface of the bit near the electrodes and near the drilling teeth, and then flows up the side of the drill system and the well to bring rock cuttings to the surface.

The electrocrushing bit may comprise an insulation section that insulates the electrodes from the housing, the electrodes themselves, the housing, the mechanical rock cutting teeth that help smooth the rock surface, and the high voltage connections that connect the high voltage power cable to the bit electrodes.

Figure 9:
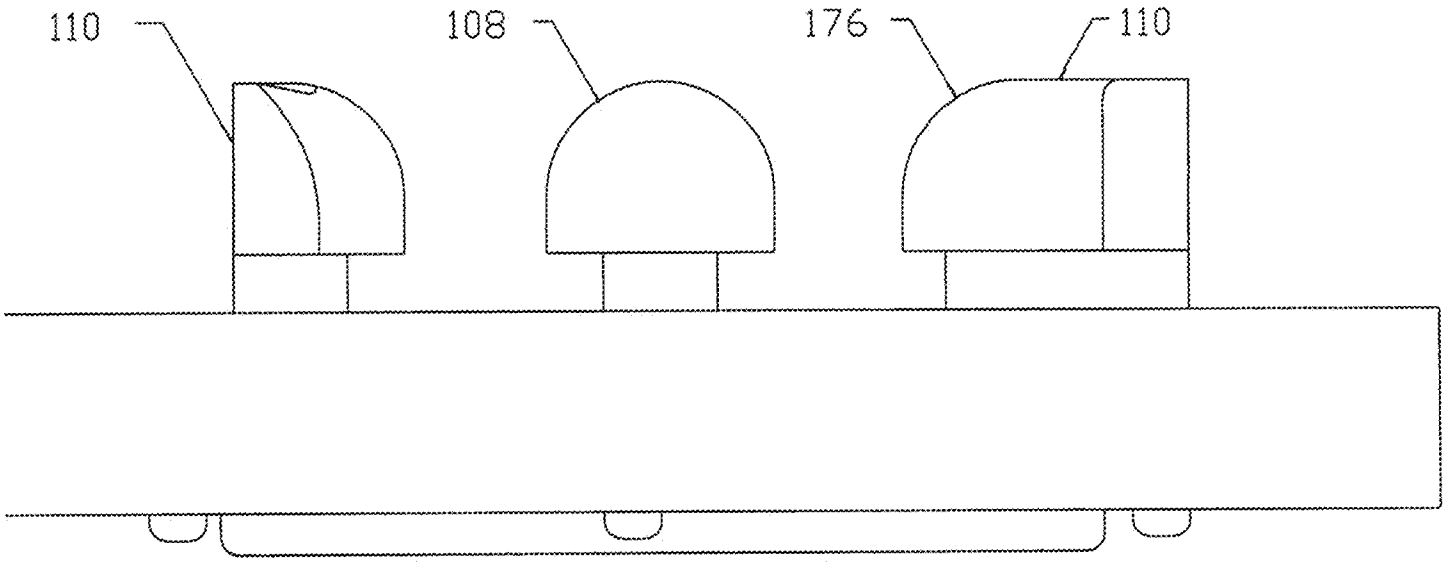
FIG. 9 shows an embodiment of the drill bit of the present invention having radiused electrodes.

FIG. 9 shows an embodiment of the FAST Drill high voltage electrode 108 and ground electrodes 110 that incorporate a radius 176 on the electrode, with electrode radius 176 on the rock-facing side of electrodes 110. Radius 176 is an important feature of the present invention to allocate the electric field into the rock. The feature is not obvious because electrodes from prior art were usually sharp to enhance the local electric field.

Figure 10:
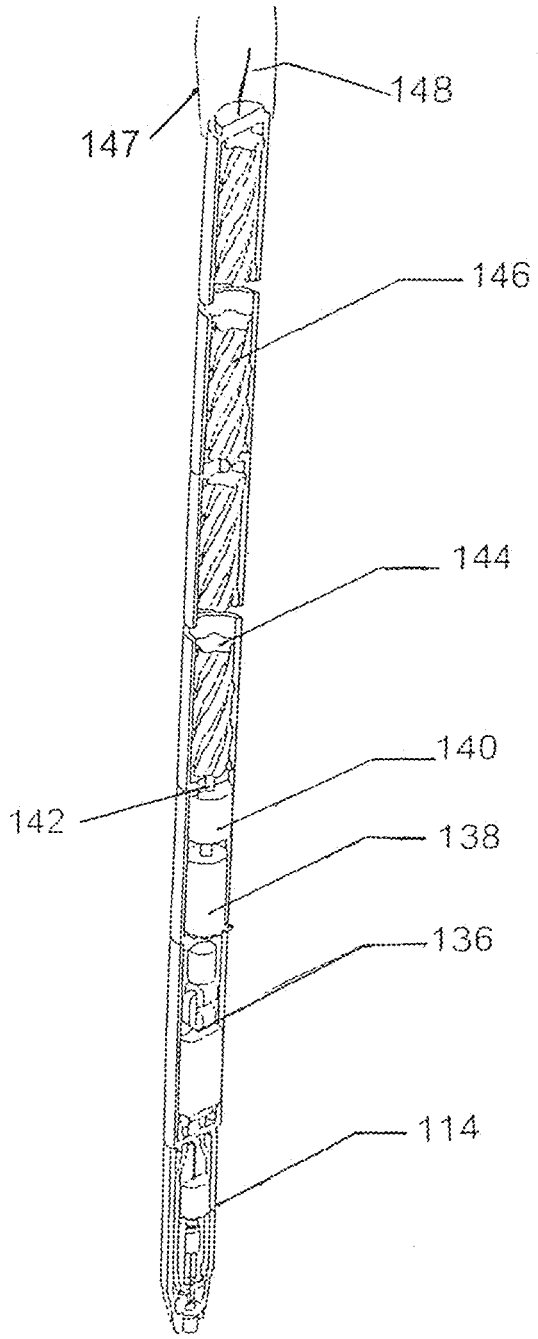
FIG. 10 shows the complete drill assembly of an embodiment of the present invention.

FIG. 10 shows an embodiment of the FAST Drill system comprising two or more sectional components, including, but not limited to: (1) at least one pulsed power FAST drill bit 114; (2) at least one pulsed power supply 136; (3) at least one downhole generator 138; (4) at least one overdrive gear to rotate the downhole generator at high speed 140; (5) at least one downhole generator drive mud motor 144; (6) at least one drill bit mud motor 146; (7) at least one rotating interface 142; (8) at least one tubing or drill pipe for the drilling fluid 147; and (9) at least one cable 148. Not all embodiments of the FAST Drill system utilize all of these components. For example, one embodiment utilizes continuous coiled tubing to provide drilling fluid to the drill bit, with a cable to bring electrical power from the surface to the pulsed power system. That embodiment does not require a down-hole generator, overdrive gear, or generator drive mud motor, but does require a downhole mud motor to rotate the bit, since the tubing does not turn. An electrical rotating interface is required to transmit the electrical power from the non-rotating cable to the rotating drill bit.

An embodiment utilizing a multi-section rigid drill pipe to rotate the bit and conduct drilling fluid to the bit requires a downhole generator, because a power cable cannot be used, but does not need a mud motor to turn the bit, since the pipe turns the bit. Such an embodiment does not need a rotating interface because the system as a whole rotates at the same rotation rate.

An embodiment utilizing a continuous coiled tubing to provide mud to the drill bit, without a power cable, requires a down-hole generator, overdrive gear, and a generator drive mud motor, and also needs a downhole motor to rotate the bit because the tubing does not turn. An electrical rotating interface is needed to transmit the electrical control and data signals from the non-rotating cable to the rotating drill bit.

An embodiment utilizing a continuous coiled tubing to provide drilling fluid to the drill bit, with a cable to bring high voltage electrical pulses from the surface to the bit, through the rotating interface, places the source of electrical power and the pulsed power system at the surface. This embodiment does not need a down-hole generator, overdrive gear, or generator drive mud motor or downhole pulsed power systems, but does need a downhole motor to rotate the bit, since the tubing does not turn.

Still another embodiment utilizes continuous coiled tubing to provide drilling fluid to the drill bit, with a fuel cell to generate electrical power located in the rotating section of the drill string. Power is fed across the rotating interface to the pulsed power system, where the high voltage pulses are created and fed to the FAST bit. Fuel for the fuel cell is fed down tubing inside the coiled tubing mud pipe.

An embodiment of the FAST Drill system comprises FAST bit 114, a drag bit reamer 150 (shown in FIG. 11), and a pulsed power system housing 136 (FIG. 10).

Figure 11:
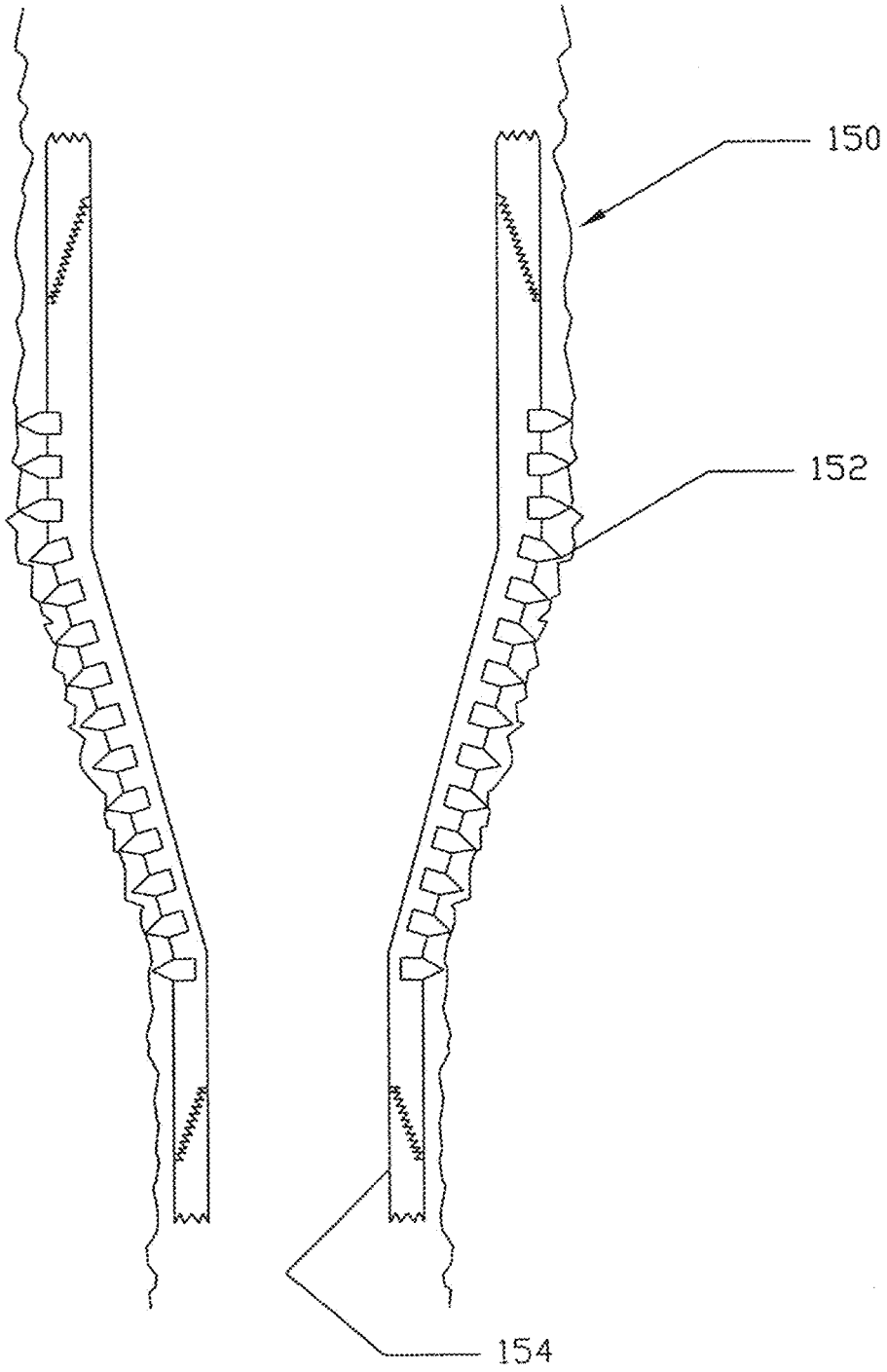
FIG. 11 shows the reamer drag bit of an embodiment of the present invention.

FIG. 11 shows reamer drag bit 150 that enlarges the hole cut by the electrocrushing FAST bit, drag bit teeth 152, and FAST bit attachment site 154. Reamer drag bit 150 is preferably disposed just above FAST bit 114. This is a conical pipe section, studded with drill teeth, that is used to enlarge the hole drilled by the electrocrushing bit (typically, for example, approximately 7.5 inches in diameter) to the full diameter of the well (for example, to approximately 12.0 inches in diameter). The conical shape of drag bit reamer 150 provides more cutting teeth for a given diameter of hole, thus higher drilling rates. Disposed in the center part of the reamer section are several passages. There is a passage for the power cable to go through to the FAST bit. The power cable comes from the pulsed power section located above and/or within the reamer and connects to the FAST drill bit below the reamer. There are also passages in the reamer that provide oil flow down to the FAST bit and passages that provide flushing fluid to the reamer teeth to help cut the rock and flush the cuttings from the reamer teeth.

Figure 12:
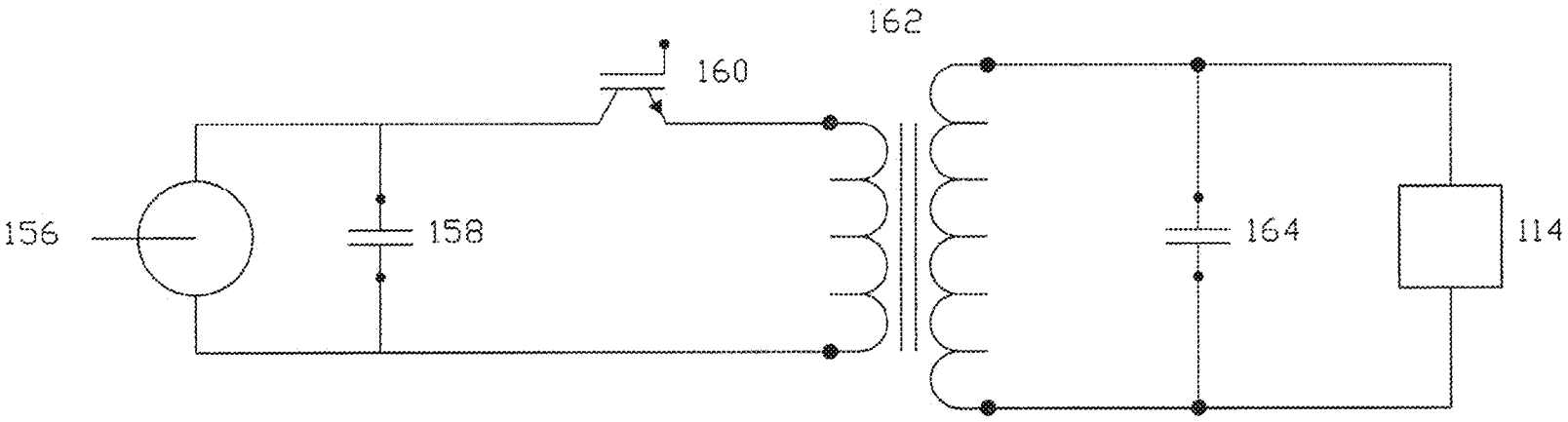
FIG. 12 shows a solid-state switch or gas switch controlled high voltage pulse generating system that pulse charges the primary output capacitor of an embodiment of the present invention.
Figure 13:
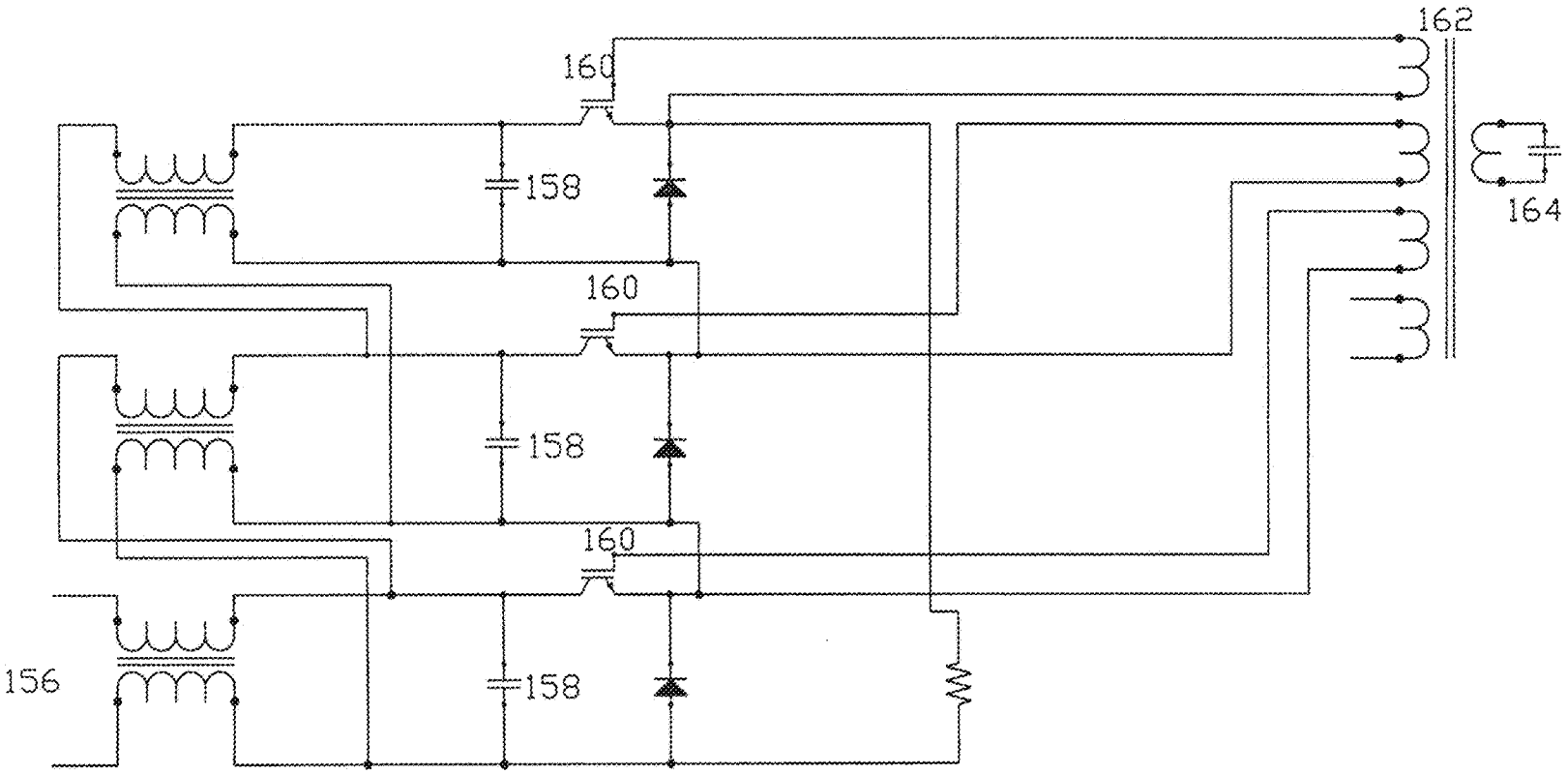
FIG. 13 shows an array of solid-state switch or gas switch controlled high voltage pulse generating circuits that are charged in parallel and discharged in series to pulse-charge the output capacitor of an embodiment of the present invention.
Figure 14:
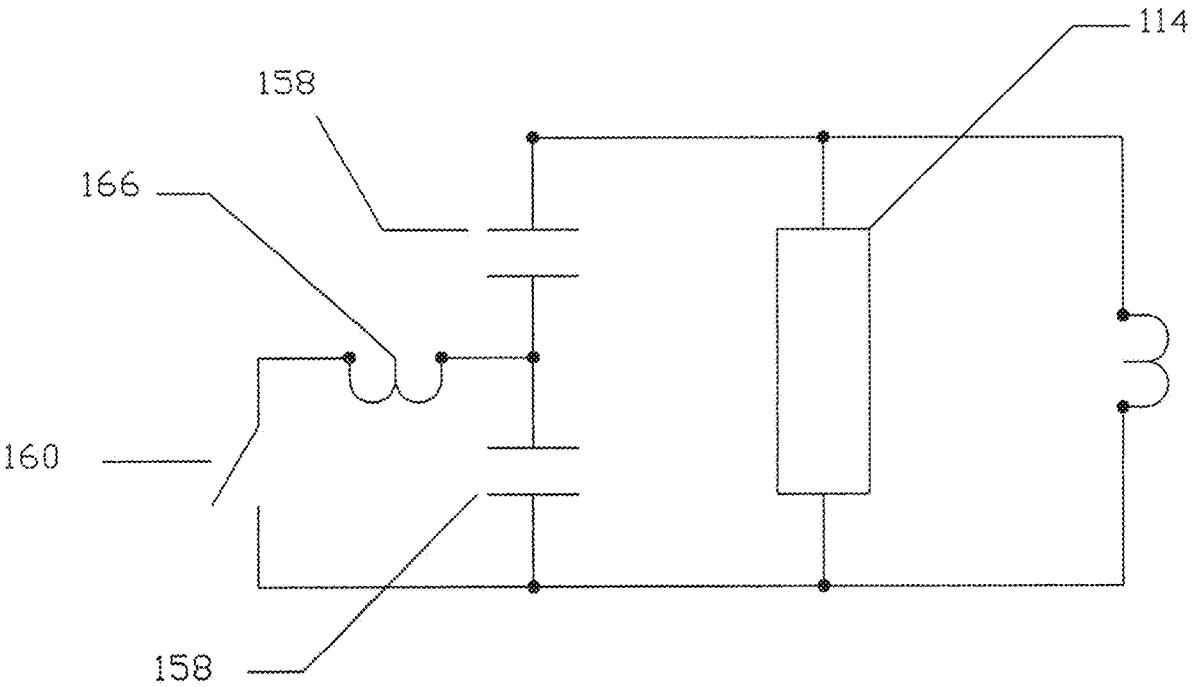
FIG. 14 shows a voltage vector inversion circuit that produces a pulse that is a multiple of the charge voltage of an embodiment of the present invention.

Preferably, a pulse power system that powers the FAST bit is enclosed in the housing of the reamer drag bit and the stem above the drag bit as shown in FIG. 10. This system takes the electrical power supplied to the FAST Drill for the electrocrushing FAST bit and transforms that power into repetitive high voltage pulses, usually over 100 kV. The repetition rate of those pulses is controlled by the control system from the surface or in the bit housing. The pulsed power system itself can include, but is not limited to:

(1) a solid state switch controlled or gas-switch controlled pulse generating system with a pulse transformer that pulse charges the primary output capacitor (example shown in FIG. 12);

(2) an array of solid-state switch or gas-switch controlled circuits that are charged in parallel and in series pulse-charge the output capacitor (example shown in FIG. 13);

(3) a voltage vector inversion circuit that produces a pulse at about twice, or a multiple of, the charge voltage (example shown in FIG. 14);

(4) An inductive store system that stores current in an inductor, then switches it to the electrodes via an opening or transfer switch (example shown in FIG. 15); or (5) any other pulse generation circuit that provides repetitive high voltage, high current pulses to the FAST Drill bit.

FIG. 12 shows a solid-state switch or gas switch controlled high voltage pulse generating system that pulse charges the primary output capacitor 164, showing generating means 156 to provide DC electrical power for the circuit, intermediate capacitor electrical energy storage means 158, gas, solid-state, or vacuum switching means 160 to switch the stored electrical energy into pulse transformer 162 voltage conversion means that charges output capacitive storage means 164 connecting to FAST bit 114.

FIG. 3 shows an array of solid-state switch or gas switch 160 controlled high voltage pulse generating circuits that are charged in parallel and discharged in series through pulse transformer 162 to pulse-charge output capacitor 164.

FIG. 14 shows a voltage vector inversion circuit that produces a pulse that is a multiple of the charge voltage. An alternate of the vector inversion circuit that produces an output voltage of about twice the input voltage is shown, showing solid-state switch or gas switching means 160, vector inversion inductor 166, intermediate capacitor electrical energy storage means 158 connecting to FAST bit 114.

Figure 15:
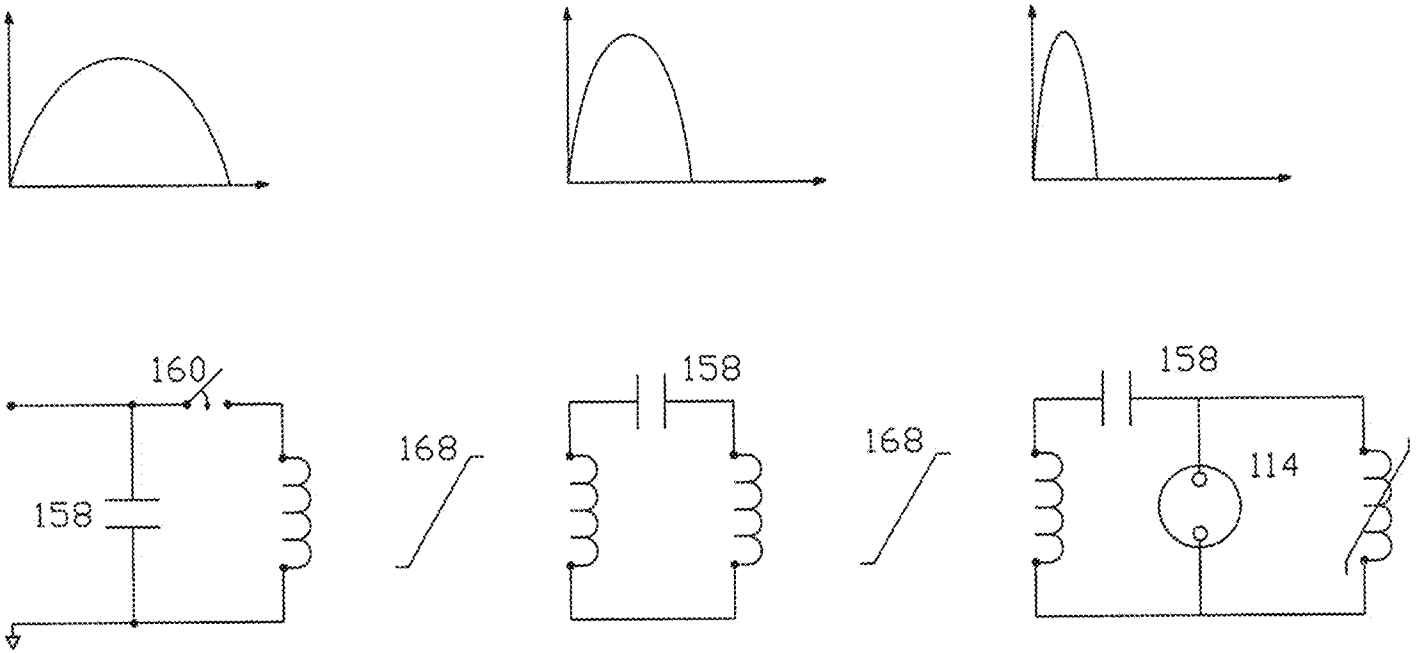
FIG. 15 shows an inductive store voltage gain system to produce the pulses needed for the FAST drill of an embodiment of the present invention.

FIG. 15 shows an inductive store voltage gain system to produce the pulses needed for the FAST Drill, showing the solid-state switch or gas switching means 160, saturable pulse transformers 168, and intermediate capacitor electrical energy storage means 158 connecting to the FAST bit 114.

The pulsed power system is preferably located in the rotating bit, but may be located in the stationary portion of the drill pipe or at the surface.

Electrical power for the pulsed power system is either generated by a generator at the surface, or drawn from the power grid at the surface, or generated down hole. Surface power is transmitted to the FAST drill bit pulsed power system either by cable inside the drill pipe or conduction wires in the drilling fluid pipe wall. In one embodiment, the electrical power is generated at the surface, and transmitted downhole over a cable 148 located inside the continuous drill pipe 147 (shown in FIG. 11).

The cable is located in non-rotating flexible mud pipe (continuous coiled tubing). Using a cable to transmit power to the bit from the surface has advantages in that part of the power conditioning can be accomplished at the surface, but has a disadvantage in the weight, length, and power loss of the long cable.

At the bottom end of the mud pipe is located the mud motor which utilizes the flow of drilling fluid down the mud pipe to rotate the FAST Drill bit and reamer assembly. Above the pulsed power section, at the connection between the mud pipe and the pulsed power housing, is the rotating interface as shown in FIG. 10. The cable power is transmitted across an electrical rotating interface at the point where the mud motor turns the drag bit. This is the point where relative rotation between the mud pipe and the pulsed power housing is accommodated. The rotating electrical interface is used to transfer the electrical power from the cable or continuous tubing conduction wires to the pulsed power system. It also passes the drilling fluid from the non-rotating part to the rotating part of the drill string to flush the cuttings from the EC electrodes and the mechanical teeth. The pulsed power system is located inside the rigid drill pipe between the rotating interface and the reamer. High voltage pulses are transmitted inside the reamer to the FAST bit.

In the case of electrical power transmission through conduction wires in rigid rotating pipe, the rotating interface is not needed because the pulsed power system and the conduction wires are rotating at the same velocity. If a downhole gearbox is used to provide a different rotation rate for the pulsed power/bit section from the pipe, then a rotating interface is needed to accommodate the electrical power transfer.

In another embodiment, power for the FAST Drill bit is provided by a downhole generator that is powered by a mud motor that is powered by the flow of the drilling fluid (mud) down the drilling fluid, rigid, multi-section, drilling pipe (FIG. 10). That mudflow can be converted to rotational mechanical power by a mud motor, a mud turbine, or similar mechanical device for converting fluid flow to mechanical power. Bit rotation is accomplished by rotating the rigid drill pipe. With power generation via downhole generator, the output from the generator can be inside the rotating pulsed power housing so that no rotating electrical interface is required (FIG. 10), and only a mechanical interface is needed. The power comes from the generator to the pulsed power system where it is conditioned to provide the high voltage pulses for operation of the FAST bit.

Alternatively, the downhole generator might be of the piezoelectric type that provides electrical power from pulsation in the mud. Such fluid pulsation often results from the action of a mud motor turning the main bit.

Figure 16:
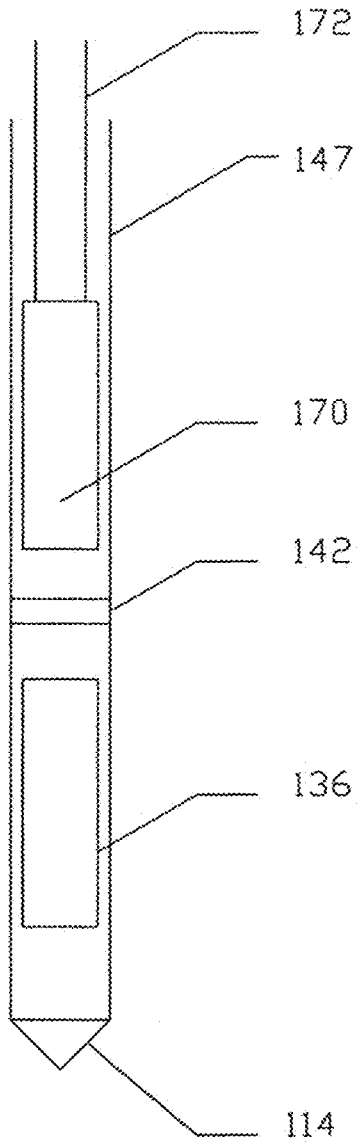
FIG. 16 shows a drill assembly powered by a fuel cell that is supplied by fuel lines and exhaust line from the surface inside the continuous metal mud pipe of an embodiment of the present invention.

Another embodiment for power generation is to utilize a fuel cell in the non-rotating section of the drill string. FIG. 16 shows an example of a FAST Drill system powered by fuel cell 170 that is supplied by fuel lines and exhaust line 172 from the surface inside the continuous metal mud pipe 147. The power from fuel cell 170 is transmitted across the rotating interface 142 to pulsed power system 136, and hence to FAST bit 114. The fuel cell consumes fuel to produce electricity. Fuel lines are placed inside the continuous coiled tubing, which provides drilling fluid to the drill bit, to provide fuel to the fuel cell, and to exhaust waste gases. Power is fed across the rotating interface to the pulsed power system, where the high voltage pulses are created and fed to the FAST bit.

As noted above, there are two primary means for transmitting drilling fluid (mud) from the surface to the bit: continuous flexible tubing or rigid multi-section drill pipe. The continuous flexible mud tubing is used to transmit mud from the surface to the rotation assembly where part of the mud stream is utilized to spin the assembly through a mud motor, a mud turbine, or another rotation device. Part of the mudflow is transmitted to the FAST bits and reamer for flushing the cuttings up the hole. Continuous flexible mud tubing has the advantage that power and instrumentation cables can be installed inside the tubing with the mudflow. It is stationary and not used to transmit torque to the rotating bit. Rigid multi-section drilling pipe comes in sections and cannot be used to house continuous power cable, but can transmit torque to the bit assembly. With continuous flexible mud pipe, a mechanical device such as, for example, a mud motor, or a mud turbine, is used to convert the mud flow into mechanical rotation for turning the rotating assembly. The mud turbine can utilize a gearbox to reduce the revolutions per minute. A downhole electric motor can alternatively be used for turning the rotating assembly. The purpose of the rotating power source is primarily to provide torque to turn the teeth on the reamer and the FAST bit for drilling. It also rotates the FAST bit to provide the directional control in the cutting of a hole. Another embodiment is to utilize continuous mud tubing with downhole electric power generation.

In one embodiment, two mud motors or mud turbines are used: one to rotate the bits, and one to generate electrical power.

Another embodiment of the rigid multi-section mud pipe is the use of data transmitting wires buried in the pipe such as, for example, the Intelipipe manufactured by Grant Prideco. This is a composite pipe that uses magnetic induction to transmit data across the pipe joints, while transmitting it along wires buried in the shank of the pipe sections. Utilizing this pipe provides for data transmission between the bit and the control system on the surface, but still requires the use of downhole power generation.

Figure 17:
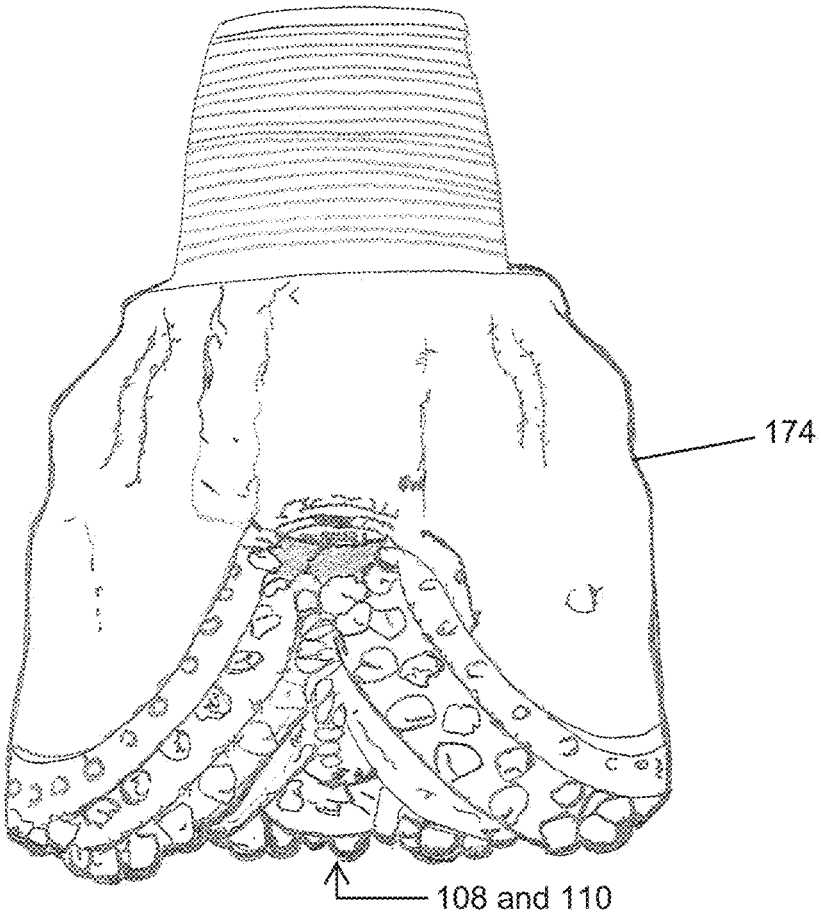
FIG. 17 shows a roller-cone bit with an electrode set of an embodiment of the present invention.

Another embodiment of the FAST Drill is shown in FIG. 17 wherein rotary or roller-cone bit 174 is utilized, instead of a drag bit, to enlarge the hole drilled by the FAST bit. Roller-cone bit 174 comprises electrodes 108 and 110 disposed in or near the center portion of roller cone bit 174 to excavate that portion of the rock where the efficiency of the roller bit is the least.

Another embodiment of the rotating interface is to use a rotating magnetic interface to transfer electrical power and data across the rotating interface, instead of a slip ring rotating interface.

In another embodiment, the mud returning from the well loaded with cuttings flows to a settling pond, at the surface, where the rock fragments settle out. The mud then cleaned and reinjected into the FAST Drill mud pipe.

Electrocrushing Vein Miner

Figure 18:
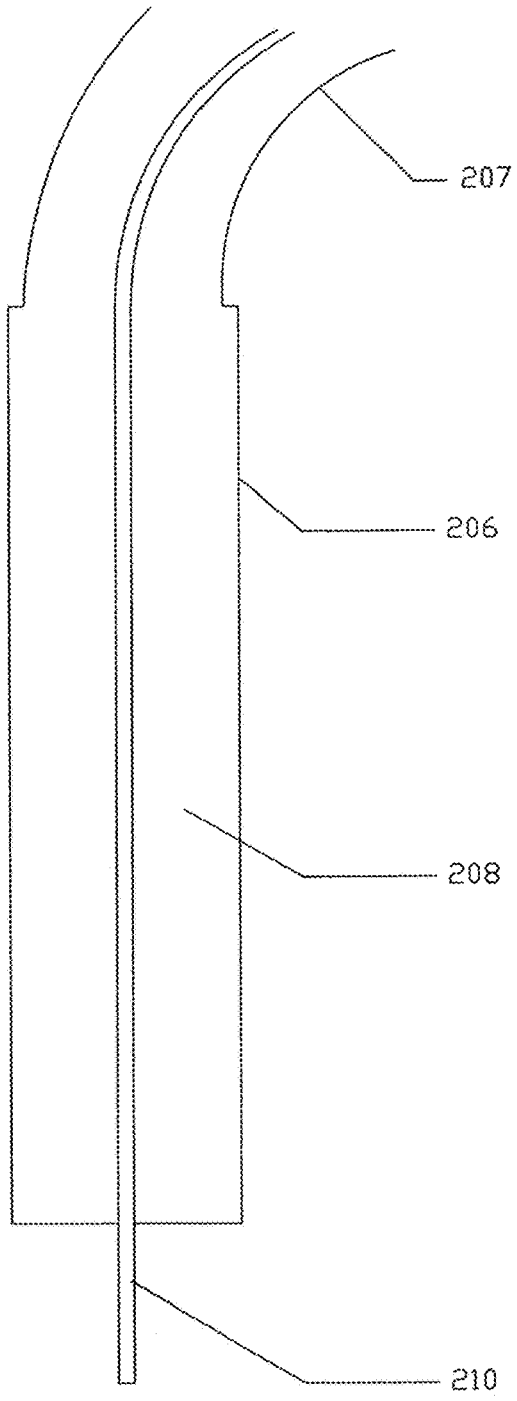
FIG. 18 shows a small-diameter electrocrushing drill of an embodiment of the present invention.

Another embodiment of the present invention provides a small-diameter, electrocrushing drill (designated herein as "SED") that is related to the hand-held electrohydraulic drill disclosed in U.S. Pat. No. 5,896,938 (to a primary inventor herein), incorporated herein by reference. However, the SED is distinguishable in that the electrodes in the SED are spaced in such a way, and the rate of rise of the electric field is such, that the rock breaks down before the water breaks down. When the drill is near rock, the electric fields break down the rock and current passes through the rock, thus fracturing the rock into small pieces. The electrocrushing rock fragmentation occurs as a result of tensile failure caused by the electrical current passing through the rock, as opposed to compressive failure caused by the electrohydraulic (EH) shock or pressure wave on the rock disclosed in U.S. Pat. No. 5,896,938, although the SED, too, can be connected via a cable from a box as described in the '938 patent so that it can be portable. FIG. 18 shows a SED drill bit comprising case 206, internal insulator 208, and center electrode 210 which is preferably movable (e.g., spring-loaded) to maintain contact with the rock while drilling. Although case 206 and internal insulator 208 are shown as providing an enclosure for center electrode 210, other components capable of providing an enclosure may be utilized to house electrode 210 or any other electrode incorporated in the SED drill bit. Preferably, case 206 of the SED is the ground electrode, although a separate ground electrode may be provided. Also, it should be understood that more than one set of electrodes may be utilized in the SED bit. A pulsed power generator as described in other embodiments herein is linked to said drill bit for delivering high voltage pulses to the electrode. In an embodiment of the SED, cable 207 (which may be flexible) is provided to link a generator to the electrode(s). A passage, for example cable 207, is preferably used to deliver water down the SED drill.

This small-diameter electrocrushing drill embodiment is advantageous for drilling in non-porous rock. Also, this embodiment benefits from the use concurrent use of the high permittivity liquid discussed herein.

Figure 19:
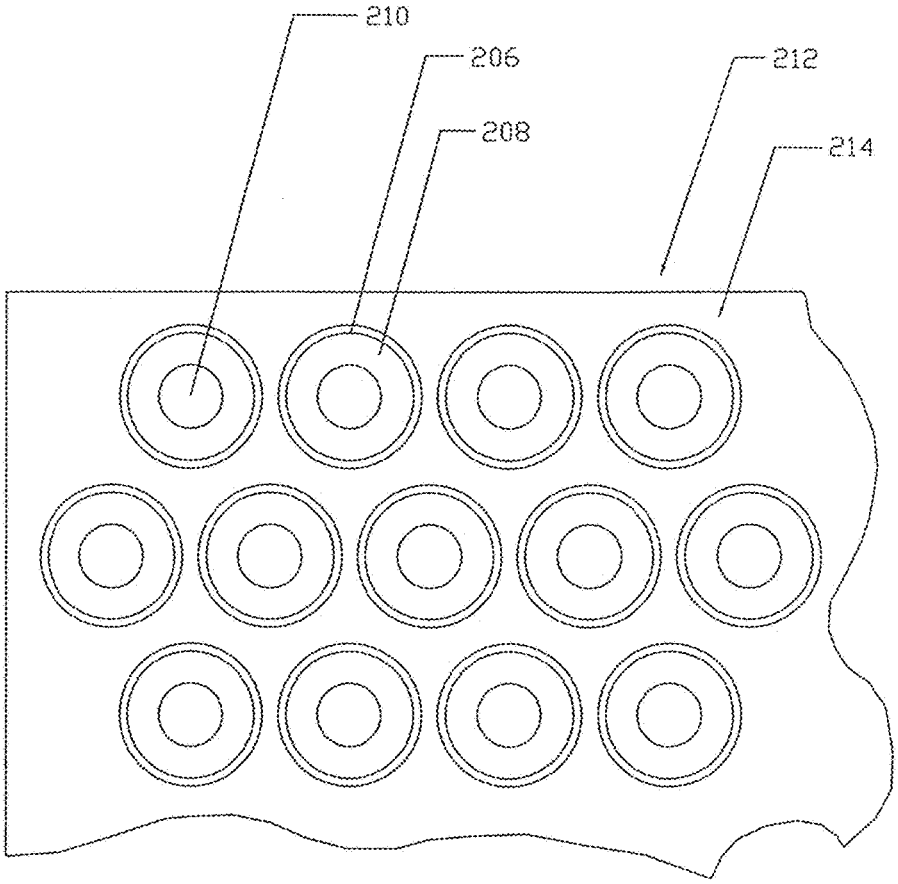
FIG. 19 shows an electrocrushing vein miner of an embodiment of the present invention.

Another embodiment of the present invention is to assemble several individual small-diameter electrocrushing drill (SED) drill heads or electrode sets together into an array or group of drills, without the individual drill housings, to provide the capability to mine large areas of rock. In such an embodiment, a vein of ore can be mined, leaving most of the waste rock behind. FIG. 19 shows such an embodiment of a mineral vein mining machine herein designated Electrocrushing Vein Miner (EVM) 212 comprising a plurality of SED drills 214, SED case 206, SED insulator 208, and SED center electrode 210. This assembly can then be steered as it moves through the rock by varying the repetition rate of the high voltage pulses differentially among the drill heads. For example, if the repetition rate for the top row of drill heads is twice as high but contains the same energy per pulse as the repetition rate for the lower two rows of drill heads, the path of the mining machine will curve in the direction of the upper row of drill heads, because the rate of rock excavation will be higher on that side. Thus, by varying the repetition rate and/or pulse energy of the drill heads, the EVM can be steered dynamically as it is excavating a vein of ore. This provides a very useful tool for efficiently mining just the ore from a vein that has substantial deviation in direction.

In another embodiment, a combination of electrocrushing and electrohydraulic (EH) drill bit heads enhances the functionality of the by enabling the Electrocrushing Vein-Miner (EVM) to take advantage of ore structures that are layered. Where the machine is mining parallel to the layers, as is the case in mining most veins of ore, the shock waves from the EH drill bit heads tend to separate the layers, thus synergistically coupling to the excavation created by the electrocrushing electrodes. In addition, combining electrocrushing drill heads with plasma-hydraulic drill heads combines the compressive rock fracturing capability of the plasma-hydraulic drill heads with the tensile rock failure of the electrocrushing drill heads to more efficiently excavate rock.

With the EVM mining machine, ore can be mined directly and immediately transported to a mill by water transport, already crushed, so the energy cost of primary crushing and the capital cost of the primary crushers is saved. This method has a great advantage over conventional mechanical methods in that it combines several steps in ore processing, and it greatly reduces the amount of waste rock that must be processed. This method of this embodiment can also be used for tunneling.

The high voltage pulses can be generated in the housing of the EVM, transmitted to the EVM via cables, or both generated elsewhere and transmitted to the housing for further conditioning. The electrical power generation can be at the EVM via fuel cell or generator, or transmitted to the EVM via power cable. Typically, water or mining fluid flows through the structure of the EVM to flush out rock cuttings.

If a few, preferably just three, of the electrocrushing or plasma-hydraulic drill heads shown in FIG. 19 are placed in a housing, the assembly can be used to drill holes, with directional control by varying the relative repetition rate of the pulses driving the drill heads. The drill will tend to drift in the direction of the drill head with the highest pulse repletion rate, highest pulse energy, or highest average power. This electrocrushing (or electrohydraulic) drill can create very straight holes over a long distance for improving the efficiency of blasting in underground mining, or it can be used to place explosive charges in areas not accessible in a straight line.

Insulating Drilling Fluid

An embodiment of the present invention also comprises insulating drilling fluids that may be utilized in the drilling methods described herein. For example, for the electrocrushing process to be effective in rock fracturing or crushing, it is preferable that the dielectric constant of the insulating fluid be greater than the dielectric constant of the rock and that the fluid have low conductivity such as, for example, a conductivity of less than approximately 10-6 mho/cm and a dielectric constant of at least approximately 6.

Therefore, one embodiment of the present invention provides for an insulating fluid or material formulation of high permittivity, or dielectric constant, and high dielectric strength with low conductivity. The insulating formulation comprises two or more materials such that one material provides a high dielectric strength and another provides a high dielectric constant. The overall dielectric constant of the insulating formulation is a function of the ratio of the concentrations of the at least two materials. The insulating formulation is particularly applicable for use in pulsed power applications.

Thus, this embodiment of the present invention provides for an electrical insulating formulation that comprises a mixture of two or more different materials. In one embodiment, the formulation comprises a mixture of two carbon-based materials. The first material may comprise a dielectric constant of greater than approximately 2.6, and the second material may comprise a dielectric constant greater than approximately 10.0. The materials are at least partly miscible with one another, and the formulation has low electrical conductivity. The term "low conductivity" or "low electrical conductivity", as used throughout the specification and claims means a conductivity less than that of tap water, that may be lower than approximately 10-5 mho/cm, and may be lower than 10-6 mho/cm. The materials are substantially non-aqueous. The materials in the insulating formulation are non-hazardous to the environment, may be non-toxic, and may be biodegradable. The formulation exhibits a low conductivity.

In one embodiment, the first material comprises one or more natural or synthetic oils. The first material may comprise castor oil, but may comprise or include other oils such as, for example, jojoba oil or mineral oil.

Castor oil (glyceryl triricinoleate), a triglyceride of fatty acids, is obtained from the seed of the castor plant. It is nontoxic and biodegradable. A transformer grade castor oil (from CasChem, Inc.) has a dielectric constant (i.e., relative permittivity) of approximately 4.45 at a temperature of approximately 22° C. (100 Hz).

The second material comprises a solvent, one or more carbonates, and/or may be one or more alkylene carbonates such as, but not limited to, ethylene carbonate, propylene carbonate, or butylene carbonate. The alkylene carbonates can be manufactured, for example, from the reaction of ethylene oxide, propylene oxide, or butylene oxide or similar oxides with carbon dioxide.

Other oils, such as vegetable oil, or other additives can be added to the formulation to modify the properties of the formulation. Solid additives can be added to enhance the dielectric or fluid properties of the formulation.

The concentration of the first material in the insulating formulation may range from between approximately 1.0 and 99.0 percent by volume, between approximately 40.0 and 95.0 percent by volume, between approximately 65.0 and 90.0 percent by volume, and/or between approximately 75.0 and 85.0 percent by volume.

The concentration of the second material in the insulating formulation may range from between approximately 1.0 and 99.0 percent by volume, between approximately 5.0 and 60.0 percent by volume, between approximately 10.0 and 35.0 percent by volume, and/or between approximately 15.0 and 25.0 percent by volume.

Thus, the resulting formulation comprises a dielectric constant that is a function of the ratio of the concentrations of the constituent materials. The mixture for the formulation of one embodiment of the present invention is a combination of butylene carbonate and a high permittivity castor oil wherein butylene carbonate is present in a concentration of approximately 20% by volume. This combination provides a high relative permittivity of approximately 15 while maintaining good insulation characteristics. In this ratio, separation of the constituent materials is minimized. At a ratio of below 32%, the castor oil and butylene carbonate mix very well and remain mixed at room temperature. At a butylene carbonate concentration of above 32%, the fluids separate if undisturbed for approximately 10 hours or more at room temperature. A property of the present invention is its ability to absorb water without apparent effect on the dielectric performance of the insulating formulation.

An embodiment of the present invention comprising butylene carbonate in castor oil comprises a dielectric strength of at least approximately 300 kV/cm (1 μsec), a dielectric constant of approximately at least 6, a conductivity of less than approximately $10^{-5}$ mho/cm, and a water absorption of up to 2,000 ppm with no apparent negative effect caused by such absorption. More preferably, the conductivity is less than approximately $10^{-6}$ mho/cm.

The formulation of the present invention is applicable to a number of pulsed power machine technologies. For example, the formulation is useable as an insulating and drilling fluid for drilling holes in rock or other hard materials or for crushing such materials as provided for herein. The use of the formulation enables the management of the electric fields for electrocrushing rock. Thus, the present invention also comprises a method of disposing the insulating formulation about a drilling environment to provide electrical insulation during drilling.

Other formulations may be utilized to perform the drilling operations described herein. For example, in another embodiment, crude oil with the correct high relative permittivity derived as a product stream from an oil refinery may be utilized. A component of vacuum gas crude oil has high molecular weight polar compounds with O and N functionality. Developments in chromatography allow such oils to be fractionated by polarity. These are usually cracked to produce straight hydrocarbons, but they may be extracted from the refinery stream to provide high permittivity oil for drilling fluid.

Figure 20:
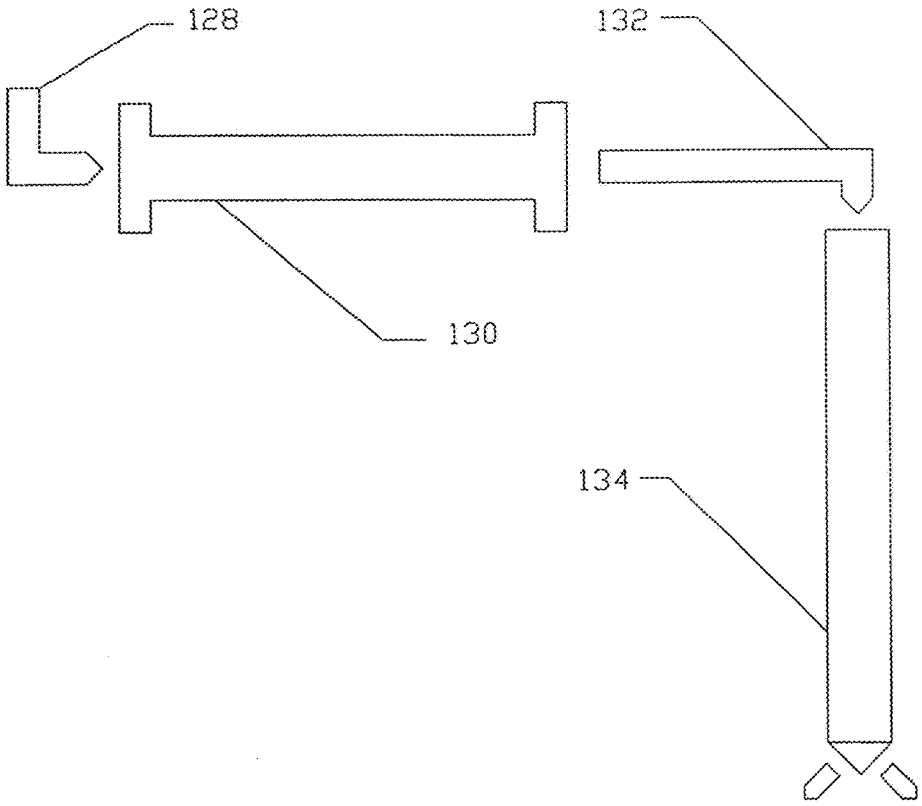
FIG. 20 shows a water treatment unit useable in the embodiments of the present invention.

Another embodiment comprises using specially treated waters. Such waters include, for example, the Energy Systems Plus (ESP) technology of Complete Water Systems which is used for treating water to grow crops. In accordance with this embodiment, FIG. 20 shows water or a water-based mixture 128 entering a water treatment unit 130 that treats the water to significantly reduce the conductivity of the water. The treated water 132 then is used as the drilling fluid by the FAST Drill system 134. The ESP process treats water to reduce the conductivity of the water to reduce the leakage current, while retaining the high permittivity of the water.

High Efficiency Electrohydraulic Boulder Breaker

Another embodiment of the present invention provides a high efficiency electrohydraulic boulder breaker (designated herein as "HEEB") for breaking up medium to large boulders into small pieces. This embodiment prevents the hazard of fly rock and damage to surrounding equipment. The HEEB is related to the High Efficiency Electrohydraulic Pressure Wave Projector disclosed in U.S. Pat. No. 6,215,734 (to the principal inventor herein), incorporated herein by reference.

Figure 21:
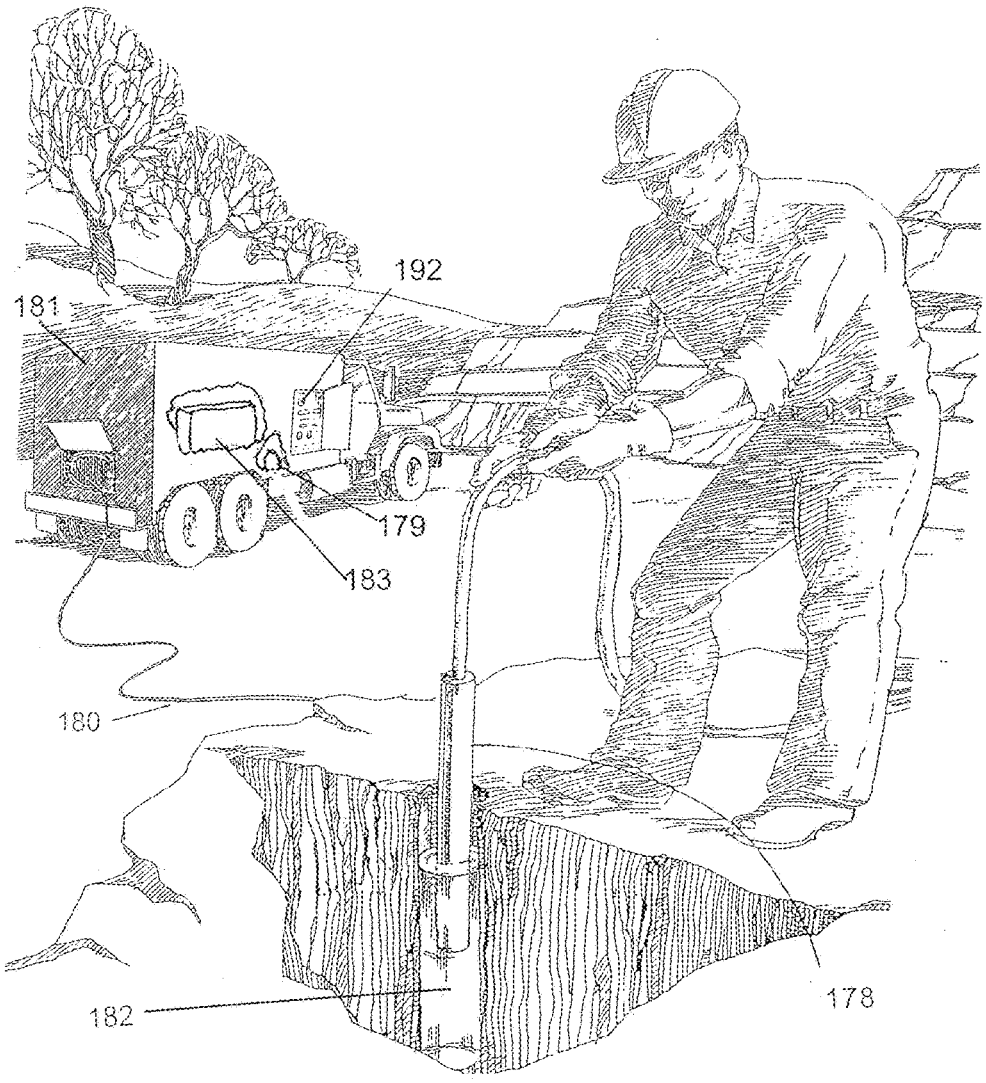
FIG. 21 shows a high energy electrohydraulic boulder breaker system (HEEB) of an embodiment of the present invention.
Figure 22:
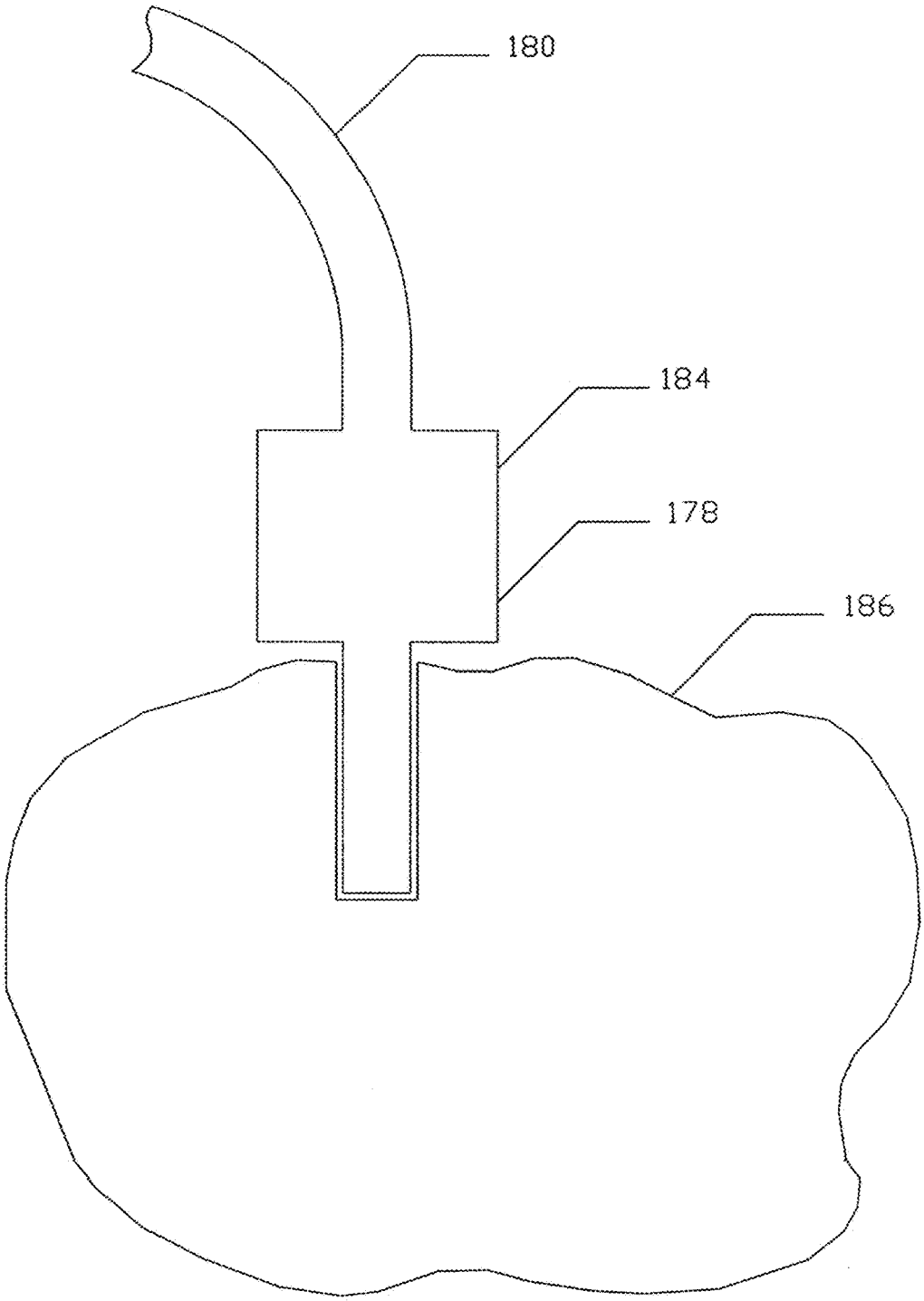
FIG. 22 shows a transducer of the embodiment of FIG. 22.

FIG. 21 shows the HEEB system disposed on truck 181, comprising transducer 178, power cable 180, and fluid 182 disposed in a hole. Transducer 178 breaks the boulder and cable 180 (which may be of any desired length such as, for example, 6-15 m long) connects transducer 178 to electric pulse generator 183 in truck 181. An embodiment of the invention comprises first drilling a hole into a boulder utilizing a conventional drill, filling the hole is filled with water or a specialized insulating fluid, and inserting HEEB transducer 178 into the hole in the boulder. FIG. 22 shows HEEB transducer 178 disposed in boulder 186 for breaking the boulder, cable 180, and energy storage module 184.

Main capacitor bank 183 (shown in FIG. 21) is first charged by generator 179 (shown in FIG. 21) disposed on truck 181. Upon command, control system 192 (shown in FIG. 21 and disposed, for example, in a truck) is closed connecting capacitor bank 183 to cable 180. The electrical pulse travels down cable 180 to energy storage module 184 where it pulse-charges capacitor set 158 (example shown in FIG. 23), or other energy storage devices (example shown in FIG. 25).

Figure 23:
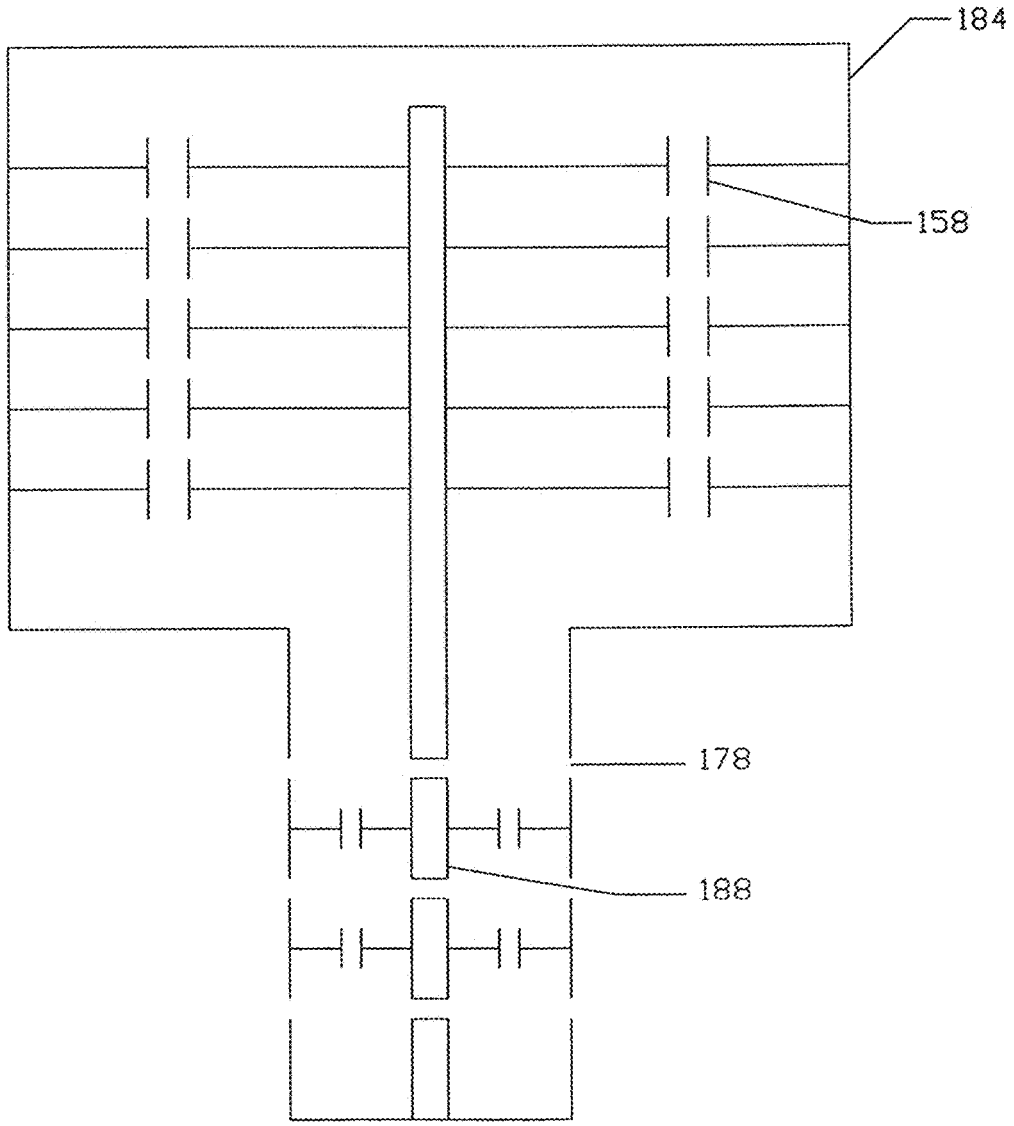
FIG. 23 shows the details of the an energy storage module and transducer of the embodiment of FIG. 22.

FIG. 23 shows the details of the HEEB energy storage module 184 and transducer 178, showing capacitors 158 in module 184, and floating electrodes 188 in transducer 178.

Figure 24:
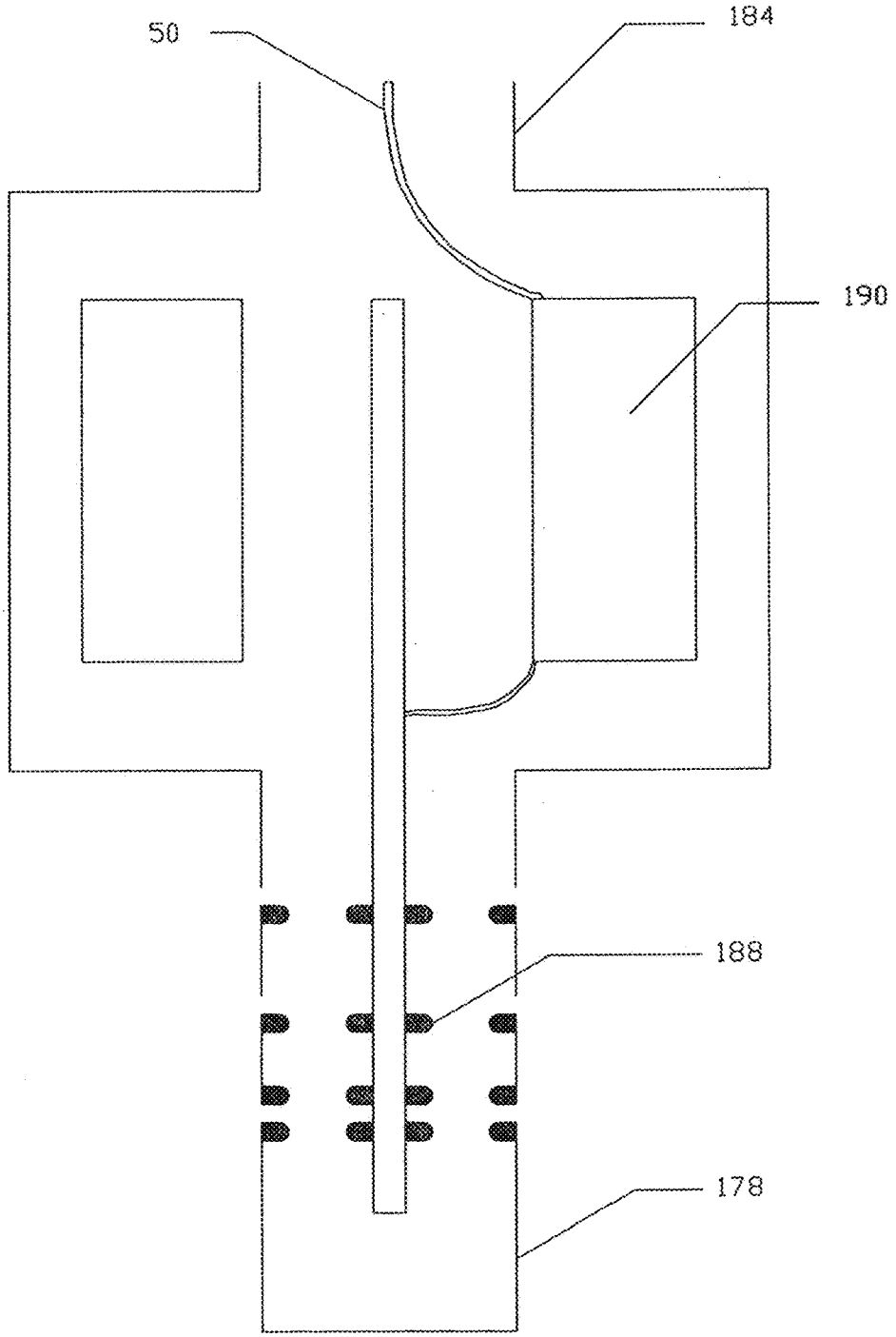
FIG. 24 shows the details of an inductive storage embodiment of the high energy electrohydraulic boulder breaker energy storage module and transducer of an embodiment of the present invention.

FIG. 24 shows the details of the inductive storage embodiment of HEEB energy storage module 184 and transducer 178, showing inductive storage inductors 190 in module 184, and showing the transducer embodiment of parallel electrode gaps 188 in transducer 178. The transducer embodiment of parallel electrode gaps (FIG. 24) and series electrode gaps (FIG. 23) can reach be used alternatively with either the capacitive energy store 158 of FIG. 3 or the inductive energy store 190 of FIG. 24.

These capacitors/devices are connected to the probe of the transducer assembly where the electrodes that create the pressure wave are located. The capacitors increase in voltage from the charge coming through the cable from the main capacitor bank until they reach the breakdown voltage of the electrodes inside the transducer assembly. When the fluid gap at the tip of the transducer assembly breaks down (acting like a switch), current then flows from the energy storage capacitors or inductive devices through the gap. Because the energy storage capacitors are located very close to the transducer tip, there is very little inductance in the circuit and the peak current through the transducers is very high. This high peak current results in a high energy transfer efficiency from the energy storage module capacitors to the plasma in the fluid. The plasma then expands, creating a pressure wave in the fluid, which fractures the boulder.

Figure 25:
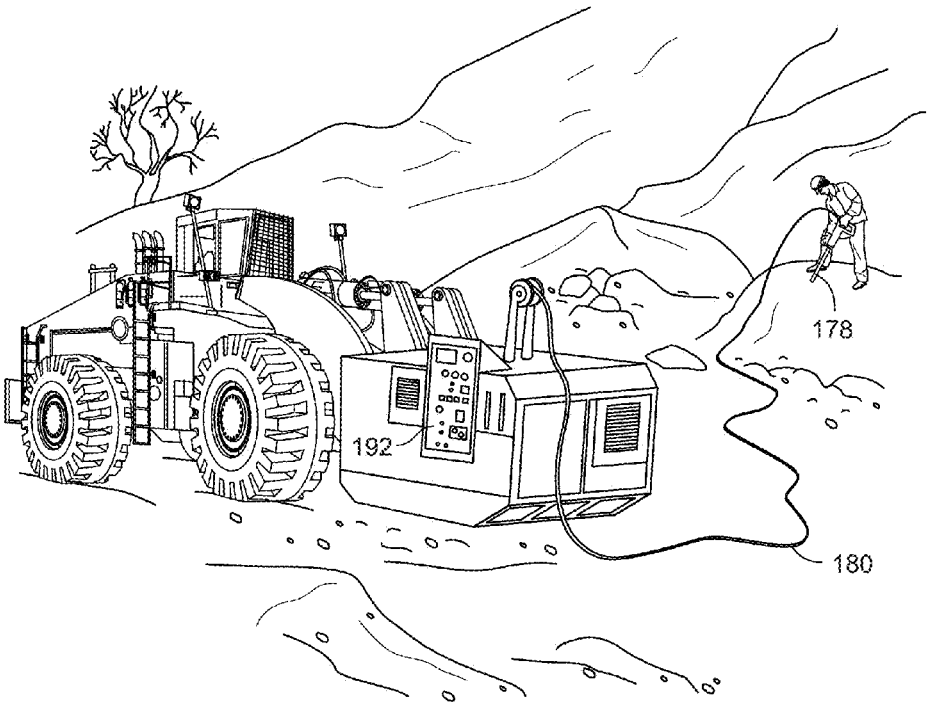
FIG. 25 shows the embodiment of the high energy electrohydraulic boulder breaker disposed on a tractor for use in a mining environment.

The HEEB system may be transported and used in various environments including, but not limited to, being mounted on a truck as shown in FIG. 21 for transport to various locations, used for either underground or aboveground mining applications as shown in FIG. 25, or used in construction applications. FIG. 25 shows an embodiment of the HEEB system placed on a tractor for use in a mining environment and showing transducer 178, power cable 180, and control panel 192.

Therefore, the HEEB does not rely on transmitting the boulder-breaking current over a cable to connect the remote (e.g., truck mounted) capacitor bank to an electrode or transducer located in the rock hole. Rather, the HEEB puts the high current energy storage directly at the boulder. Energy storage elements, such as capacitors, are built into the transducer assembly. Therefore, this embodiment of the present invention increases the peak current through the transducer and thus improves the efficiency of converting electrical energy to pressure energy for breaking the boulder. This embodiment of the present invention also significantly reduces the amount of current that has to be conducted through the cable thus reducing losses, increasing energy transfer efficiency, and increasing cable life.

An embodiment of the present invention improves the efficiency of coupling the electrical energy to the plasma into the water and hence to the rock by using a multi-gap design. A problem with the multi-gap water spark gaps has been getting all the gaps to ignite because the cumulative breakdown voltage of the gaps is much higher than the breakdown voltage of a single gap. However, if capacitance is placed from the intermediate gaps to ground (FIG. 23), each gap ignites at a voltage similar to the ignition voltage of a single gap. Thus, a large number of gaps can be ignited at a voltage of approximately a factor of 2 greater than the breakdown voltage for a single gap. This improves the coupling efficiency between the pulsed power module and the energy deposited in the fluid by the transducer. Holes in the transducer case are provided to let the pressure from the multiple gaps out into the hole and into the rock to break the rock (FIG. 23).

In another embodiment, the multi-gap transducer design can be used with a conventional pulsed power system, where the capacitor bank is placed at some distance from the material to be fractured, a cable is run to the transducer, and the transducer is placed in the hole in the boulder. Used with the HEEB, it provides the advantage of the much higher peak current for a given stored energy.

Thus, an embodiment of the present invention provides a transducer assembly for creating a pressure pulse in water or some other liquid in a cavity inside a boulder or some other fracturable material, said transducer assembly incorporating energy storage means located directly in the transducer assembly in close proximity to the boulder or other fracturable material. The transducer assembly incorporates a connection to a cable for providing charging means for the energy storage elements inside the transducer assembly. The transducer assembly includes an electrode means for converting the electrical current into a plasma pressure source for fracturing the boulder or other fracturable material.

The transducer assembly may have a switch located inside the transducer assembly for purposes of connecting the energy storage module to said electrodes. In the transducer assembly, the cable is used to pulse charge the capacitors in the transducer energy storage module. The cable is connected to a high voltage capacitor bank or inductive storage means to provide the high voltage pulse.

In another embodiment, the cable is used to slowly charge the capacitors in the transducer energy storage module. The cable is connected to a high voltage electric power source.

In an embodiment of the present invention, the switch located at the primary capacitor bank is a spark gap, thyratron, vacuum gap, pseudo-spark switch, mechanical switch, or some other means of connecting a high voltage or high current source to the cable leading to the transducer assembly.

In another embodiment, the transducer electrical energy storage utilizes inductive storage elements.

Another embodiment of the present invention provides a transducer assembly for the purpose of creating pressure waves from the passage of electrical current through a liquid placed between one or more pairs of electrodes, each gap comprising two or more electrodes between which current passes. The current creates a phase change in the liquid, thus creating pressure in the liquid from the change of volume due to the phase change. The phase change includes a change from liquid to gas, from gas to plasma, or from liquid to plasma.

In the transducer, more than one set of electrodes may be arranged in series such that the electrical current flowing through one set of electrodes also flows through the second set of electrodes, and so on. Thus, a multiplicity of electrode sets can be powered by the same electrical power circuit.

In another embodiment, in the transducer, more than one set of electrodes is arranged in parallel such that the electrical current is divided as it flows through each set of electrodes (FIG. 24). Thus, a multiplicity of electrode sets can be powered by the same electrical power circuit.

A plurality of electrode sets may be arrayed in a line or in a series of straight lines.

Figure 26:
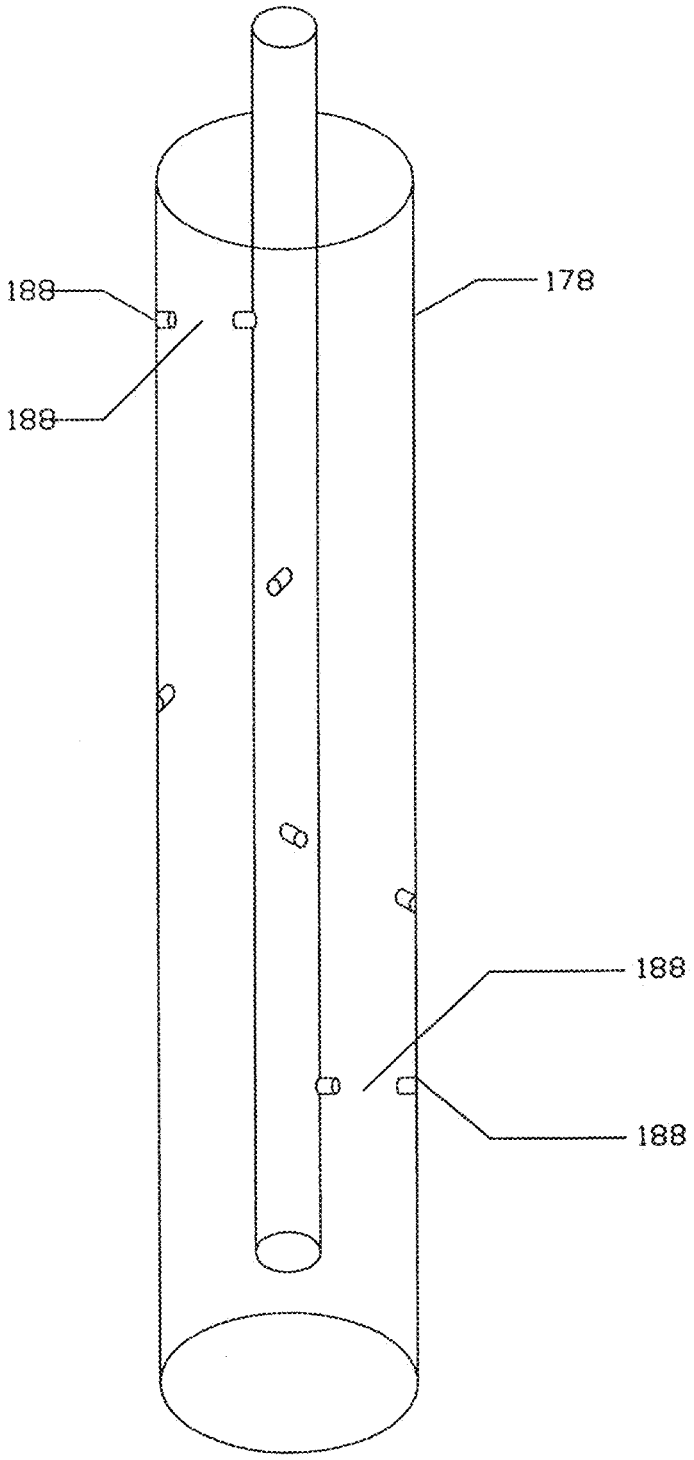
FIG. 26 shows a geometric arrangement of the embodiment of parallel electrode gaps in a transducer in a spiral configuration.

In another embodiment, the plurality of electrode sets is alternatively arrayed to form a geometric figure other than a straight line, including, but not limited to, a curve, a circle (FIG. 24), or a spiral. FIG. 26 shows a geometric arrangement of the embodiment comprising parallel electrode gaps 188 in the transducer 178, in a spiral configuration.

The electrode sets in the transducer assembly may be constructed in such a way as to provide capacitance between each intermediate electrode and the ground structure of the transducer (FIG. 23).

In another embodiment, in the plurality of electrode sets, the capacitance of the intermediate electrodes to ground is formed by the presence of a liquid between the intermediate electrode and the ground structure.

In another embodiment, in the plurality of electrode sets, the capacitance is formed by the installation of a specific capacitor between each intermediate electrode and the ground structure (FIG. 23). The capacitor can use solid or liquid dielectric material.

Figure 27:
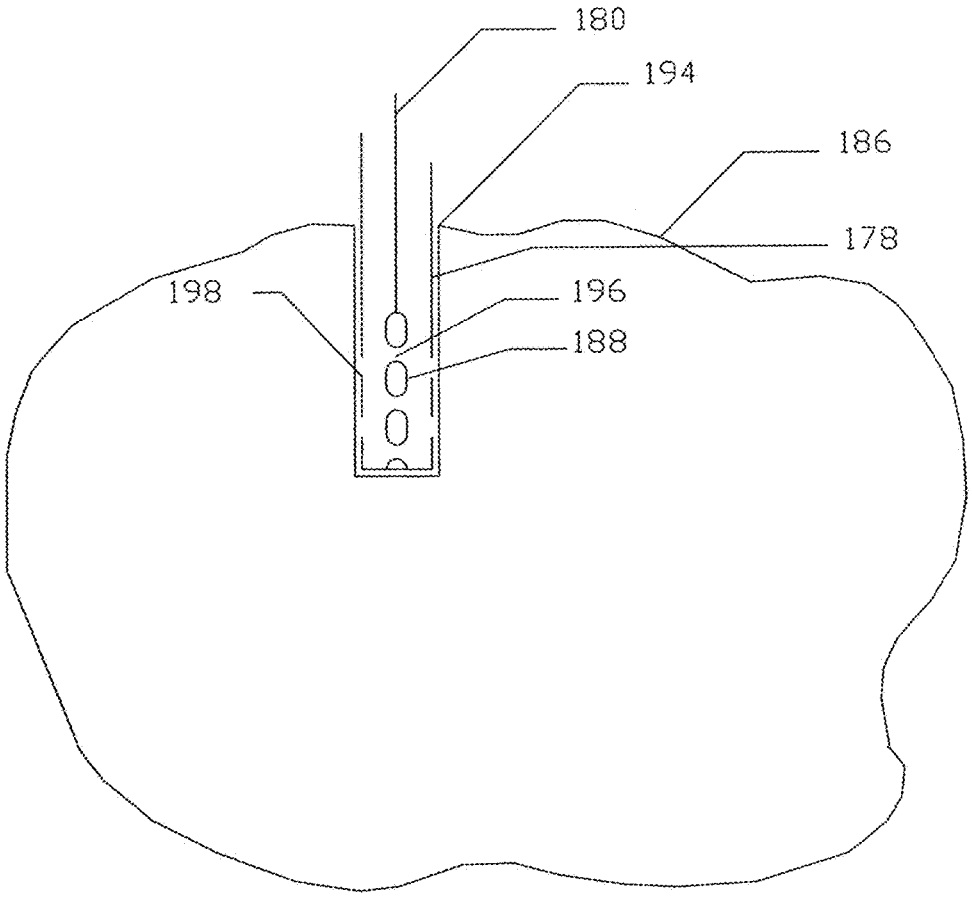
FIG. 27 shows details of another embodiment of an electrohydraulic boulder breaker system.

In another embodiment, in the plurality of electrode sets, capacitance is provided between the electrode sets from electrode to electrode. The capacitance can be provided either by the presence of the fracturing liquid between the electrodes or by the installation of a specific capacitor from an intermediate electrode between electrodes as shown in FIG. 27. FIG. 27 shows the details of the HEEB transducer 178 installed in hole 194 in boulder 186 for breaking the boulder. Shown are cable 180, the floating electrodes 188 in the transducer and liquid between the electrodes 196 that provides capacitive coupling electrode to electrode. Openings 198 in the transducer which allow the pressure wave to expand into the rock hole are also shown.

In an embodiment of the present invention, the electrical energy is supplied to the multi-gap transducer from an integral energy storage module in the multi-electrode transducer.

In another embodiment, in the multi-electrode transducer, the energy is supplied to the transducer assembly via a cable connected to an energy storage device located away from the boulder or other fracturable material.

Virtual Electrode Electro-Crushing Process

Another embodiment of the present invention comprises a method for crushing rock by passing current through the rock using electrodes that do not touch the rock. In this method, the rock particles are suspended in a flowing or stagnant water column, or other liquid of relative permittivity greater than the permittivity of the rock being fractured. Water may be used for transporting the rock particles because the dielectric constant of water is approximately 80 compared to the dielectric constant of rock which is approximately 3.5 to 12.

Figure 28:
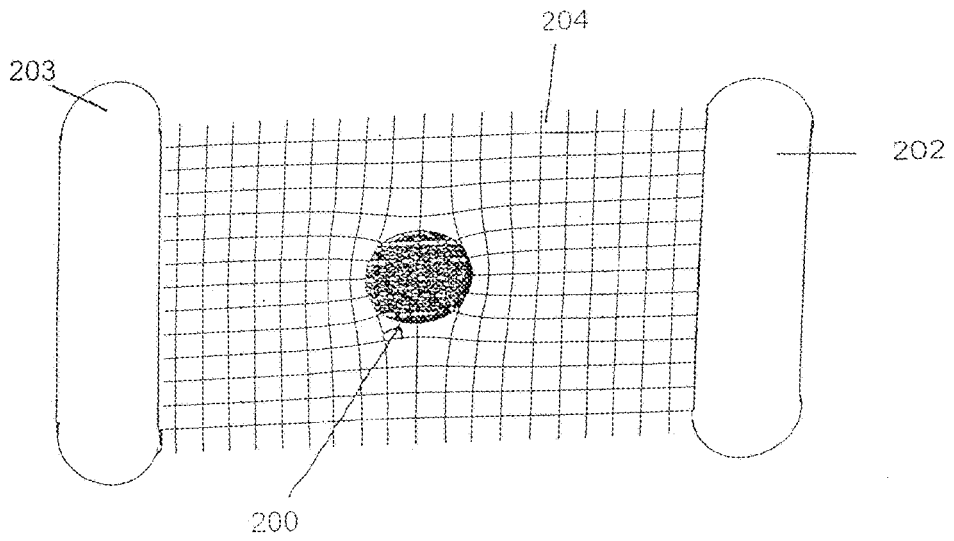
FIG. 28 shows an embodiment of a virtual electrode electrocrushing process.

In one embodiment, the water column moves the rock particles past a set of electrodes as an electrical pulse is provided to the electrodes. As the electric field rises on the electrodes, the difference in dielectric constant between the water and the rock particle causes the electric fields to be concentrated in the rock, forming a virtual electrode with the rock. This is illustrated in FIG. 28 showing rock particle 200 between high voltage electrodes 202 and ground electrode 203 in liquid 204 whose dielectric constant is significantly higher than that of rock particle 200.

The difference in dielectric constant concentrated the electric fields in the rock particle. These high electric fields cause the rock to break down and current to flow from the electrode, through the water, through the rock particles, through the conducting water, and back to the opposite electrode. In this manner, many small particles of rock can be disintegrated by the virtual electrode electrocrushing method without any of them physically contacting both electrodes. The method is also suitable for large particles of rock.

Thus, it is not required that the rocks be in contact with the physical electrodes and so the rocks need not be sized to match the electrode spacing in order for the process to function. With the virtual electrode electrocrushing method, it is not necessary for the rocks to actually touch the electrode, because in this method, the electric fields are concentrated in the rock by the high dielectric constant (relative permittivity) of the water or fluid. The electrical pulse must be tuned to the electrical characteristics of the column structure and liquid in order to provide a sufficient rate of rise of voltage to achieve the allocation of electric field into the rock with sufficient stress to fracture the rock.

Figure 29:
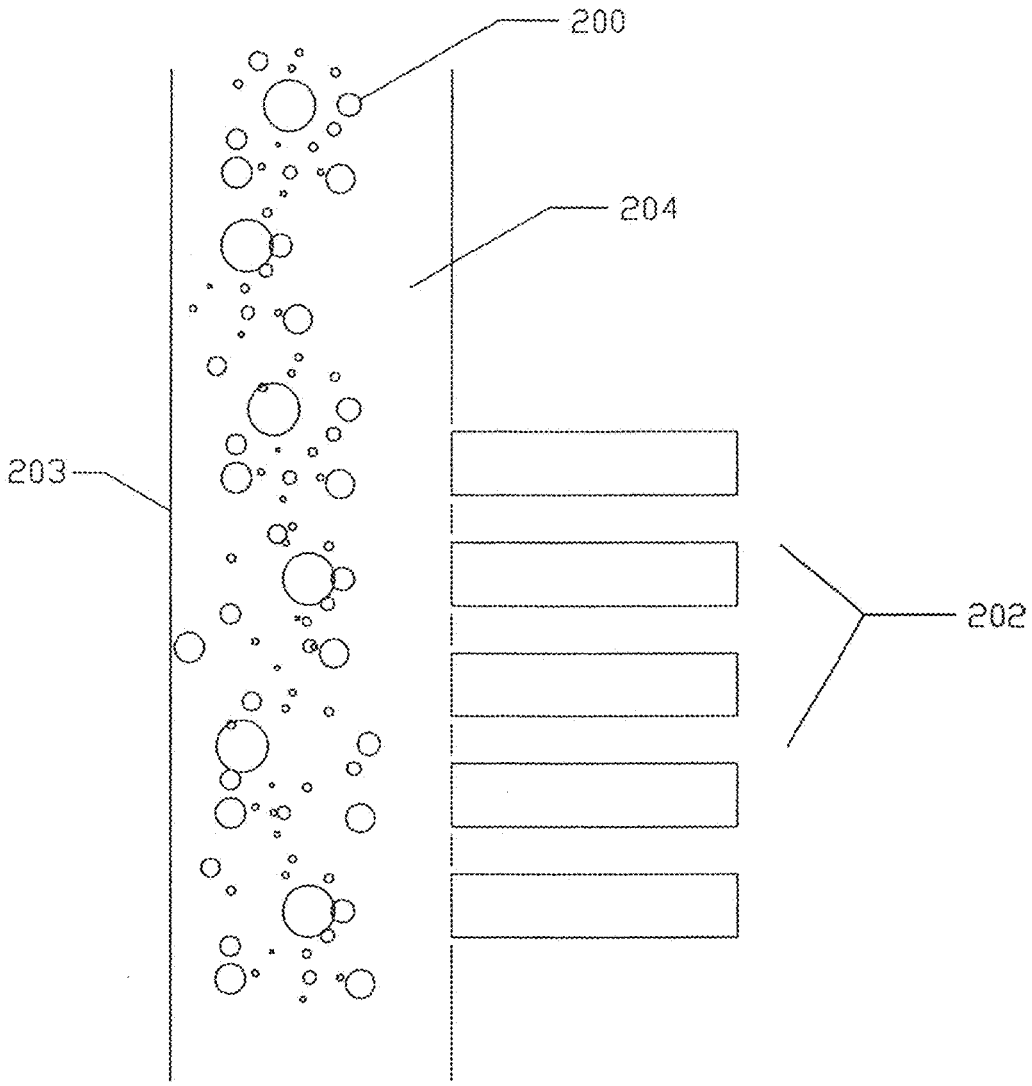
FIG. 29 shows an embodiment of the virtual electrode electrocrushing system comprising a vertical flowing fluid column.

Another embodiment of the present invention, illustrated in FIG. 29, comprises a reverse-flow electro-crusher wherein electrodes 202 send an electrocrushing current to mineral (e.g., rock) particles 200 and wherein water or fluid 204 flows vertically upward at a rate such that particles 200 of the size desired for the final product are swept upward, and whereas particles that are oversized sink downward.

As these oversized particles sink past the electrodes, a high voltage pulse is applied to the electrodes to fracture the particles, reducing them in size until they become small enough to become entrained by the water or fluid flow. This method provides a means of transport of the particles past the electrodes for crushing and at the same time differentiating the particle size.

The reverse-flow crusher also provides for separating ash from coal in that it provides for the ash to sink to the bottom and out of the flow, while the flow provides transport of the fine coal particles out of the crusher to be processed for fuel.

INDUSTRIAL APPLICABILITY

The invention is further illustrated by the following non-limiting example(s).

Example 1

Figure 30:
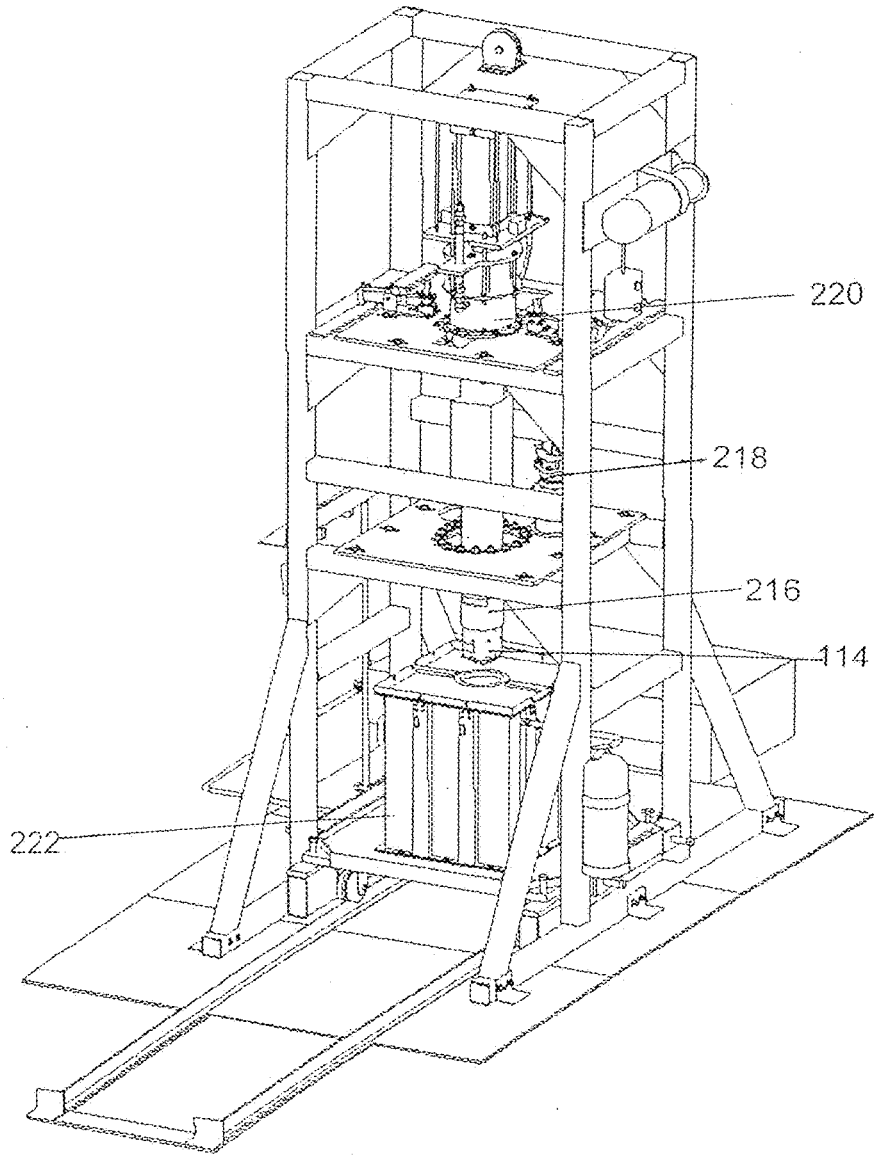
FIG. 30 shows a pulsed power drilling apparatus manufactured and tested in accordance with an embodiment of the present invention.

An apparatus utilizing FAST Drill technology in accordance with the present invention was constructed and tested. FIG. 30 shows FAST Drill bit 114, the drill stem 216, the hydraulic motor 218 used to turn drill stem 216 to provide power to mechanical teeth disposed on drill bit 114, slip ring assembly 220 used to transmit the high voltage pulses to the FAST bit 114 via a power cable inside drill stem 216, and tank 222 used to contain the rocks being drilled. A pulsed power system, contained in a tank (not shown), generated the high voltage pulses that were fed into the slip ring assembly. Tests were performed by conducting 150 kV pulses through drill stem 216 to the FAST Bit 114, and a pulsed power system was used for generating the 150 kV pulses. A drilling fluid circulation system was incorporated to flush out the cuttings. The drill bit shown in FIG. 4 was used to drill a 7 inch diameter hole approximately 12 inches deep in rock located in a rock tank. A fluid circulation system flushed the rock cuttings out of the hole, cleaned the cuttings out of the fluid, and circulated the fluid through the system.

Example 2

A high permittivity fluid comprising a mixture of castor oil and approximately 20% by volume butylene carbonate was made and tested in accordance with the present invention as follows.

1. Dielectric Strength Measurements.

Figure 31:
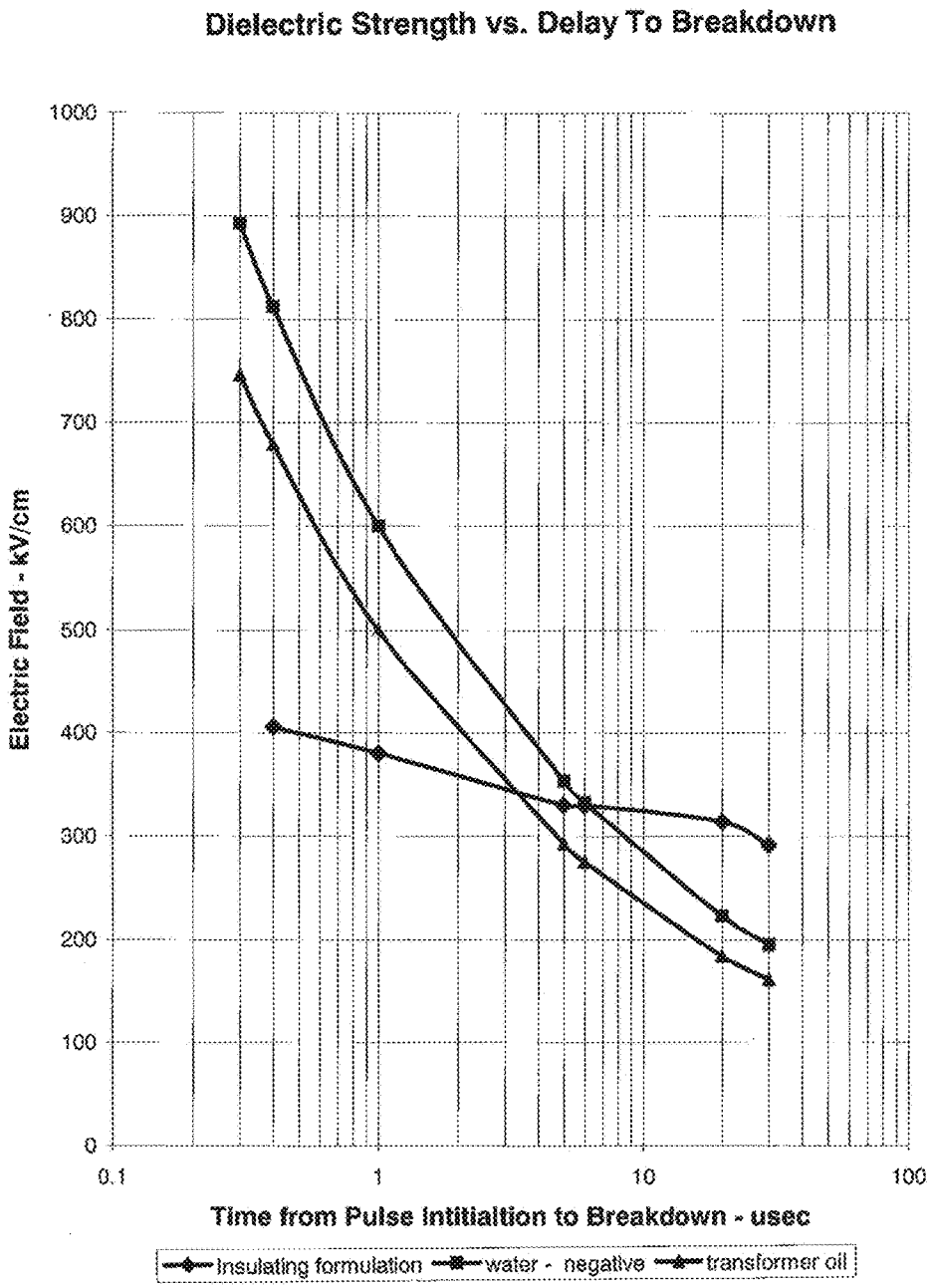
FIG. 31 is a graph showing dielectric strength versus delay to breakdown of the insulating formulation of the present invention, oil, and water.

Because this insulating formulation of the present invention is intended for high voltage applications, the properties of the formulation were measured in a high voltage environment. The dielectric strength measurements were made with a high voltage Marx bank pulse generator, up to 130 kV. The rise time of the Marx bank was less than 100 nsec. The breakdown measurements were conducted with 1-inch balls immersed in the insulating formulation at spacings ranging from 0.06 to 0.5 cm to enable easy calculation of the breakdown fields. The delay from the initiation of the pulse to breakdown was measured. FIG. 31 shows the electric field at breakdown plotted as a function of the delay time in microseconds. Also included are data from the Charlie Martin models for transformer oil breakdown and for deionized water breakdown (Martin, T. H., A. H. Guenther, M Kristiansen "J. C. Martin on Pulsed Power" Lernum Press, (1996)).

The breakdown strength of the formulation was substantially higher than transformer oil at times greater than 10 μsec. No special effort was expended to condition the formulation. It contained dust, dissolved water and other contaminants, whereas the Martin model is for very well conditioned transformer oil or water.

2. Dielectric Constant Measurements.

The dielectric constant was measured with a ringing waveform at 20 kV. The ringing high voltage circuit was assembled with 8-inch diameter contoured plates immersed in the insulating formulation at 0.5-inch spacing. The effective area of the plates, including fringing field effects, was calibrated with a fluid whose dielectric constant was known (i.e., transformer oil). An aluminum block was placed between the plates to short out the plates so that the inductance of the circuit could be measured with a known circuit capacitance. Then, the plates were immersed in the insulating formulation, and the plate capacitance was evaluated from the ringing frequency, properly accounting for the effects of the primary circuit capacitor. The dielectric constant was evaluated from that capacitance, utilizing the calibrated effective area of the plate. These tests indicated a dielectric constant of approximately 15.

3. Conductivity Measurements.

To measure the conductivity, the same 8-inch diameter plates used in the dielectric constant measurement were utilized to measure the leakage current. The plates were separated by 2-inch spacing and immersed in the insulating formulation. High voltage pulses, ranging from 70-150 kV were applied to the plates, and the leakage current flow between the plates was measured. The long duration current, rather than the initial current, was the value of interest, in order to avoid displacement current effects. The conductivity obtained was approximately 1 micromho/cm [$1\times10^{-6}$ (ohm-cm)$^{-1}$].

4. Water Absorption.

The insulating formulation has been tested with water content up to 2000 ppm without any apparent effect on the dielectric strength or dielectric constant. The water content was measured by Karl Fisher titration.

5. Energy Storage Comparison.

The energy storage density of the insulating formulation of the present invention was shown to be substantially higher than that of transformer oil, but less than that of deionized water. Table 1 shows the energy storage comparison of the insulating formulation, a transformer oil, and water in the 1 μsec and 10 μsec breakdown time scales. The energy density (in joules/cm$^3$) was calculated from the dielectric constant ($\in,\in_0$) and the breakdown electric field ($E_{bd}$~kV/cm). The energy storage density of the insulating formulation is approximately one-fourth that of water at 10 microseconds. The insulating formulation did not require continuous conditioning, as did a water dielectric system. After about 12 months of use, the insulating formulation remained useable without conditioning and with no apparent degradation.

TABLE 1

Comparison of Energy Storage Density

| | | Time = 1 μsec | | Time = 10 μsec | |
|---|---|---|---|---|---|
| Fluid | Dielectic Constant | kV/cm | Energy Density | kV/cm | Energy Density |
| Insulating formulation | 15 | 380 | 9.59E−02 | 325 | 7.01E−02 |
| Trans. Oil | 2.2 | 500 | 2.43E−02 | 235 | 5.38E−03 |
| Water | 80 | 600 | 1.27E+00 | 280 | 2.78E−01 |

Energy density = $\frac{1}{2} * \in * \in_0 * E_{bd} * E_{bd}$~j/cm$^3$

6. Dielectric Properties.

A summary of the dielectric properties of the insulating formulation of the present invention is shown in Table 2. Applications of the insulating formulation include high energy density capacitors, large-scale pulsed power machines, and compact repetitive pulsed power machines.

TABLE 2

Summary of Formulation Properties

| | |
|---|---|
| Dielectric Strength = | 380 kV/cm (1 μsec) |
| Dielectric Constant = | 15 |
| Conductivity = | 1e−6 mho/cm |
| Water absorption = | up to 2000 ppm with no apparent ill effects |

Spiker-Sustainer

Another embodiment of the present invention comprises two pulsed power systems coordinated to fire one right after the other.

Creating an arc inside the rock or other substrate with the electrocrushing (EC) process potentially comprises a large mismatch in impedance between the pulsed power system that provides the high voltage pulse and the arc inside the substrate. The conductivity of the arc may be quite high, because of the high plasma temperature inside the substrate, thus yielding a low impedance load to the pulsed power system requiring high current to deposit much energy. In contrast, the voltage required to overcome the insulative properties of the substrate (break down the substrate electrically) may be quite high, requiring a high impedance circuit (high ratio of voltage to current). The efficiency of transferring energy from the pulsed power system into the substrate can be quite low as a consequence of this mismatch.

The first pulsed power system, comprising a spiker, may create a high voltage pulse that breaks down the insulative properties of the substrate and may create an arc channel in the substrate. It is designed for high voltage but low energy, at high impedance. The second pulsed power system, comprising a sustainer, is designed to provide high current into the arc, but at low voltage, thus better matching the impedance of the arc and achieving much more efficient energy transfer.

Figure 32:
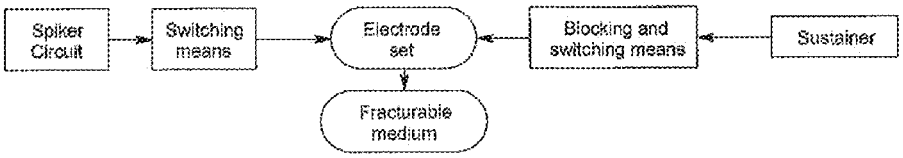
FIG. 32 is a schematic of a spiker-sustainer circuit.

FIG. 32 illustrates a schematic of the spiker sustainer circuit in operation. The spiker circuit is charged to a high voltage. A switching apparatus subsequently connects the spiker circuit to an electrode set that provides an electric field to the fracturable substrate. The high voltage pulse from the spiker circuit exceeds the dielectric strength of the fracturable substrate and creates a conductive channel comprising as plasma channel in the fracturable substrate.

The sustainer circuit comprises a blocker that prevents the high voltage pulse from the spiker circuit from conducting into the sustainer circuit. After a conductive channel is established, a switch on the sustainer circuit connects the sustainer circuit to an electrode set that in turn is connected to the fracturable substrate. The stored energy in the sustainer circuit then flows through the conductive channel in the fracturable substrate, depositing energy into the fracturable substrate to create fractures, and finally fracturing or breaking the substrate.

The spiker-sustainer circuit is used in electrocrushing rock or any other fracturable medium or substrate.

The switch used in the spiker may include liquid and gas switches, solid state switches, and metal vapor switches.

The blocker used with the sustainer may include solid-state diodes, liquid and gas diodes, or high voltage chervil switches, including liquid and gas switches, solid state switches, and metal vapor switches.

Electrode sets connect the high voltage pulse from the spiker and the high current pulse from the sustainer into the substrate. The electrode sets comprise a single electrode set or a plurality of electrode sets disposed on the substrate, and the electrode sets may operate off a single spiker circuit or off a single sustainer circuit.

The spiker-sustainer circuit may comprise a plurality of circuits, at least one of which initiates a conductive channel and at least one of which provides the energy into the conductive channel.

The spiker-sustainer circuit alternately may comprise plurality of spikers operating a plurality of electrode sets operating with a single sustainer.

Figure 33A:
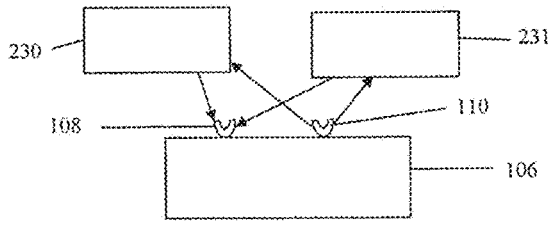
FIG. 33A shows the spiker pulsed power system and the sustainer pulsed power system.
Figure 33B:
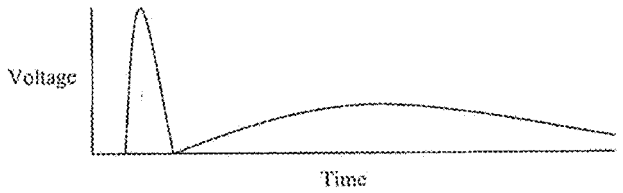
FIG. 33B shows the voltage waveforms produced by each.

FIG. 33A illustrates spiker pulsed power system 230 and sustainer pulsed power system 231, both connected to center electrode 108 and to surrounding electrode 110, both electrodes in contact or near substrate 106. FIG. 33B illustrates a typical voltage waveform produced by spiker 230 and sustainer 231, the high voltage narrow pulse waveform produced by spiker 230 and the lower voltage, typically a longer duration waveform, produced by sustainer 231. Typical voltages for spiker 230 may range from approximately 50 to 700 kV, and/or range from approximately 100 to 500 kV. Typical voltages produced by sustainer 231 may range from approximately 1 to 150 kV and/or may range from approximately 10 to 100 kV. A wide variety of switches and pulsed power circuits can be used for either spiker 230 or sustainer 231 to switch the stored electrical energy into the substrate, including but not limited to solid state switches, gas or liquid spark gaps, thyratrons, vacuum tubes, and solid state optically triggered or self-break switches (see FIGS. 12-15). The energy can be stored in either capacitors 158 and 164 (see FIGS. 12-14) or inductors 168 (see FIG. 15) and 166 (see FIG. 34).

Figure 34:
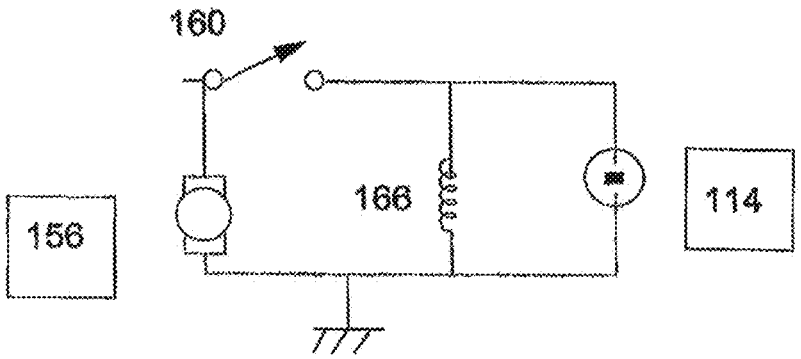
FIG. 34 is an illustration of an inductive energy storage circuit applicable to conventional and spiker-sustainer applications.

FIG. 34 illustrates an inductive energy storage circuit applicable to conventional and spiker-sustainer applications, illustrating switch 160 initially closed, circulating current from generating means current source 156 through inductor 166. When the current is at the correct value, switch 160 is opened, creating a high voltage pulse that is fed to FAST bit 114.

The high voltage can be created through pulsed transformer 162 (see FIG. 12) or charging capacitors in parallel and adding them in series (see FIG. 14) or a combination thereof (see FIG. 13).

The spiker-sustainer pulsed power system can be located downhole in the bottom hole assembly, at the surface with the pulse sent over a plurality of cables, or in an intermediate section of the drill string.

Non-Rotating Electrocrushing (EC) FAST Bit

Figure 35:
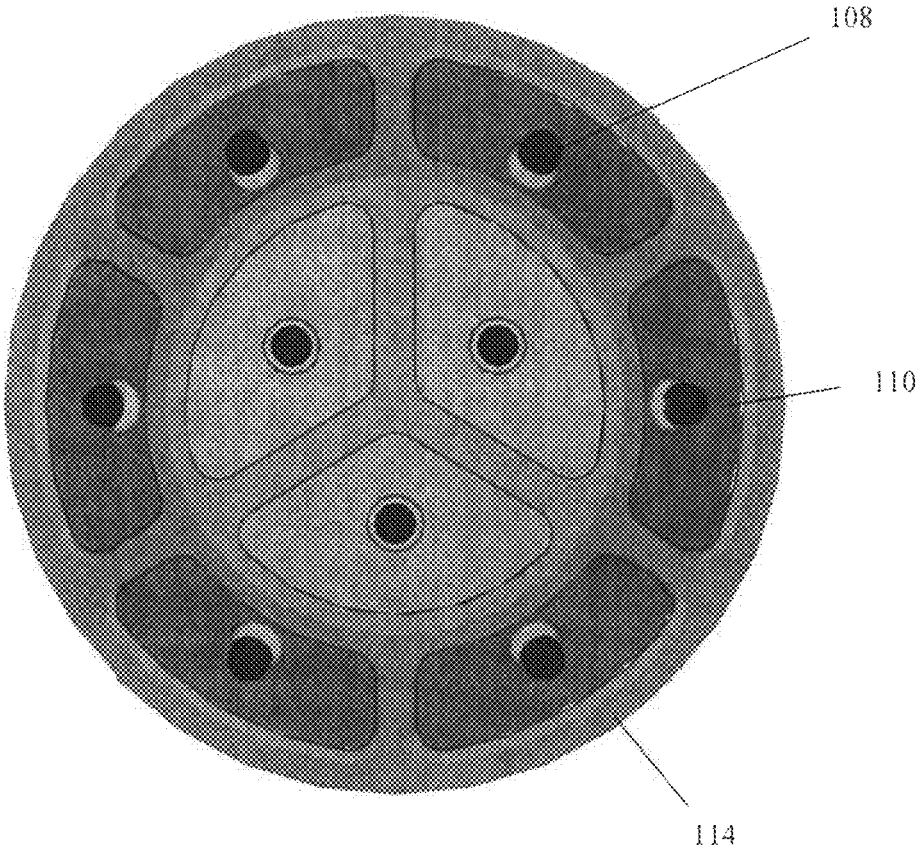
FIG. 35 is an illustration of a non-rotating electrocrushing bit of the present invention.

FIG. 35 illustrates non-rotating electrocrushing FAST bit 114, showing center electrode 108 of a typical electrode set and surrounding electrode 110 (without mechanical teeth since the bit does not rotate).

Figure 36:
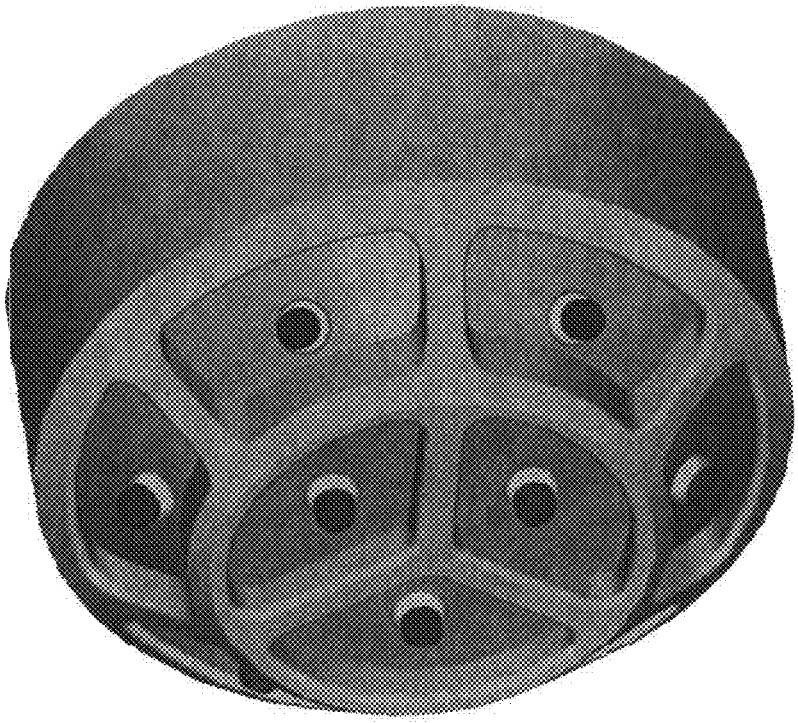
FIG. 36 is a perspective view of the non-rotating electrocrushing bit of FIG. 35.
Figure 37:
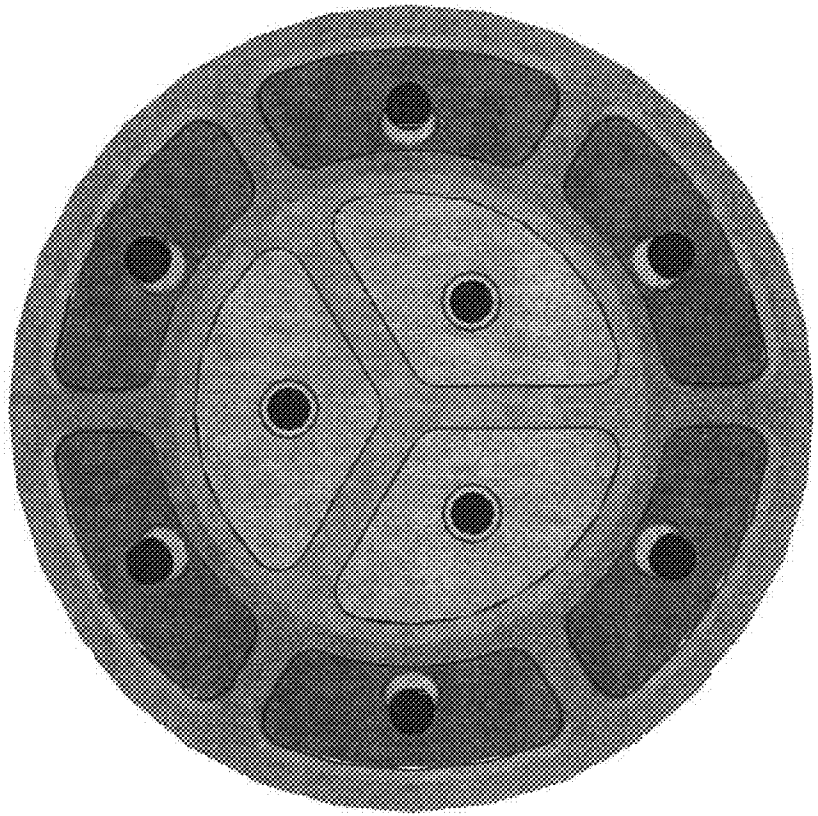
FIG. 37 illustrates a non-rotating electrocrushing bit with an asymmetric arrangement of the electrode sets.

FIG. 36 illustrates a perspective view of the same typical FAST electrocrushing non-rotating bit, more clearly showing the center grouping of electrode sets on the non-conical part of the bit and the side electrode sets located on the conical portion of the bit. An asymmetric configuration of the electrode sets is another embodiment providing additional options for bit directional control, as illustrated in FIG. 37.

The non-rotating bit may be designed with a plurality of electrocrushing electrode sets with the sets divided in groups of one or more electrode sets per group for directional control. For example, in FIG. 35, the electrocrushing electrode sets may be divided into four groups: the center three electrode sets as one group and the outer divided into three groups of two electrode sets each. Each group of electrode sets is powered by a single conductor. The first electrode set in a group to achieve ignition through the rock or substrate is the one that excavates. The other electrode sets in that group do not fire because the ignition of the first electrode set to ignite causes the voltage to drop on that conductor and the other electrode sets in that group do not fire. The first electrode set to ignite excavates sufficient rock out in front of it that it experiences an increase in the required voltage to ignite and a greater ignition delay because of the greater arc path through the rock, causing another electrode set in the group to ignite first.

The excavation process may be self-regulating and all the electrode sets in a group may excavate at approximately the same rate. The nine electrode sets shown in FIG. 35 may require four pulsed power systems to operate the bit. Alternatively, the nine electrode sets in the bit of FIG. 35 are each operated by a single pulsed power system, e.g. requiring nine pulsed power systems to operate the bit. This configuration may provide precise directional control of the bit compared to the four pulsed power system configuration, but at a cost of greater complexity.

Directional control may be achieved by increasing the pulse repetition rate or pulse energy for those conical electrode sets toward which it is desired to turn the bit. For example, as illustrated in FIG. 35, either the pulse repetition rate or pulse energy are increased to that group of electrode sets compared to the other two groups of conical electrode sets to turn towards the pair of electrodes mounted on the conical portion of the bit as shown at the bottom of FIG. 36. The bottom electrode sets subsequently excavate more rock on that side of the bit than the other two groups of conical electrode sets and the bit preferably tends to turn in the direction of the bottom pair of electrode sets. The power to the center three electrode sets preferably changes only enough to maintain the average bit propagation rate through the rock. The group of center electrodes do not participate in the directional control of the bit.

The term "rock" as used herein is intended to include rocks or any other substrates wherein drilling is needed.

The two conical electrode sets on the bottom and the bottom center electrode may all participate in the directional control of the bit when nine pulsed power systems are utilized to power the non-rotating bit with each electrode set having its own pulsed power system.

Another embodiment comprises arranging all the electrocrushing electrode sets in a conical shape, with no a flat portion to the bit, as shown in FIG. 6.

FIG. 36 illustrates a perspective view of the same typical FAST electrocrushing non-rotating bit, more clearly illustrating the center grouping of electrode sets on the non-conical part of the bit and the side electrode sets located on the conical portion of the bit.

FIG. 37 illustrates a typical FAST electrocrushing non-rotating bit with an asymmetric arrangement of the electrode sets. Another embodiment comprising a non-rotating bit system utilizing continuous coiled tubing to provide drilling fluid to the non-rotating drill bit, comprising a cable to preferably bring electrical power from the surface to the downhole pulsed power system, as shown in FIG. 37.

Figure 38:
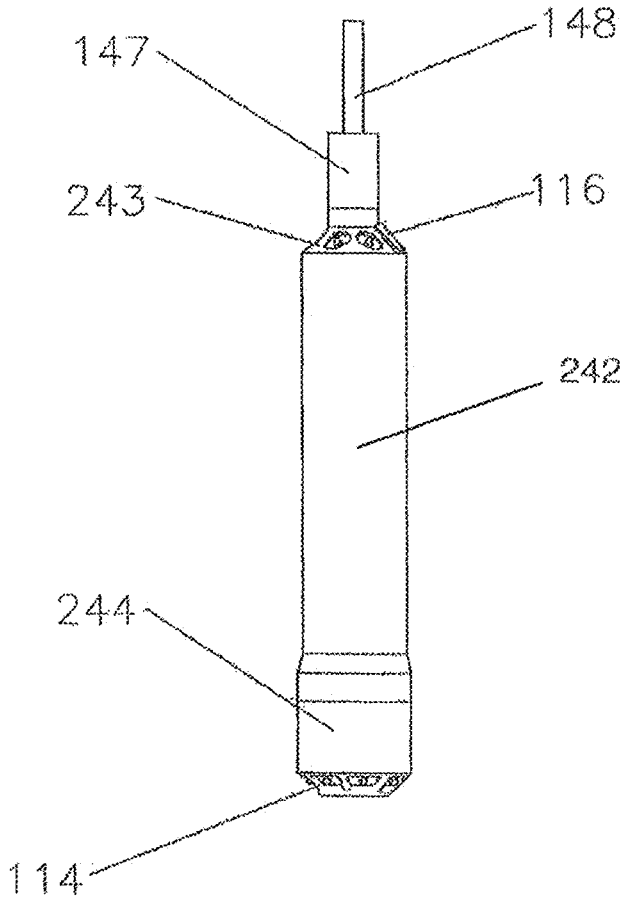
FIG. 38 is an illustration of a bottom hole assembly of the present invention.
Figure 39:
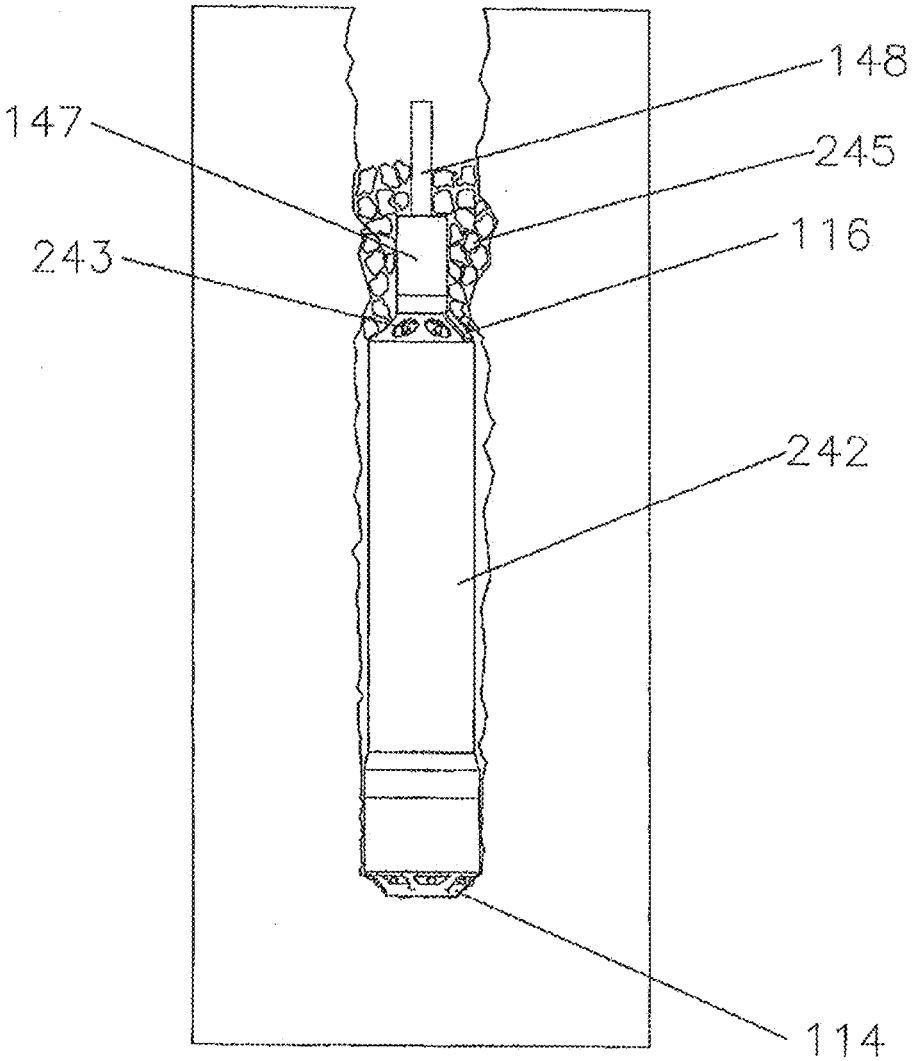
FIG. 39 illustrates the bottom hole assembly in a well.

Bottom hole assembly 242, as illustrated in FIGS. 38 and 39, comprises FAST electrocrushing bit 114, electrohydraulic projectors 243, drilling fluid pipe 147, power cable 148, and housing 244 that may comprise the pulsed power system and other components of the downhole drilling assembly (not shown).

The cable may be located inside the continuous coiled tubing, as shown in FIG. 37 or outside. This embodiment does not comprise a down-hole generator, overdrive gear, or generator drive mud motor or a bit rotation mud motor, since the bit does not rotate. Another embodiment utilizes segmented drill pipe to provide drilling fluid to the non-rotating drill bit, with a cable either outside or inside the pipe to bring electrical power and control signals from the surface to the downhole pulsed power system.

In another embodiment, part of the total fluid pumped down the fluid pipe is diverted through the backside electrohydraulic projectors/electrocrushing electrode sets when in normal operation. The fluid flow rate required to clean the rock particles out of the hole is greater above the bottom hole assembly than at the bottom hole assembly, because typically the diameter of the fluid pipe and power cable is less than the diameter of the bottom hole assembly, requiring greater volumetric flow above the bottom hole assembly to maintain the flow velocity required to lift the rock particles out of the well.

Another embodiment of the present invention comprises the method of backwards excavation. Slumping of the hole behind the bit, wherein the wall of the well caves in behind the bottom hole assembly, blocking the ability of the bottom hole assembly to be extracted from the well and inhibiting further drilling because of the blockage, as shown in FIG. 38, can sometimes occur. An embodiment of the present invention comprises the electrical-driven excavation processes of the FAST drill technology. An embodiment of the present invention comprises the application of the electrocrushing process to drilling. A combination of the electrohydraulic or plasma-hydraulic process with electrocrushing process may also be utilized to maximize the efficacy of the complete drilling process. The electrohydraulic projector may create an electrical spark in the drilling fluid, not in the rock. The spark preferably creates an intense shock wave that is not nearly as efficient in fracturing rock as the electrocrushing process, but may be advantageous in extracting the bit from a damaged well. A plurality of electrohydraulic projectors may be installed on the back side of the bottom hole assembly to preferably enable the FAST Drill to drill its way out of the slumped hole. At least one electrocrushing electrode set may comprise an addition to efficiently excavate larger pieces of rock that have slumped onto the drill bottom hole assembly. An embodiment of the present invention may comprise only electrocrushing electrode sets on the back of the bottom hole assembly, which may operate advantageously in some formations.

FIG. 38 illustrates bottom hole assembly 242 comprising FAST electrocrushing bit 114, electrohydraulic projectors 243, drilling fluid pipe 147, power cable 148, and housing 244 that may contain the pulsed power system (not shown) and other components of the downhole drilling assembly. FIG. 38 illustrates electrohydraulic projectors 243 installed on the back of bottom hole assembly 242. Inside the bottom hole assembly a plurality of switches (not shown) may be disposed that may be activated from the surface to switch the electrical pulses that are sent to the electrocrushing non-rotating bit and are alternately sent to power the electrohydraulic projectors/electrocrushing electrode sets disposed on the back side of the bottom hole assembly. The spiker-sustainer system for powering the electrocrushing electrode sets in the main non-rotating bit may improve the efficiency of the electrohydraulic projectors disposed at the back of the bottom hole assembly. Alternately, an electrically actuated valve diverts a portion of the drilling fluid flow pumped down the fluid pipe to the back electrohydraulic projectors/electrocrushing electrode sets and flushes the slumped rock particles up the hole.

In another embodiment of the present invention, electrohydraulics alone or electrohydraulic projectors in conjunction with electrocrushing electrode sets may be used at the back of the bottom hole assembly. The electrohydraulic projectors are especially helpful because the high power shock wave breaks up the slumped rock behind the bottom hole assembly and disturbs the rock above it. The propagation of the pressure pulse through the slumped rock disturbs the rock, providing for enhanced fluid flow through it to carry the rock particles up the well to the surface. As the bottom hole assembly is drawn up to the surface, the fluid flow carries the rock particles to the surface, and the pressure pulse continually disrupts the slumped rock to keep it from sealing the hole. One or more electrocrushing electrode sets may be added to the plurality of projectors at the back of the bottom hole assembly to further enhance the fracturing and removal of the slumped rock behind the bottom hole assembly.

In another embodiment of the present invention comprising the FAST drill, a cable may be disposed inside the fluid pipe and the fluid pipe may comprise a rotatable drill pipe. Mechanical teeth 116 may be installed on the back side of the bottom hole assembly and the bottom hole assembly may be rotated to further assist the electrohydraulic/electrocrushing projectors in cleaning the rock from behind the bottom hole assembly. The bottom hole assembly is rotated as it is pulled out while the electrohydraulic projectors/electrocrushing electrode sets are fracturing the rock behind the bottom hole assembly and the fluid is flushing the rock particles up the hole.

FIG. 39 shows bottom hole assembly 242 in the well with part of the wall of the well slumped around the top of the drill and drill pipe 147, trapping the drill in the hole with rock fragments 245.

Embodiments of the present invention described herein may also include, but are not limited to the following elements or steps:

The invention may comprise a plurality of electrode sets disposed on the bit. The pulse repetition rate as well as the pulse energy produced by the pulsed power generator is variably directed to different electrode sets, thus breaking more substrate from one side of the bit than another side, thus causing the bit to change direction. Thus, the bit is steered through the substrate;

The electrode sets comprise groups of arranged sets. The electrode sets are connected with a single connection to the pulsed power generator for each group of arranged set.

The present invention comprises a single connection provided from the pulsed power generator to each electrode set disposed on the bit. The present invention comprises a single connection provided from the pulsed power generator to some of the electrode sets disposed on the bit. The remaining electrode sets are arranged into one or a plurality of groups with a single connection to the pulsed power generator for each group.

The present invention comprises a plurality of electrode sets disposed on the drill bit. The pulse repetition rate or pulse energy is applied differently to different electrode sets on the bit for the purpose of steering the bit from the differential operation of the electrode sets.

The present invention comprises a plurality of electrode sets arranged in groups. The pulse repetition rate or pulse energy is applied differently to different groups of electrode sets for the purpose of steering the bit from the differential operation of electrode sets.

The present invention comprises a plurality of electrode sets arranged along a face of the drill bit with symmetry relative to the axis of the direction of motion of the drill bit.

Additionally, the present invention comprises a plurality of electrode sets arranged along a face of the drill bit with some of the electrode sets not having symmetry relative to the axis of the direction of motion of the drill bit.

The arrangement of the electrode sets comprises conical shapes comprising axes substantially parallel to the axis of the direction of motion of the drill bit. Additionally, the arrangement of the electrode sets comprises conical shapes comprising axes at an angle to the axis of the direction of motion of the drill bit. Additionally, the arrangement of the electrode sets comprises a flat section perpendicular to the direction of motion of the drill bit in conjunction with a plurality of conical shapes comprising axes substantially oriented to the axis of the direction of motion of the drill bit.

The present invention comprises providing electrode sets arranged into groups with a single connection to a voltage and current pulse source for each group.

The present invention comprises providing a single connection to a voltage and current pulse source for each electrode set on the bit. Alternately, the present invention comprises providing a single connection to a voltage and current pulse source for each of some of the electrode sets on the bit while arranging the remaining electrode sets into at least one group with a single connection to a voltage and current pulse source for each group.

The present invention comprises tuning the current pulse to the substrate properties so that the substrate is broken beyond the boundaries of the electrode set.

The present invention comprises providing a power conducting means comprising a cable for providing power to a FAST drill bottom hole assembly. The cable is disposed inside a fluid conducting means for conducting drilling fluid from the surface to the bottom hole assembly. Alternately, the cable is disposed outside a fluid conducting means.

The present invention comprises a bottom hole assembly comprising a drill bit, a connector for connecting the drill bit to the pulsed power generator, and a transmitter for transmitting the drilling fluid to the bit, and a housing.

The present invention comprises a bottom hole assembly comprises at least one electrohydraulic projector installed on a side of the bottom hole assembly not in the direction of drilling. The present invention comprises a bottom hole assembly comprising at least one electrocrushing electrode set installed on a side of the bottom hole assembly not in the direction of drilling.

The present invention comprises a switch disposed in the bottom hole assembly for switching the power from the pulsed power generator from at least one of the bit electrode sets to the electrocrushing electrode set or electrohydraulic projector.

The present invention further comprises a valve in the bottom hole assembly for diverting at least a portion of the drilling fluid from the bit to the electrocrushing electrode set or electrohydraulic projector.

The present invention comprises a cable disposed inside the fluid pipe, with the fluid pipe comprising a rotatable drill pipe, and mechanical cutting teeth installed on the back side of the bottom hole assembly so the bottom hole assembly can be rotated to clean the rock from behind the bottom hole assembly.

The present invention comprises a method of drilling backwards out of a damaged or slumped or caved in well, the method utilizing at least one electrohydraulic projector installed on a side of the bottom hole assembly not in the direction of drilling. The present invention further comprises creating a pressure wave propagating backwards in the well, i.e. opposite the direction of drilling, to assist in cleaning the substrate particles out of a damaged or slumped or caved-in well, utilizing at least one electrohydraulic projector installed on a side of the bottom hole assembly not in the direction of drilling. The present invention comprises a method of drilling backwards out of a damaged or slumped or caved-in well utilizing at least one electrocrushing electrode set installed on a side of the bottom hole assembly not in the direction of drilling.

The present invention comprises a switch disposed in the bottom hole assembly for switching the power from the pulsed power generator from at least one of the bit electrode sets to the electrocrushing electrode set or electrohydraulic projector. The present invention further comprises a valve disposed in the bottom hole assembly to divert at least a portion of the drilling fluid from the bit to the electrocrushing electrode set or electrohydraulic projector.

The present invention comprises a method of creating a backwards flow of drilling fluid in the well (i.e. opposite to the direction of drilling) to assist in cleaning the substrate particles out of a damaged or slumped or caved-in well, further utilizing a valve in the bottom hole assembly to divert at least a portion of the drilling fluid from the bit to the back of the bottom hole assembly.

The present invention further comprises a method of balancing the fluid flow through the bit, around the bottom hole assembly and through the well, diverting at least a portion of the drilling fluid in the bottom hole assembly from the bit to the back of the bottom hole assembly during normal drilling operation. The present invention further comprises a method of cleaning the substrate out of a damaged or slumped or caved-in well and enabling the bottom hole assembly to drill backwards to the surface by further providing a mechanical cutter installed on the back side of a rotatable bottom hole assembly and drill string, and rotating the bottom hole assembly to clean the substrate from behind the bottom hole assembly.

The present invention comprises a method of utilizing at least one initial high voltage pulse to overcome the insulative properties of the substrate, followed by providing at least one high current pulse from a different source impedance from the initial pulse or pulses, thus providing sufficient energy to break the substrate.

The present invention comprises utilizing a pulse transformer for creating high voltage pulses and high current pulses. The present invention alternately comprises creating high voltage pulses and high current pulses by charging capacitors in parallel and adding them in series or a combination of parallel and series. The high voltage pulses and the high current pulses use electrical energy stored in either capacitors or inductors or a combination of capacitors and inductors.

The present invention comprises providing a pulsed power system comprising a pulsed power generator for providing at least one initial high voltage pulse to overcome the insulative properties of the substrate, comprising a spiker, followed by at least one high current pulse to provide the energy to break the substrate, comprising a sustainer.

The present invention comprises a spiker-sustainer pulsed power system comprising solid state switches, gas or liquid spark gaps, thyratrons, vacuum tubes, solid state optically triggered switches, and self-break switches. The spiker-sustainer pulsed power system comprises capacitive energy storage, inductive energy storage, or a combination of capacitive energy storage and inductive energy storage. The spiker-sustainer pulsed power system creates the high voltage pulse by a pulse transformer or by charging capacitors in parallel and adding them in series or a combination of capacitive energy storage and inductive energy storage.

The spiker-sustainer pulsed power system is located downhole in a bottom hole assembly, at the surface with the pulse sent over one or a plurality of cables, or in an intermediate section of the drill string. The cable is disposed inside a fluid conducting apparatus for conducting drilling fluid from the surface to the bottom hole assembly. The cable is alternately disposed outside a fluid conducting apparatus for conducting drilling fluid from the surface to the bottom hole assembly.

The preceding examples can be repeated with similar success by substituting the generically or specifically described compositions, biomaterials, devices and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above, and of the corresponding application(s), are hereby incorporated by reference.

As used in the specification and claims herein, the terms "a", "an", and "the" mean one or more.

An embodiment of the present invention provides a drill bit on which is disposed one or more sets of electrodes. In this embodiment, the electrodes are disposed so that a gap is formed between them and are disposed on the drill bit so that they are oriented along a face of the drill bit. In other words, the electrodes between which an electrical current passes through a mineral substrate (e.g., rock) are not on opposite sides of the rock. Also, in this embodiment, it is not necessary that all electrodes touch the mineral substrate as the current is being applied. In accordance with this embodiment, at least one of the electrodes extending from the bit toward the substrate to be fractured and may be compressible (i.e., retractable) into the drill bit by any means known in the art such as, for example, via a spring-loaded mechanism.

The preferred embodiment of the present invention (see FIGS. 48-50) comprises a drill bit with multiple electrode sets arranged at the tip of the drill stem, each electrode set being independently supplied with electric current to pass through the substrate. By varying the repetition rate of the high voltage pulses, the drill changes direction towards those electrode sets having the higher repetition rate. Thus the multi-electrode set drill stem is steered through the rock by the control system, independently varying the pulse repetition rate to the electrode sets.

To accomplish the control of the electrode sets independently, a multi-conductor power cable is used with each electrode set connected, either separately or in groups, to individual conductors in the cable. A switch is used at the pulse generator to alternately feed the pulses to the conductors and hence to the individual electrode sets according to the requirements set by the control system. Alternatively, a switch is placed in the drill stem to distribute pulses sent over a single-conductor power cable to individual electrode sets. Because the role of each electrode set is to excavate a small amount of rock, it is not necessary for the electrode sets to operate simultaneously. A change in direction is achieved by changing the net amount of rock excavated on one side of the bit compared to the other side.

To further enhance the transmittal of power from the pulse generator to the rock, individual capacitors are located inside the drill stem, each connected, individually or in groups, to the individual electrode sets. This enhances the peak current flow to the rock, and improves the power efficiency of the drilling process. The combination of capacitors and switches, or other pulse forming circuitry and components such as inductors, are located in the drill stem to further enhance the power flow into the rock.

Accordingly, an embodiment of the present invention provides a drill bit on which is disposed one or more sets of electrodes. In this embodiment, the electrodes are disposed so that a gap is formed between them and are disposed on the drill bit so that they are oriented along a face of the drill bit. In other words, the electrodes between which an electrical current passes through a mineral substrate (e.g., rock) are not on opposite sides of the rock. Also, in this embodiment, it is not necessary that all electrodes touch the mineral substrate as the current is being applied. In accordance with this embodiment, at least one of the electrodes extending from the bit toward the substrate to be fractured and may be compressible (i.e., retractable) into the drill bit by any means known in the art such as, for example, via a spring-loaded mechanism.

Generally, but not necessarily, the electrodes are disposed on the bit such that at least one electrode contacts the mineral substrate to be fractured and another electrode that usually touches the mineral substrate but otherwise may be close to, but not necessarily touching, the mineral substrate so long as it is in sufficient proximity for current to pass through the mineral substrate. Typically, the electrode that need not touch the substrate is the central, not the surrounding, electrode.

Therefore, the electrodes are disposed on a bit and arranged such that electrocrushing arcs are created in the rock. High voltage pulses are applied repetitively to the bit to create repetitive electrocrushing excavation events. Electrocrushing drilling can be accomplished, for example, with a flat-end cylindrical bit with one or more electrode sets. These electrodes can be arranged in a coaxial configuration.

Generally, but not necessarily, the electrodes are disposed on the bit such that at least one electrode contacts the mineral substrate to be fractured and another electrode that usually touches the mineral substrate but otherwise may be close to, but not necessarily touching, the mineral substrate so long as it is in sufficient proximity for current to pass through the mineral substrate. Typically, the electrode that need not touch the substrate is the central, not the surrounding, electrode.

Therefore, the electrodes are disposed on a bit and arranged such that electrocrushing arcs are created in the rock. High voltage pulses are applied repetitively to the bit to create repetitive electrocrushing excavation events. Electrocrushing drilling can be accomplished, for example, with a flat-end cylindrical bit with one or more electrode sets. These electrodes can be arranged in a coaxial configuration.

An embodiment of the present invention incorporating a drill bit as described herein thus provides a portable electrocrushing drill that utilizes an electrical plasma inside the rock to crush and fracture the rock. A portable drill stem is preferably mounted on a cable (preferably flexible) that connects to, or is integral with, a pulse generator which then connects to a power supply module. A separate drill holder and advance mechanism is preferably utilized to keep the drill pressed up against the rock to facilitate the drilling process. The stem itself is a hollow tube preferably incorporating the insulator, drilling fluid flush, and electrodes. Preferably, the drill stem is a hard tubular structure of metal or similar hard material that contains the actual plasma generation apparatus and provides current return for the electrical pulse. The stem comprises a set of electrodes at the operating end. Preferably, the drill stem includes a capacitor to enhance the current flow through the rock. These electrodes are typically circular in shape but may have a convoluted shape for preferential arc management. The center electrode is preferably compressible to maintain connection to the rock. The drill tip preferably incorporates replaceable electrodes, which are field replaceable units that can be, for example, unscrewed and replaced in the mine. Alternatively, the pulse generator and power supply module can be integrated into one unit. The electrical pulse is created in the pulse generator and then transmitted along the cable to the drill stem and preferably to the drill stem capacitor. The pulse creates an arc or plasma in the rock at the electrodes. Drilling fluid flow from inside the drill stem sweeps out the crushed material from the hole. The system is preferably sufficiently compact so that it can be manhandled inside underground mine tunnels.

When the drill is first starting into the rock, it is highly preferable to seal the surface of the rock in the vicinity of the starting point when drilling vertically. To accomplish this, a fluid containment or entrapment component provided to contain the drilling fluid around the head of the drill to insulate the electrodes. One illustrative embodiment of such a fluid containment component of the present invention comprises a boot made of a flexible material such as plastic or rubber. The drilling fluid flow coming up through the insulator and out the tip of the drill then fills the boot and provides the seal until the drill has progressed far enough into the rock to provide its own seal. The boot may either be attached to the tip of the drill with a sliding means so that the boot will slide down over the stem of the drill as the drill progresses into the rock or the boot may be attached to the guide tube of the drill holder so that the drill can progress into the rock and the boot remains attached to the launch tube.

The fluid used to insulate the electrodes preferably comprises a fluid that provides high dielectric strength to provide high electric fields at the electrodes, low conductivity to provide low leakage current during the delay time from application of the voltage until the arc ignites in the rock, and high relative permittivity to shift a higher proportion of the electric field into the rock near the electrodes. More preferably, the fluid comprises a high dielectric constant, low conductivity, and high dielectric strength. Still more preferably, the fluid comprises having an electrical conductivity less than $10^{-5}$ mho/cm and a dielectric constant greater than 6. The drilling fluid further comprises having a conductivity less than approximately $10^{-4}$ mho/cm and a dielectric constant greater than approximately 40 and including treated water.

The distance from the tip to the pulse generator represents inductance to the power flow, which impeded the rate of rise of the current is flowing from the pulse generator to the drill. To minimize the effects of this inductance, a capacitor is installed in the drill stem, to provide high current flow in to the rock plasma, to increase drilling efficiency.

The cable that carries drilling fluid and electrical power from the pulse generator to the drill stem is fragile. If a rock should fall on it or it should be run over by a piece of equipment, it would damage the electrical integrity, mash the drilling fluid line, and impair the performance of the drill. Therefore, this cable is preferably armored, but in a way that permits flexibility. Thus, for example, one embodiment comprises a flexible armored cable having a corrugated shape that is utilized as a means for advancing the drill into the hole when the drill hole depth exceeds that of the stem.

Preferably, a pulse power system that powers the bit provides repetitive high voltage pulses, usually over 30 kV. The pulsed power system can include, but is not limited to:

(1) a solid state switch controlled or gas-switch controlled pulse generating system with a pulse transformer that pulse charges the primary output capacitor;

(2) an array of solid-state switch or gas-switch controlled circuits that are charged in parallel and in series pulse-charge the output capacitor;

(3) a voltage vector inversion circuit that produces a pulse at about twice, or a multiple of, the charge voltage;

(4) An inductive store system that stores current in an inductor, then switches it to the electrodes via an opening or transfer switch; or (5) any other pulse generation circuit that provides repetitive high voltage, high current pulses to the drill bit.

The present invention substantially improves the production of holes in a mine. In an embodiment, the production drill could incorporate two drills operating out of one pulse generator box with a switch that connects either drill to the pulse generator. In such a scenario, one operator can operate two drills. The operator can be setting up one drill and positioning it while the other drill is in operation. At a drilling rate of 0.5 meter per minute, one operator can drill a one meter deep hole approximately every four minutes with such a set up. Because there is no requirement for two operators, this dramatically improves productivity and substantially reduces labor cost.

Figure 40:
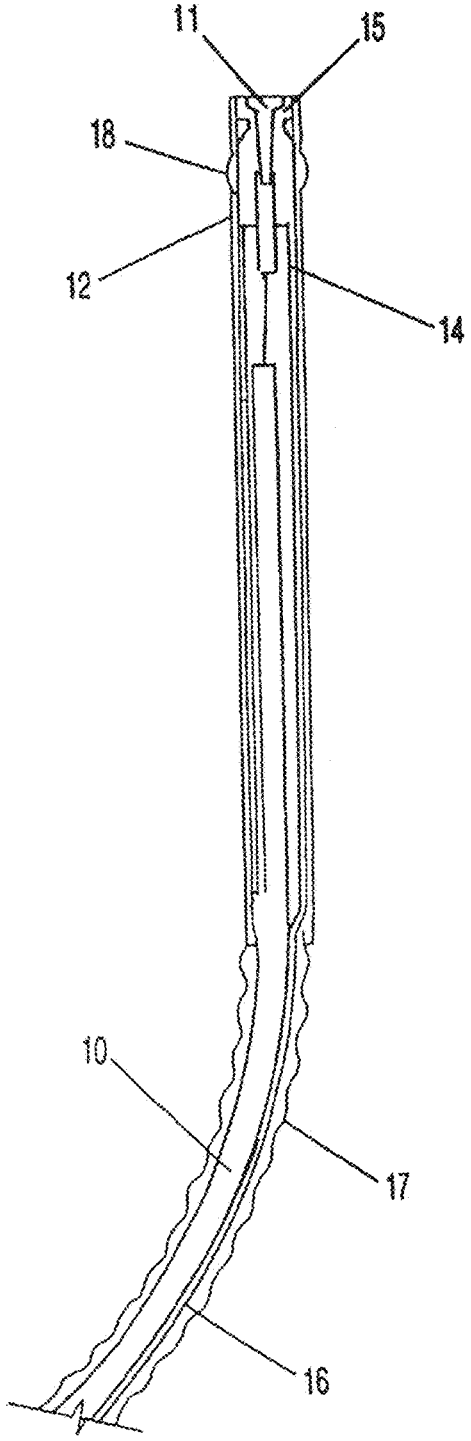
FIG. 40 is a close-up side cutaway view of an embodiment of the present invention showing a portable electrocrushing drill stem with a drill tip having replaceable electrodes.

Turning now to the figures, which describe non-limiting embodiments of the present invention that are illustrative of the various embodiments within the scope of the present invention, FIG. 40 shows the basic concept of the drilling stem of a portable electrocrushing mining drill for drilling in hard rock, concrete or other materials. Pulse cable 10 brings an electrical pulse produced by a pulse modulator (not shown in FIG. 40) to drill tip 11 which is enclosed in drill stem 12. The electrical current creates an electrical arc or plasma inside the rock between drill tip 11 and drill stem 12. Drill tip 11 is preferably compressible to maintain contact with the rock to facilitate creating the arc inside the rock. A drilling fluid delivery component such as, but not limited to, fluid delivery passage 14 in stem 12 feeds drilling fluid through electrode gap 15 to flush debris out of gap 15. Drilling fluid passages 14 or other fluid in stem 12 are fed by a drilling fluid line 16 embedded with pulse cable 10 inside armored jacket 17. Boot holder 18 is disposed on the end of drill stem 12 to hold the boot (shown in FIGS. 42A and 42B) during the starting of the drilling process. Boot 23 is used to capture drilling fluid flow coming through gap 15 and supplied by drilling fluid delivery passage 14 during the starting process. As the drill progresses into the rock or other material, boot 23 slides down stem 12 and down armored jacket 17.

Figure 41:
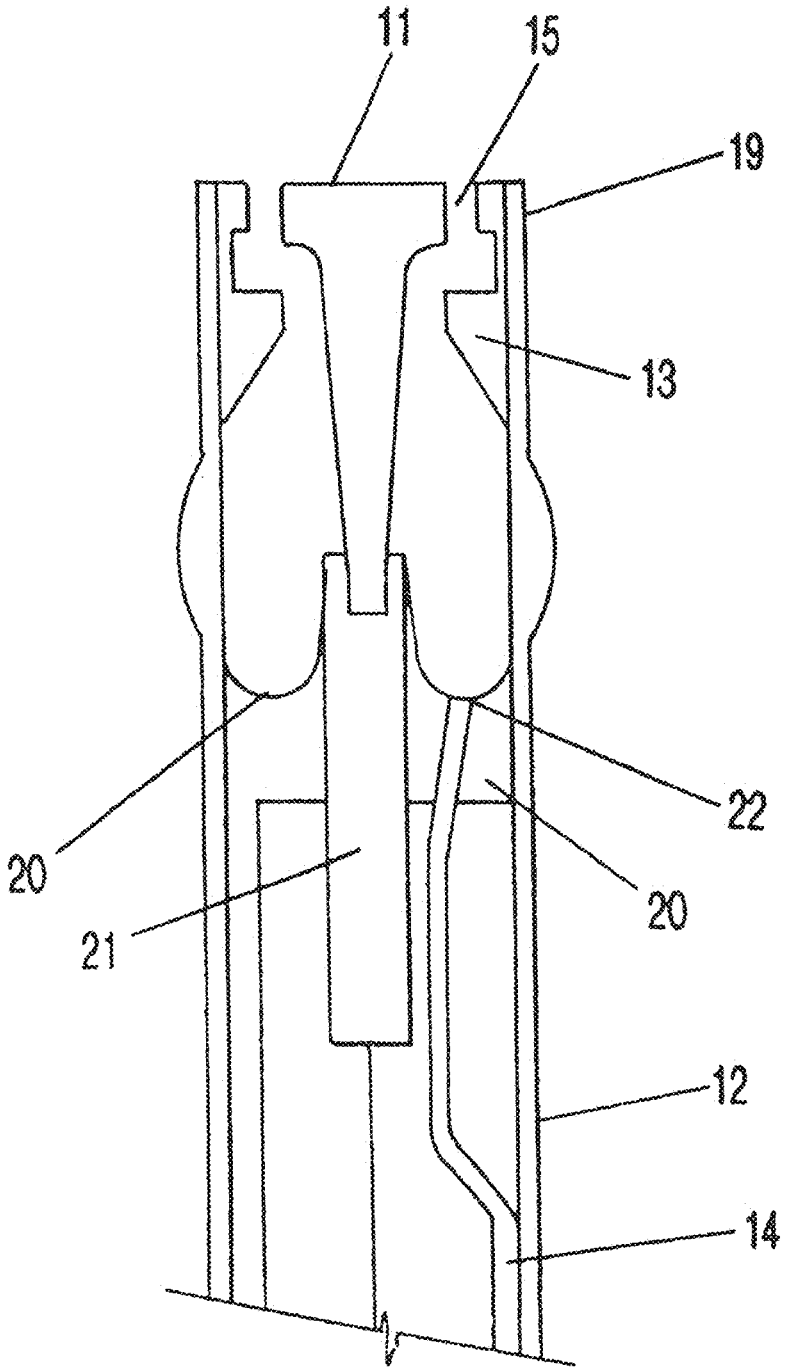
FIG. 41 is a close-up side cutaway view of the drill stem of FIG. 39 incorporating the insulator, drilling fluid flush, and electrodes.

FIG. 41 is a close-up view of tip 11 of portable electro-crushing drill stem 12, showing drill tip 11, discharge gap 15, and replaceable outer electrode 19. The electrical pulse is delivered to tip 11. The plasma then forms inside the rock between tip 11 and replaceable outer electrode 19. Insulator 20 has drilling fluid passages 22 built into insulator 20 to flush rock dust out of the base of insulator 20 and through gap 15. The drilling fluid is provided into insulator 20 section through drilling fluid delivery line 14.

Figure 42A:
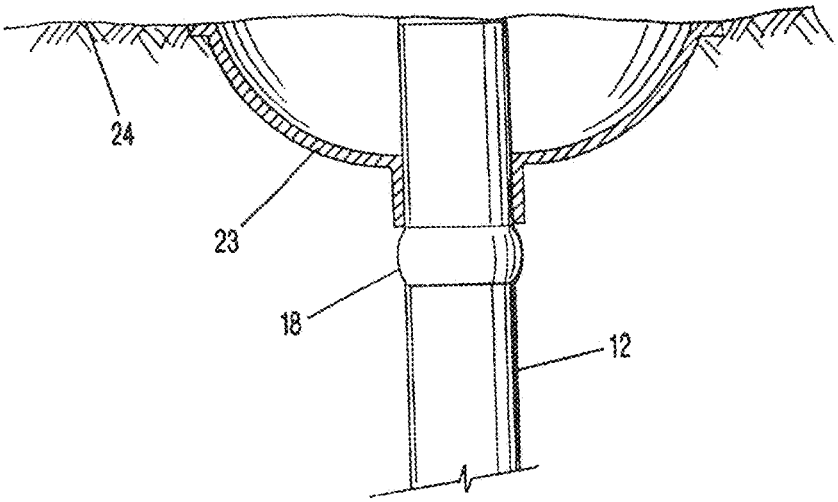
FIGS. 42A and 42B are side cutaway views of the preferred boot embodiment of the electrocrushing drill of the present invention.
Figure 42B:
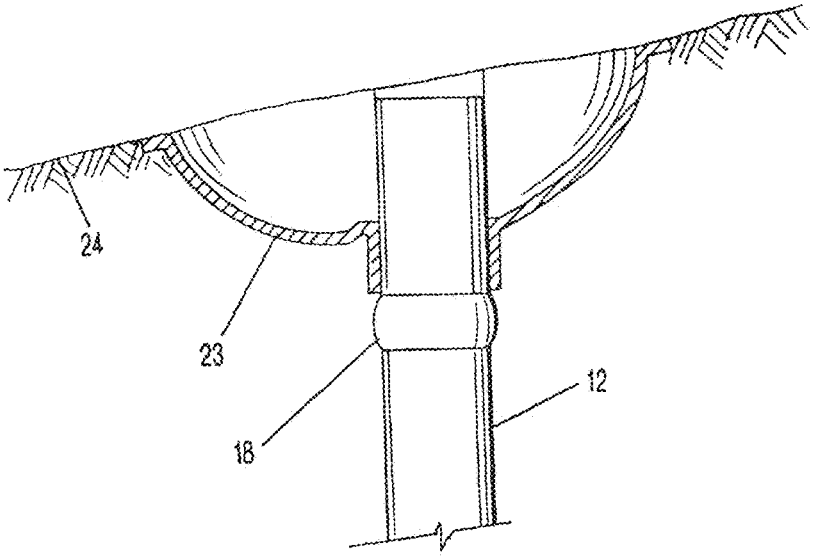

FIGS. 42A and 42B show drill stem 12 starting to drill into rock 24. Boot 23 is fitted around drill stem 12, held in place by boot holder 18. Boot 23 provides means of containing the drilling fluid near rock surface 24, even when drill stem 12 is not perpendicular to rock surface 24 or when rock surface 24 is rough and uneven. As drill stem 12 penetrates into rock 24, boot 23 slides down over boot holder 18.

Figure 43:
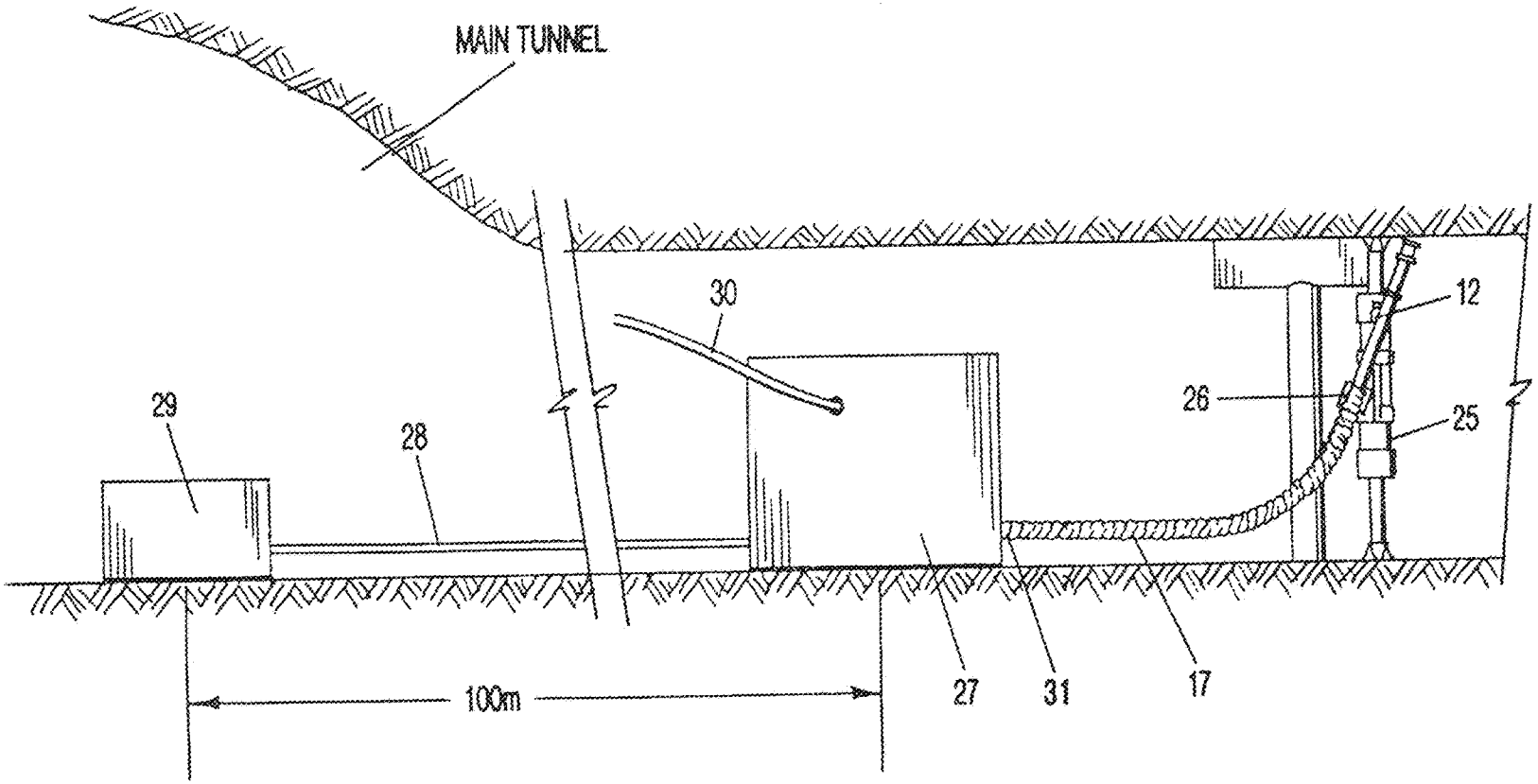
FIG. 43 is a side view of an alternative electrocrushing mining drill system of the present invention showing a version of the portable electrocrushing drill in a mine in use to drill holes in the roof for roofbolts.

FIG. 43 shows an embodiment of the portable electro-crushing mining drill utilizing drill stem 12 described in FIGS. 40, 41, 42A and 42B. Drill stem 12 is shown mounted on jackleg support 25, that supports drill stem 12 and advance mechanism 26. Armored cable 17 connects drill stem 12 to pulse generator 27. Pulse generator 27 is then connected in turn by power cable 28 to power supply 29. Armored cable 17 is typically a few meters long and connects drill stem 12 to pulse generator 27. Armored cable 17 provides adequate flexibility to enable drill stem 12 to be used in areas of low roof height. Power supply 29 can be placed some long distance from pulse generator 27. Drilling fluid inlet line 30 feeds drilling fluid to drilling fluid line 16 (not shown) contained inside armored cable 17. A pressure switch (not shown) may be installed in drilling fluid line 16 to ensure that the drill does not operate without drilling fluid flow.

Figure 44:
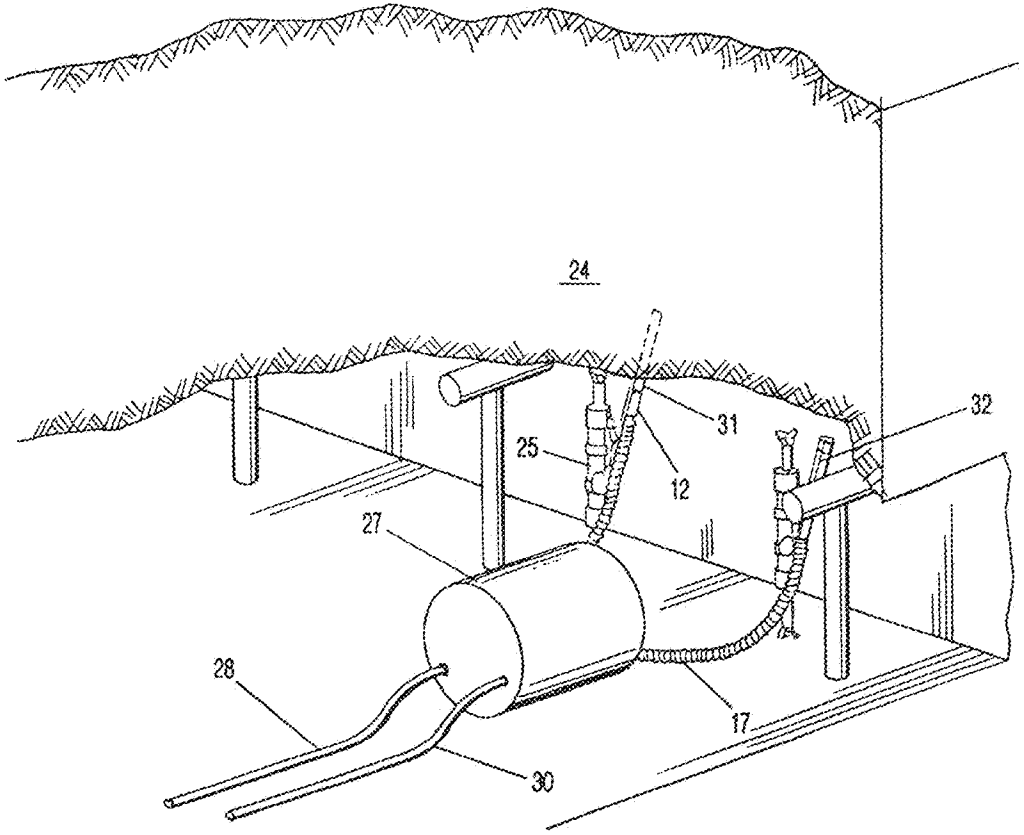
FIG. 44 is a side view of an alternative electrocrushing mining drill system of the present invention showing a version of the portable electrocrushing drill to drill holes in the roof for roofbolts and comprising two drills capable of non-simultaneous or simultaneous operation from a single pulse generator box.

FIG. 44 shows an embodiment of the subject invention with two drills being operated off single pulse generator 27. This figure shows drill stem 12 of operating drill 31 having progressed some distance into rock 24. Jack leg support 25 provides support for drill stem 12 and provides guidance for drill stem 12 to propagate into rock 24. Pulse generator 27 is shown connected to both drill stems 12. Drill 32 being set up is shown in position, ready to start drilling with its jack leg 25 in place against the roof. Power cable 28, from power supply 29 (not shown in FIG. 44) brings power to pulse generator 27. Drilling fluid feed line 30 is shown bringing drilling fluid into pulse generator 27 where it then connects with drilling fluid line 16 contained in armored cable 17. In this embodiment, while one drill is drilling a hole and being powered by the pulse generator, the second drill is being set up. Thus one man can accomplish the work of two men with this invention.

Figure 45:
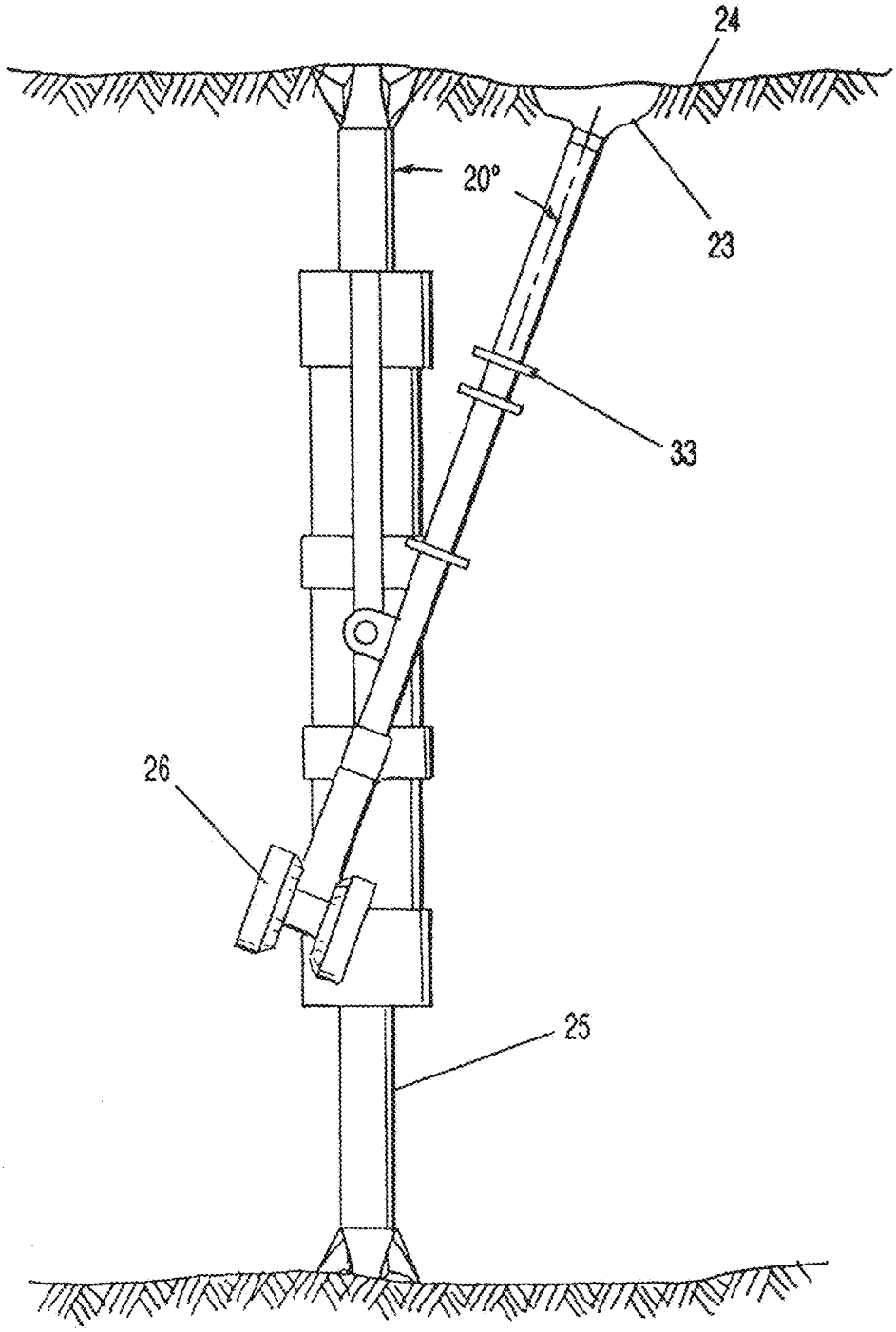
FIG. 45 is a view of the embodiment of FIG. 40 showing the portable electrocrushing drill support and advance mechanism.

FIG. 45 shows jack leg support 25 supporting guide structure 33 which guides drill 12 into rock 24. Cradle or tube guide structure 33 holds drill stem 12 and guides it into the drill hole. Guide structure 33 can be tilted at the appropriate angle to provide for the correct angle of the hole in rock 24. Fixed boot 23 can be attached to the end of guide tube 33 as shown in FIG. 45. Advance mechanism 26 grips the serrations on armored cable 17 to provide thrust to maintain drill tip 11 in contact with rock 24. Note that advance mechanism 26 does not do the drilling. It is the plasma inside the rock that actually does the drilling. Rather, advance mechanisms 26 keeps drill tip 15 and outer electrode 19 in close proximity to rock 24 for efficient drilling. In this embodiment, boot 23 is attached to the uppermost guide loop rather than to drill 12. In this embodiment, drill 12 does not utilize boot holder 18, but rather progresses smoothly through boot 23 into rock 24 guided by the guide loops that direct drill 12.

Figure 46:
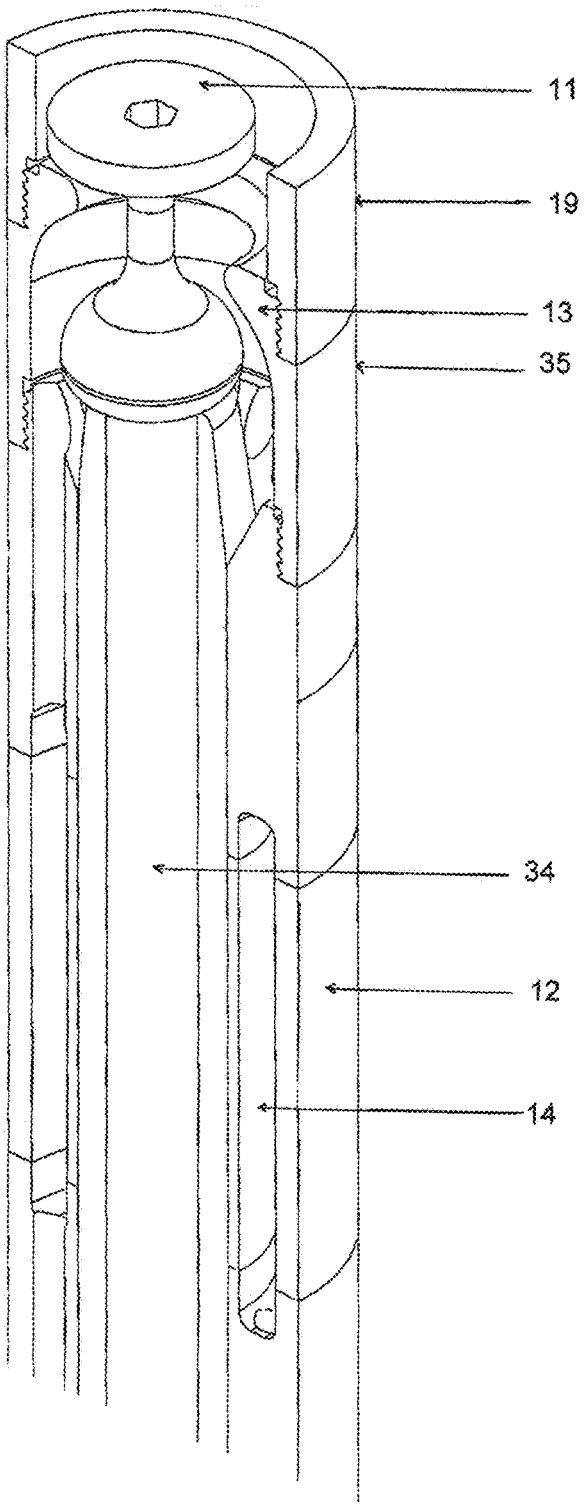
FIG. 46 is a close-up side cut-way view of an alternate embodiment of the drill stem.

FIG. 46 shows a further embodiment wherein the drilling fluid line is built into drill stem 12. Energy is stored in capacitor 13, which is delivered to tip 11 by conductor 34 when the electric field inside the rock breaks down the rock, creating a path for current conduction inside the rock. The low inductance created by the location of the capacitor in the stem dramatically increases the efficiency of transfer of energy into the rock. The capacitor is pulse charged by the pulse generator 27. Center conductor 34 is surrounded by capacitor 13, which then is nested inside drill stem 12 which incorporates drilling fluid passage 14 inside the stem wall. In this embodiment, drill tip 11 is easily replaceable and outer conductor 19 is easily replaceable. An alternative approach is to use slip-in electrodes 19 that are pinned in place. This is a very important feature of the subject invention because it enables the drill to be operated extensively in the mine environment with the high electrode erosion that is typical of high energy, high power operation.

Figure 47A:
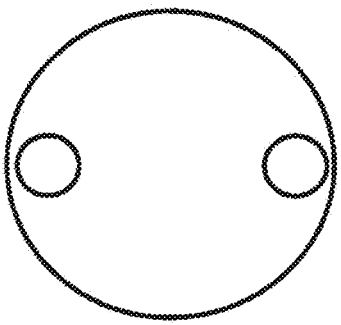
FIG. 47A shows an electrode configuration with circular shaped electrodes.
Figure 47B:
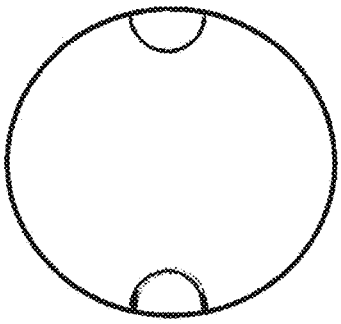
FIG. 47B shows another electrode configuration with circular shaped electrodes.
Figure 47C:
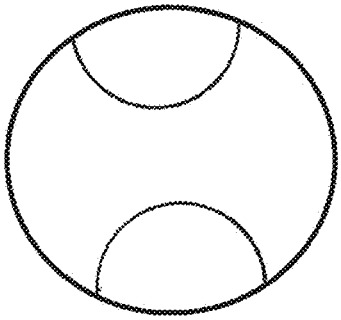
FIG. 47C shows another electrode configuration with circular shaped electrodes.
Figure 47D:
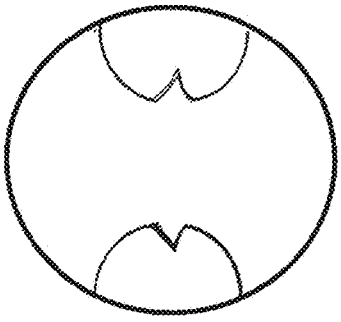
FIG. 47D shows a combination of circular and convoluted electrodes.
Figure 47E:
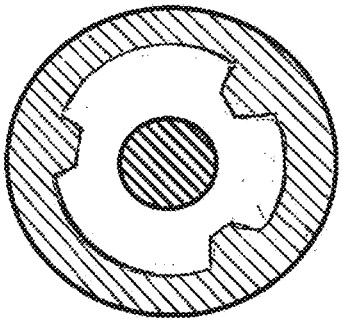
FIG. 47E shows convoluted shaped electrodes.

FIGS. 47A-47D show different, though not limiting, embodiments of the electrode configurations useable in the present invention. FIGS. 47A, 47B, and 47C show circular electrodes, FIG. 47E shows convoluted shape electrodes (the outer electrodes are convoluted), and FIG. 47D shows a combination thereof. FIG. 46 shows a coaxial electrode configuration. For longer holes or for holes with a curved trajectory, the multi-electrode set drill tip is used.

Figure 48:
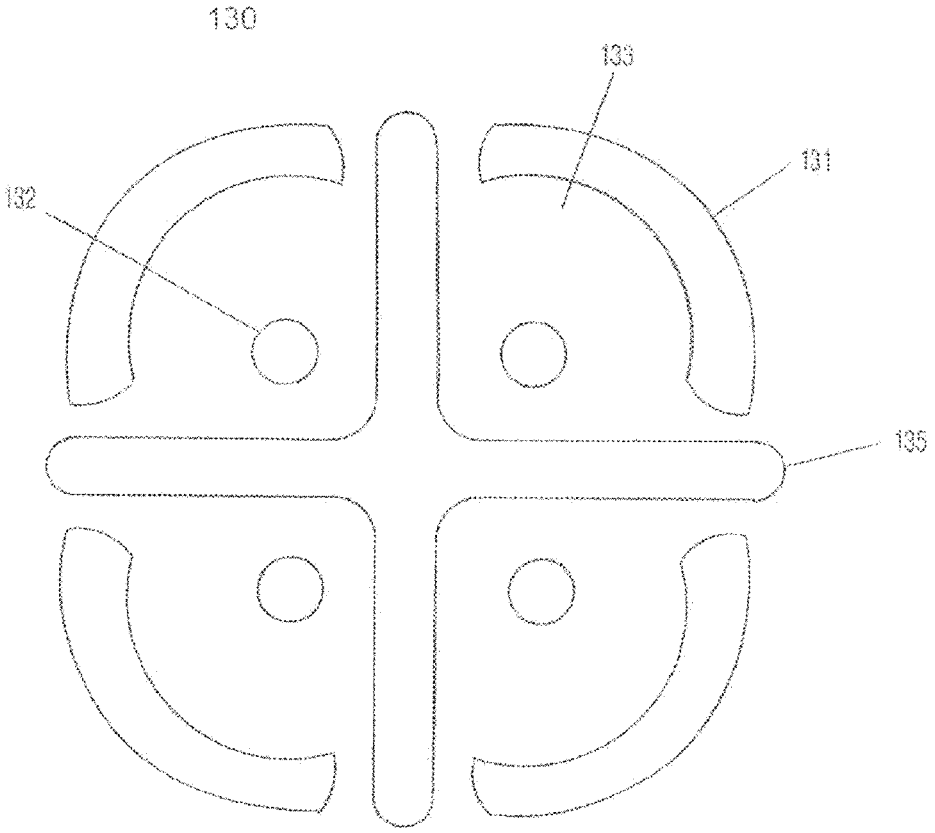
FIG. 48 shows a multi-electrode set drill tip for directional drilling.
Figure 49:
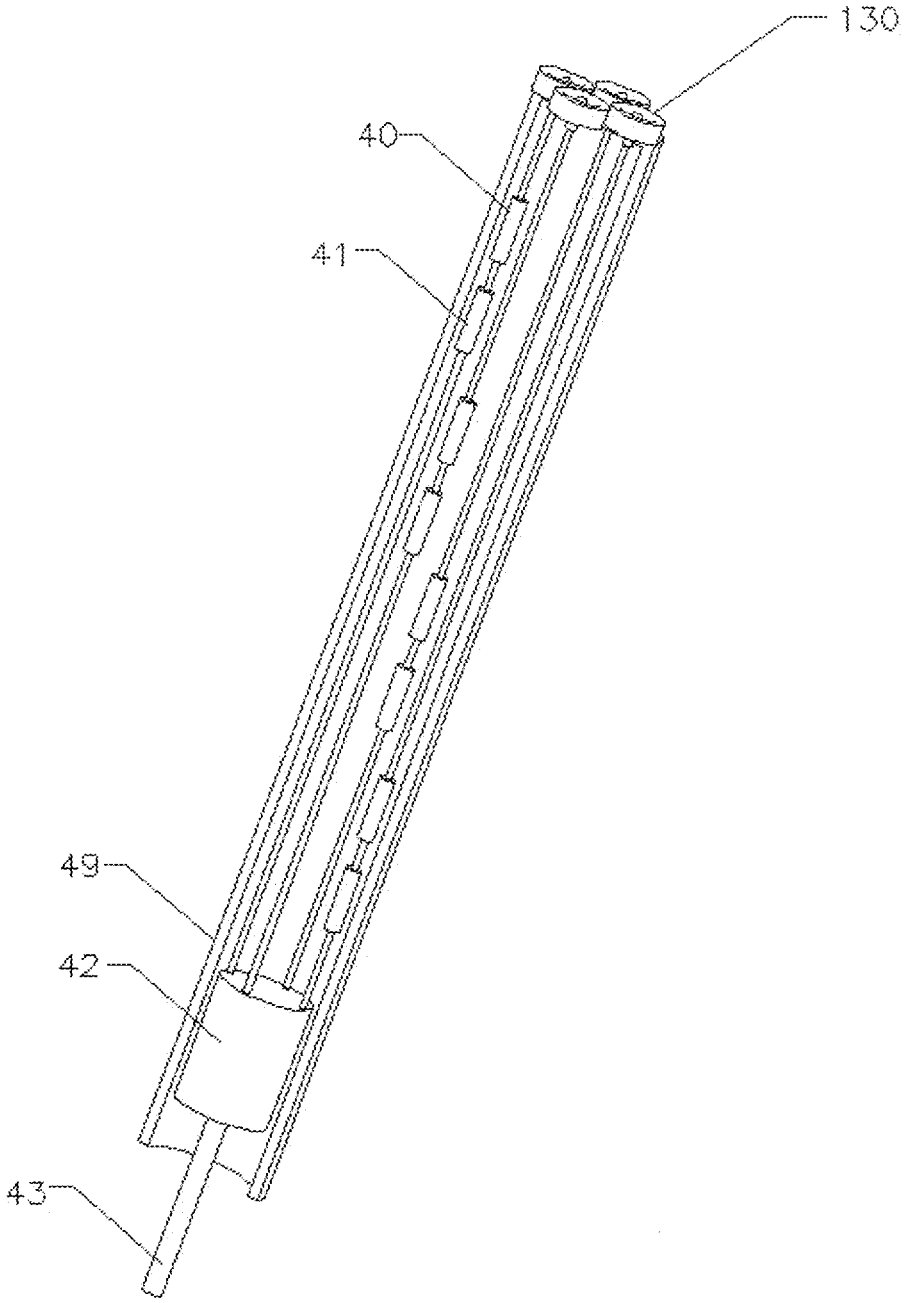
FIG. 49 shows a multi-electrode set drill showing internal circuit components and a flexible cable.
Figure 50:
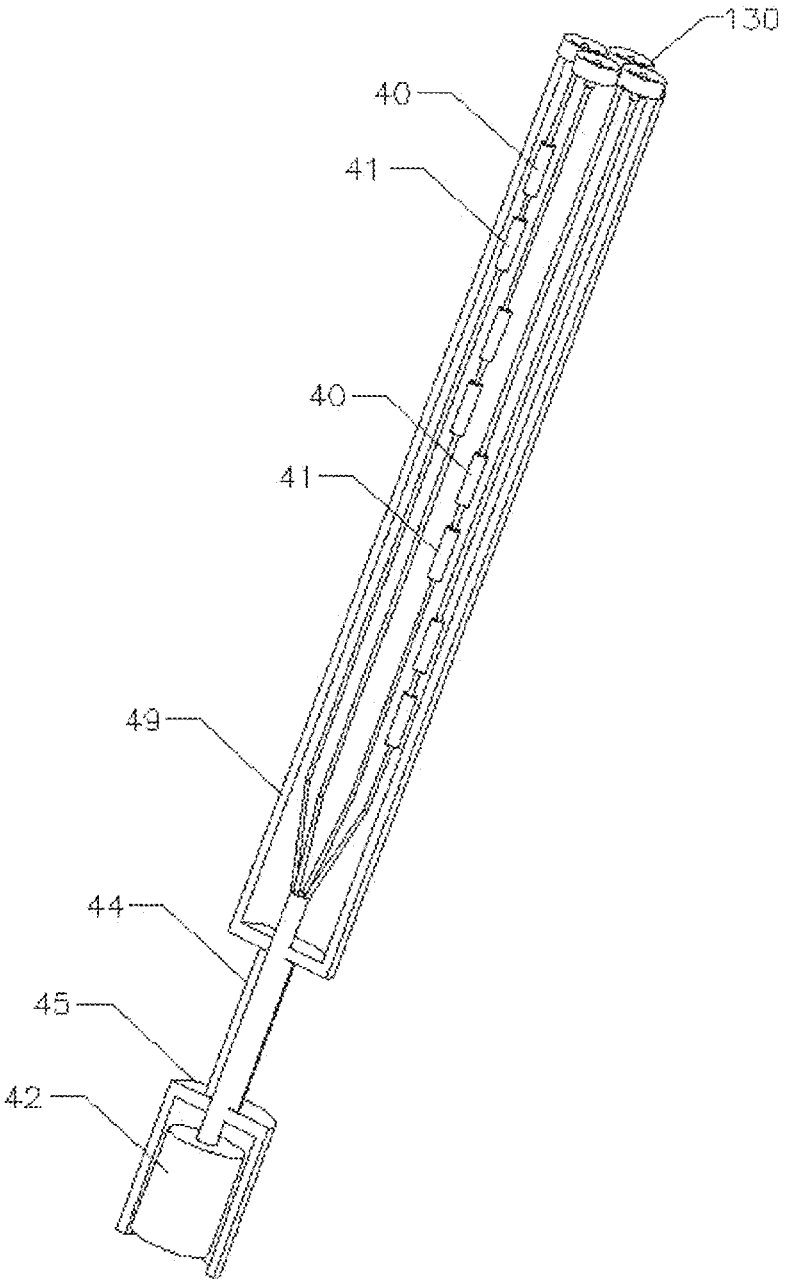
FIG. 50 shows a multi-electrode set drill showing internal circuit components, a flexible cable, and a pulse generator.

FIG. 48 shows an embodiment of multi-electrode set drill tip 130 for directional drilling, showing high-voltage electrodes 132, inter-electrode insulator 133, and ground return electrodes 131 and 135. FIG. 49 shows the multi-electrode set embodiment of the drill showing a plurality of electrode sets 130, mounted on the tip of drill stem 49, capacitors 40, inductors 41, and switch 42 to connect each of the electrode sets to flexible cable 43 from the pulse generator (not shown). FIG. 50 shows multi-conductor cable 44 connecting electrode sets 130 and capacitors 40 and inductors 41 to diverter switch 42 located in pulse generator assembly 45.

The operation of the drill is preferably as follows. The pulse generator is set into a location from which to drill a number of holes. The operator sets up a jack leg and installs the drill in the cradle with the advance mechanism engaging the armored jacket and the boot installed on the tip. The drill is started in its hole at the correct angle by the cradle on the jack leg. The boot has an offset in order to accommodate the angle of the drill to the rock. Once the drill is positioned, the operator goes to the control panel, selects the drill stem to use and pushes the start button which turns on drilling fluid flow. The drill control system first senses to make sure there is adequate drilling fluid pressure in the drill. If the drill is not pressed up against the rock, then there will not be adequate drilling fluid pressure surrounding the drill tips and the drill will not fire. This prevents the operator from engaging the wrong drill and also prevents the drill from firing in the open air when drilling fluid is not surrounding the drill tip. The drill then starts firing at a repetition rate of several hertz to hundreds of hertz. Upon a fire command from the control system, the primary switch connects the capacitors, which have been already charged by the power supply, to the cable. The electrical pulse is then transmitted down the cable to the stem where it pulse charges the stem capacitor. The resulting electric field causes the rock to break down and causes current to flow through the rock from electrode to electrode. This flowing current creates a plasma which fractures the rock. The drilling fluid that is flowing up from the drill stem then sweeps the pieces of crushed rock out of the hole. The drilling fluid flows in a swirl motion out of the insulator and sweeps up any particles of rock that might have drifted down inside the drill stem and flushes them out the top. When the drill is first starting, the rock particles are forced out under the lip of the boot. When the drill is well into the rock then the rock particles are forced out along the side between the drill and the rock hole. The drill maintains its direction because of its length. The drill should maintain adequate directional control for approximately 4-8 times its length depending on the precision of the hole.

While the first drill is drilling, the operator then sets up the other jack-leg and positions the second drill. Once the first drill has completed drilling, the operator then selects the second drill and starts it drilling. While the second drill is drilling, the operator moves the first drill to a new location and sets it up to be ready to drill. After several holes have been drilled, the operator will move the pulse generator box to a new location and resume drilling.

The following further summarizes features of the operation of the system of the present invention. An electrical pulse is transmitted down a conductor to a set of removable electrodes where an arc or plasma is created inside the rock between the electrodes. Drilling fluid flow passes between the electrodes to flush out particles and maintain cleanliness inside the drilling fluid cavity in the region of the drilling tip. By making the drill tips easily replaceable, for example, thread-on units, they can be easily replaced in the mine environment to compensate for wear in the electrode gap. The embedded drilling fluid channels provide drilling fluid flow through the drill stem to the drill tip where the drilling fluid flushes out the rock dust and chips to keep from clogging the interior of the drill stem with chips and keep from shorting the electrical pulse inside the drill stem near the base of the drill tip.

Mine water is drawn into the pulse generator and is used to cool key components through a heat exchanger. Drilling fluid is used to flush the crushed rock out of the hole and maintain drilling fluid around the drill tip or head. The pulse generator box is hermetically sealed with all of the high voltage switches and cable connections inside the box. The box is pressurized with a gas or filled with a fluid or encapsulated to insulate it. Because the pulse generator is completely sealed, there is no potential of exposing the mine atmosphere to a spark from it. The drill will not operate and power will not be sent to the drill stem unless the drilling fluid pressure inside the stem is high enough to ensure that the drill tip is completely flooded with drilling fluid. This will prevent a spark from occurring in air at the drill tip. These two features should prevent any possibility of an open spark in the mine.

There is significant inductance in the circuit between the pulse generator and the drill stem. This is unavoidable because the drill stem must be positioned some distance away from the pulse generator. Normally, such an inductance would create a significant inefficiency in transferring the electrical energy to the plasma. Because of the inductance, it is difficult to match the equivalent source impedance to the plasma impedance. The stem capacitor greatly alleviates this problem and significantly increases system efficiency by reducing inductance of the current flow to the rock.

By utilizing multiple drills from a single pulse generator, the system is able to increase productivity and reduce manpower cost. The adjustable guide loops on the jack leg enable the drill to feed into the roof at an angle to accommodate the rock stress management and layer orientation in a particular mine.

The embodiment of the portable electrocrushing mining drill as shown in FIG. 5, can be utilized to drill holes in the roof of a mine for the insertion of roof bolts to support the roof and prevent injury to the miners. In such an application, one miner can operate the drill, drilling two holes at a rate much faster than a miner could drill one hole with conventional equipment. The miner sets the angle of the jack leg and orients the drill to the roof, feeds the drill stem up through the guide loops and through the boot to the rock with the armored cable engaged in the advance mechanism. The miner then steps back out of the danger zone near the front mining face and starts the drill in operation. The drill advances itself into the roof by the advance mechanisms with the cuttings, or fines, washed out of the hole by the drilling fluid flow. During this drilling process, the miner then sets up the second drill and orients it to the roof, feeds the drill stem through the boot and the guide loops so that when the first drill is completed, he can then switch the pulse generator over to the second drill and start drilling the second hole.

The same drill can obviously be used for drilling horizontally, or downward. In a different industrial application, the miner can use the same or similar dual drill set-up to drill horizontal holes into the mine face for inserting explosives to blow the face for recovering the ore. The embodiment of drilling into the roof is shown for illustration purposes and is not intended as a limitation.

The application of this drill to subsurface drilling is shown for illustration purposes only. The drill can obviously be used on the surface to drill shallow holes in the ground or in boulders.

In another embodiment, the pulse generator can operate a plurality of drill stems simultaneously. The operation of two drill stems is shown for illustration purposes only and is not intended to be a limitation.

Another industrial application is the use of the present invention to drill inspection or anchoring holes in concrete structures for anchoring mechanisms or steel structural materials to a concrete structure. Alternatively, such holes drill in concrete structures can also be used for blasting the structure for removing obsolete concrete structures.

It is understood from the description of the present invention that the application of the portable electrocrushing mining drill of present invention to various applications and settings not described herein are within the scope of the invention. Such applications include those requiring the drilling of small holes in hard materials such as rock or concrete.

Thus, a short drill stem length provides the capability of drilling deep holes in the roof of a confined mine space. A flexible cable enables the propagation of the drill into the roof to a depth greater than the floor to roof height. The electrocrushing process enables high efficiency transfer of energy from electrical storage to plasma inside the rock, thus resulting in high overall system efficiency and high drilling rate.

The invention is further illustrated by the following non-limiting example.

Example 3

The length of the drill stem was fifty cm, with a 5.5 meter long cable connecting it to the pulse modulator to allow operation in a one meter roof height. The drill was designed to go three meters into the roof with a hole diameter of approximately four cm. The drilling rate was approximately 0.5 meters per minute, at approximately seven to ten holes per hour.

The drill system had two drills capable of operation from a single pulse generator. The drill stem was mounted on a holder that located the drill relative to the roof, maintained the desired drill angle, and provided advance of the drill into the roof so that the operator was not required to hold the drill during the drilling operation. This reduced the operator's exposure to the unstable portion of the mine. While one drill was drilling, the other was being set up, so that one man was able to safely operate both drills. Both drills connected to the pulse generator at a distance of a few meters. The pulse modulator connected to the power supply which was located one hundred meters or more away from the pulse generator. The power supply connected to the mine power.

The pulse generator was approximately sixty cm long by sixty cm in diameter, not including roll cage support and protection handles. Mine drilling fluid was used to cool key components through a heat exchanger. Drilling fluid was used to flush out the cuttings and maintain drilling fluid around the drill head. The pulse generator box was hermetically sealed with all of the high voltage switches and cable connections inside the box. The box was pressurized with an inert gas to insulate it. Because the pulse generator was completely sealed, there was no potential of spark from it.

The drill would not operate and power would not be sent to the drill unless the drilling fluid pressure inside the stem was high enough to ensure that the drill tip was completely flooded with drilling fluid. This prevented a spark from occurring erroneously at the drill tip. The boot was a stiff rubber piece that fit snugly on the top of the drill support and was used to contain the drilling fluid for initially starting the drilling process. Once the drill started to penetrate into the rock, the boot slipped over the boot holder bulge and slid on down the shaft. The armored cable was of the same diameter or slightly smaller than the drill stem, and hence the boot slid down the armored cable as the drill moved up into the drill hole.

Command Charge System for Electrocrushing Drilling of Rock

Figure 51:
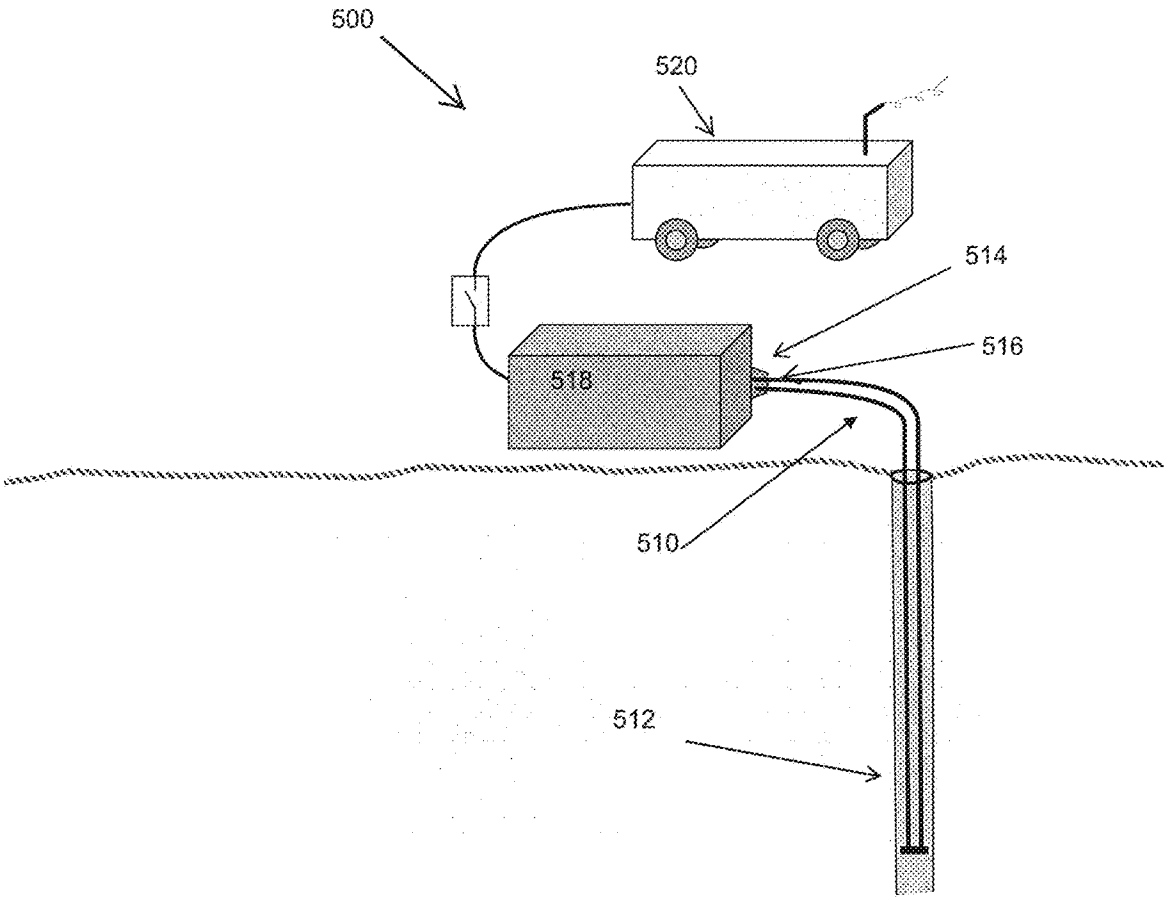
FIG. 51 shows a command charge system for electrocrushing drilling of rock.

Referring to FIG. 51, one embodiment of the present invention comprises command charge system 500 for electrocrushing drilling of rock. Command charge system 500 comprises cable 510, which preferably provides power from the surface to the pulsed power system (not shown) located in bottom hole assembly 512, where the pulsed power system produces high voltage pulses used for electrocrushing drilling. The pulsed power system of this embodiment of the present invention preferably comprises a drill bit (not shown), generator 520 linked to the drill bit via cable 510 for delivering high voltage pulses down-hole and at least one set of at least two electrodes disposed on, near or in the drill bit defining therebetween at least one electrode gap. The drill bit preferably does not rotate. The capacitors and switches of the pulsed power system are preferably located in bottom hole assembly 512 close to the nonrotational drill bit.

Figure 53:
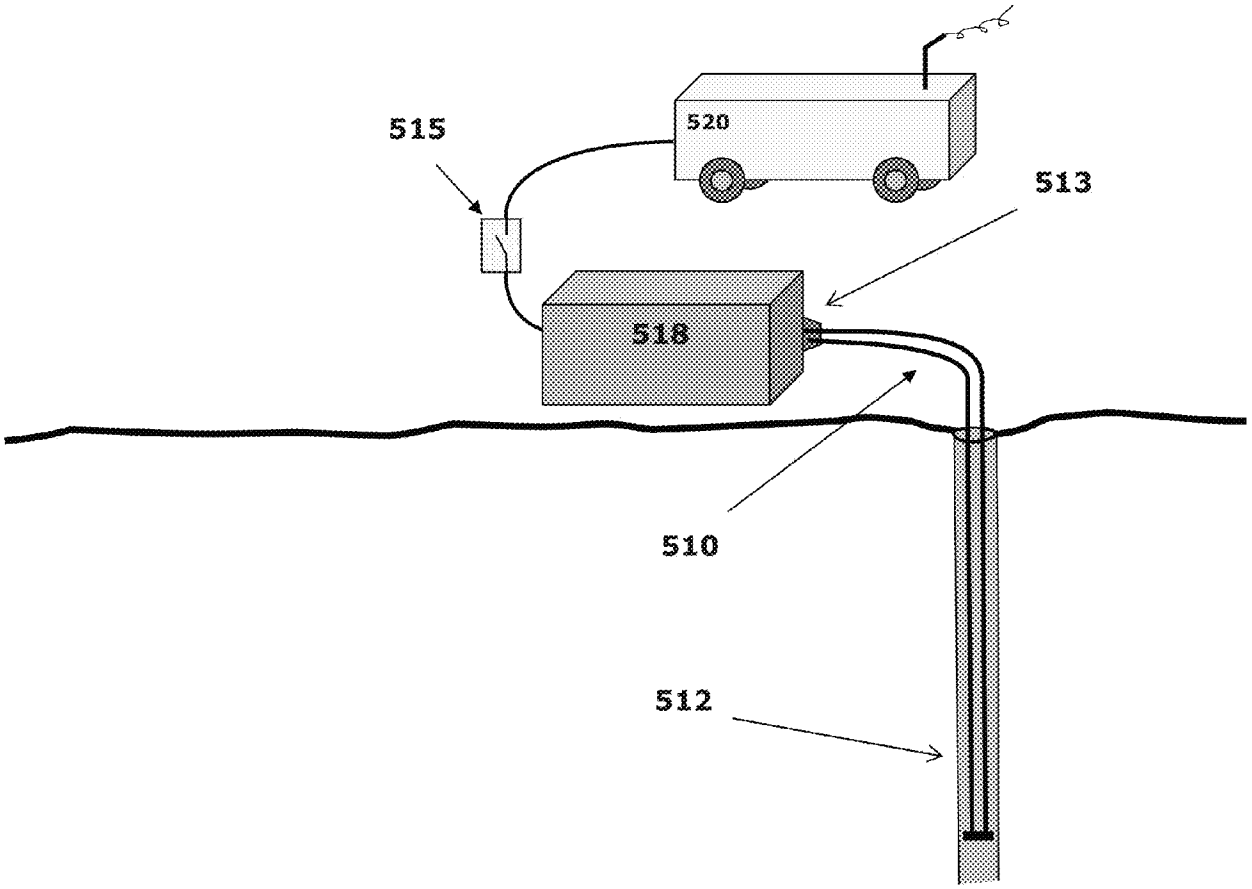
FIG. 53 shows a pulsed power system comprising a breaker and diode place in series with a cable in order to stop cable oscillations.

In order to precisely control the timing of the firing electrodes by the pulsed power system, and to minimize the dwell time of high voltage on the pulsed power system, command charge switch 514 is located between end 516 of cable 510 and prime power system 518 at the surface of the ground. Command charge switch 514, as illustrated in FIG. 51, is preferably fired on command and serves to control when the power produced by prime power system 518 is fed into cable 510 and hence into the pulsed power system in bottom hole assembly 512. Prime power system 518 preferably takes power from the grid or from generator 520 and transforms that power to produce a power suitable for injection to cable 510. Preferably, prime power system 518 produces medium voltage DC power that is used to charge a set of capacitors in prime power system 518. Command charge switch 514 then controls when that voltage on the prime power capacitors is switched on to cable 510, and hence is transmitted to the pulsed power system located in bottom hole assembly 512. In one embodiment of the present invention, the use of command charge switch 514 provides the ability to control the duration of charge voltage on the pulsed power system in bottom hole assembly 512. It also preferably provides the ability to control the voltage waveform on cable 510. In addition, the prime power system incorporates a cable oscillation damping function, such as a diode and resistor set (not shown), to dampen cable oscillations created by the operation of the bottom hole assembly. The command charge system is equally applicable to downhole configurations where composite pipe with embedded conductors is utilized to transmit power to the bottom hole assembly, instead of a cable. Referring to FIG. 53, in one embodiment of the present invention, diode 513 is placed in series with cable 510 to stop cable oscillations. Breaker 515 is also included in this embodiment of the present invention.

Composite Pipe for Pulsed Power System

One of the challenges with utilizing a pulsed power system encased in a bottom hole assembly to drill wells utilizing an electrocrushing process is transmitting electrical power to the bottom hole assembly. Conventional technology typically utilizes a cable running alongside the drill pipe or running inside the drill pipe to transmit electrical power to the bottom hole assembly. However, utilizing the cable alongside the drill pipe creates a cable management problem with the cable potentially getting pinched between the drill pipe and the wall of the hole. There is also the problem of ensuring that the cable is spooled out at the same rate that drill pipe is added to the hole, and the stretch of the cable must also be accounted for to make sure the cable does not get bunched up at the bottom of the hole. If the cable is running inside the drill pipe, then it must be broken into sections to accommodate screwing on different sections of drill pipe. Each connection between the sections of the cable is a potential problem area for failure of the connection, or failure of insulation in the connection. Embodiments of the present invention comprise an apparatus and method for transmitting power to the bottom hole assembly without a cable, thereby eliminating any cable management issues associated with conventional technology. An embodiment of the present invention comprises a method for conducting electrical power and communications signals from a surface to a downhole device.

Figure 52:
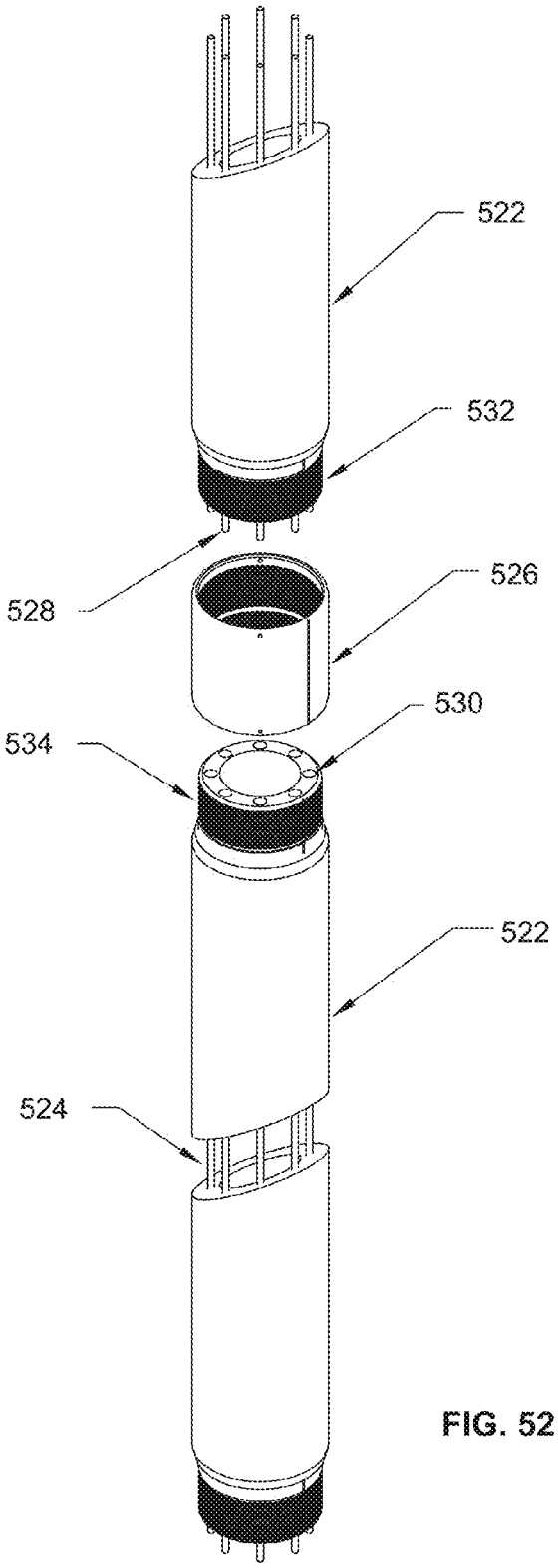
FIG. 52 shows a section of dielectric pipe having embedded conductors.

An embodiment of the present invention combines the functions of transmitting power to the bottom hole assembly and conducting drilling fluid to the bottom hole assembly. Referring to FIG. 52, this embodiment comprises drill pipe 522 having conductors 524 embedded in the wall of drill pipe 522. There are preferably two types of conductors, a high voltage conductor for carrying high voltage power to the bottom hole assembly for drilling operation and a low voltage conductor for carrying command and control signals down to the bottom hole assembly and for returning instrumentation signals to the surface. The signals preferably include, but are not limited to, pulsed power performance and operation instrumentation signals, thermal management instrumentation signals, and/or geophysical instrumentation signals. Drill pipe 522 of this embodiment is preferably made of a dielectric material, which serves as an insulation medium. Conductors 524 preferably have insulation disposed around them and are then preferably embedded in the dielectric material of drill pipe 522 to provide further insulation. The dielectric material also provides structural integrity for the drill pipe, provides containment for the pressure of the drilling fluid and also provides mechanical integrity to maintain functionality in the harsh drilling environment.

Embodiments of the present invention comprise embedding wires in the body of a pipe, preferably a non-conductive drill pipe, to conduct electric current and collect data from a top-hole environment to a down-hole bottom hole assembly. The high voltage wires preferably carry current at a voltage of at least about 1 kV. The pipe preferably does not carry mechanical high torque loads. The pipe sections preferably use connectors that do not require the pipe to rotate on assembly, more preferably non-rotating stab-type or buckle-type connectors, and most preferably turnbuckle connectors to enable alignment of electrical connectors 528 and 530 to each other. Turnbuckle connectors utilize right-hand thread 532 on drill pipe 522 that mates with the right-hand thread portion of drill pipe turnbuckle connector 526. Drill pipe connector 526 also has left-hand screw threads that mate with left-hand screw threads 534 on the other section of drill pipe 522. This enables drill pipe sections 522 to be connected without relative rotation, providing for alignment of electrical connectors 528 and 530. The high voltage electrical connectors also provide for the conduction of current at least 1 amp average current. The drill pipe assembly of this embodiment also comprises a provision for wires for carrying low-voltage data signals to collect various data from down-hole. Types of collected data can include but is not limited to operational voltage and current of components of the pulsed power system, data as to the geophysical location of the bottom hole assembly, other geophysical instrumentation data such as pressure and temperature of the downhole environment, and bottom hole assembly thermal management data. The drill pipe assembly of this embodiment also comprises a provision for wires for carrying low-voltage power to operate the instrumentation, control, cooling, and switch functions in the bottom hole assembly. The low-voltage data signal wires and low-voltage power wires are preferably isolated from the high voltage wires. The low voltage wires operate in a voltage of about 1 to 500 V or more.

The connectors for the high voltage power wires preferably provide long lifetimes for many connect-disconnect cycles while providing a long lifetime conducting high current. The high voltage connectors are sufficiently separated from each other in the drill pipe construction to provide adequate voltage isolation at the interface between pipe sections. The pipe wall is preferably of sufficient thickness and of appropriate dielectric materials to provide adequate dielectric insulation between high voltage lines. Thicknesses can range from about 0.1 inches to about 1.0 inches or more. Dielectric materials can include but are not limited to fiberglass, polyurethane, PEEK, and carbon fiber composite.

In one embodiment of the present invention, the bit of the bottom hole assembly does not rotate, in other words, it is nonrotational. In this embodiment, the drill pipe does not have to transmit torque to the bottom hole assembly. This simplifies the drill pipe and the electrical connections. The drill pipe sections of this embodiment preferably connect with a stab-type or buckle-type or click-type connection or most preferably a turnbuckle connection so the drill pipe sections do not have to rotate relative to each other during connection. The electrical connections can then easily be aligned during pipe section connection. The nonrotating connection greatly simplifies the design of the high voltage connections, enabling high voltage insulation integrity to be maintained with the pipe connected. The stab-type connection is not required to be sufficiently robust to support rotational torque, because the pipe does not rotate.

Referring to FIG. 52, one embodiment of the present invention comprises drill pipe 522 having embedded conductors or wires 524, turnbuckle drill pipe connector 526, male electrical contacts 528, and female electrical contacts 530. Male electrical contacts 528 preferably mate with female electrical contacts 530. Drill pipe section 522 preferably comprises right-hand threads 532 that mate with the right-hand threads of the turnbuckle connector 526 and left-hand threads 534 of drill pipe 522 that mate with left-hand threads on turnbuckle connector 526. As turnbuckle connector 526 is rotated, it draws both drill pipe sections together without relative rotation between them, thus facilitating alignment of electrical connectors 528 and 530.

In another embodiment of the present invention, sections of drill pipe can be cast as single units, with the conductors embedded in the dielectric wall material during the casting process. By using a nonmetallic insulating dielectric material for the pipe, the material can help insulate the high voltage conductors. The conductors are preferably cast with an initial layer of insulation on the conductors to help manage the insulation function better, or the conductors can be cast bare into the pipe wall, with the insulating dielectric material of the pipe providing the full insulation function. In yet another embodiment of the present invention, conductors are insulated with high temperature insulators, such as ceramic insulators, and cast directly into the wall of steel or aluminum drill pipe. In yet another embodiment of the present invention, the drill pipe itself is a hybrid drill pipe with one or more layers of dielectric material and one or more layers of metallic material to provide additional structural strength. In such a hybrid drill pipe, the wires are preferably cast into a dielectric material layer, but may optionally be cast into a metallic material layer.

Repetitive Pulsed Electric Discharge Apparatus

Embodiment of the present invention a repetitive pulsed electric discharge apparatus comprises one or more pulsed power subsystems, a drill bit, and one or more additional subsystems. The subsystems are preferably within a bottom hole assembly (BHA) of the repetitive pulsed electric discharge apparatus. The bottom hole assembly is located down in a hole or well and is the assembly that drills in the hole or well. The one or more subsystems within the bottom hole assembly preferably fall into four categories: pulsed power, fluid flow management, structures, and control, data acquisition and communication. There are also additional and optional subsystems. For example, there is a subsystem that connects the BHA to the surface and there are subsystems at the surface that provide for the operation of the BHA. Each of these systems and subsystems are discussed below.

Pulsed Power Subsystem

In an embodiment of the present invention high voltage pulses are applied repetitively to the bit to create repetitive electrocrushing excavation events. A pulsed power system can include, but is not limited to:

(1) a solid state switch controlled or gas-switch controlled pulse generating system with a pulse transformer that pulse charges the primary output capacitor;

(2) an array of solid-state switch or gas-switch controlled circuits that are charged in parallel and in series pulse-charge the output capacitor;

(3) a voltage vector inversion circuit that produces a pulse at about twice, or a multiple of, the charge voltage;

(4) An inductive store system that stores current in an inductor, then switches it to the electrodes via an opening or transfer switch; and/or (5) any other pulse generation circuit that provides repetitive high voltage, high current pulses to a drill bit.

In embodiments of the present invention, a bottom hole assembly comprises one or more of the following: a bit, one or more electrohydraulic projectors, a drilling fluid pipe, a power cable, one or more electrocrushing electrode sets, a connector for connecting the drill bit to the pulsed power generator, and/or a housing that may comprise the pulsed power system and other components of the pulsed power electric discharge apparatus.

In an embodiment of the present invention a repetitive pulsed electric discharge apparatus comprises a pulsed power subsystem, preferably within a bottom hole assembly (BHA) located down in a hole for drilling in the hole or well. The power is preferably generated topside with an electric generator, such as, for example, a diesel electric generator, or is taken directly from a power source, such as, for example, a power grid or a portable nuclear reactor. The electrical power is then fed into a power supply that converts the line power, for example, three phase 480 volt power, into a voltage range more suitable for the bottom hole assembly. The voltage range can be about 5-50 kV DC, as an example. This voltage can be fed downhole over one or more cables or over one or more drill pipes with embedded conductors to the bottom hole assembly. Alternatively, as described above, electrical power can be fed to a command charge system which stores electrical energy, and then transmits the electrical energy in a pulse to the bottom hole assembly when the drilling event is about to be initiated. The command charge system preferably comprises one or more energy storage components, for example, capacitors or inductors, switches for creating the pulse and transmitting it to the cable, a transformer for changing the voltage of the pulse, components for damping cable oscillations, combinations thereof or the like. The command charge system also optionally includes one or more heaters and/or one or more triggers for the switches. The command charge system or power conditioning system preferably connects to interface hardware that connects to the cable or embedded conductor drill pipe, which is attached at the other end to the top of the bottom hole assembly. In a non-limiting example, if cable is used, then electrical power for the downhole bottom hole assembly connects to the cable reel through a rotating interface at the center of the reel. This enables the cable to be unreeled and propagate down the hole with the drill string. Alternatively, the cable may connect to the bottom hole assembly through a side entry sub so that the cable can run on the outside of the drill pipe. If an embedded conductor drill pipe is utilized, the conductors preferably connect directly to mating conductors at the top of the bottom hole assembly. Alternatively or in addition the drill can be powered by a downhole power source, by a downhole alternator or generator powered by mud turbine.

The cable and/or embedded conductor drill pipe then transmits a pulse or DC power down the hole and connects to the pulsed power system in the bottom hole assembly, which preferably comprises capacitors and/or storage inductors which store the electrical energy transmitted from the surface. Upon command, switches connect the stored energy either directly to the drill bit and/or through transformers to the drill bit and/or through similar voltage multiplying pulsed power circuits to create a high voltage pulse at the drill bit. In some circumstances, a spiker-sustainer circuit can be used which creates a high voltage pulse separately from a main drilling pulse. Housekeeping power for the bottom hole assembly, for example, power for switch heaters or conditioners, instrumentation, switch triggers, and/or data acquisition and transmission systems, is preferably about 12-480 V, DC-800 Hz, and more preferably 120 volt 400 Hz power. This housekeeping power is also transmitted down the cable and/or embedded conductor drill pipe to the bottom hole assembly.

Subsystems and components involved in the pulsed power section of the bottom hole assembly can include, but are not limited to, a capacitor and/or inductive energy storage subsystem, one or more switches along with corresponding switch heaters and/or conditioners and the corresponding switch triggers, and one or more high voltage connection subsystems that connect the high voltage output to the drill bit. Other subsystems and components of a bottom hole assembly can include but are not limited to transformers and/or Marx banks and/or other voltage multiplication systems within the bottom hole assembly that create the high voltage pulse that is then transmitted to the drill bit by the high voltage connection and wiring system.

Instrumentation, Communication and Control Subsystem

Figure 55:
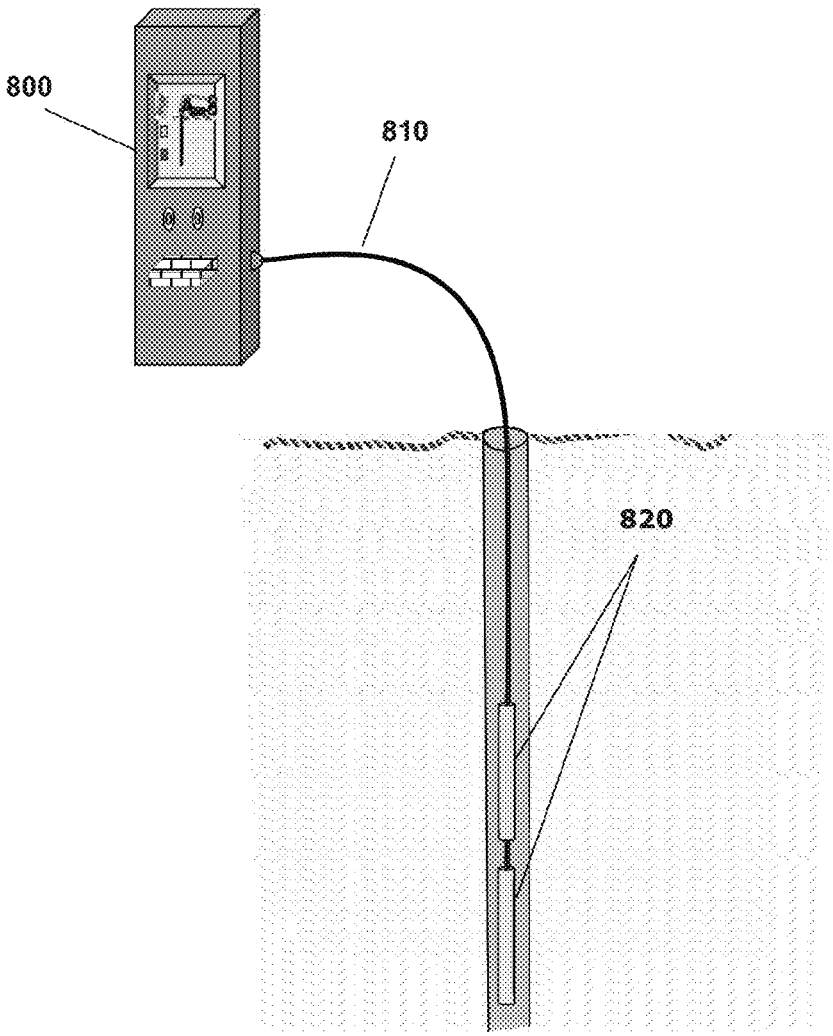
FIG. 55 shows a schematic of an embodiment of the instrumentation, communication, and control subsystem of the present invention.

Referring to FIG. 55, some embodiments of an instrumentation, communication and control subsystem of the present invention comprise a topside or surface system 800 for a repetitive pulsed electric discharge apparatus that comprises a primary power generation and conditioning apparatus and a command charge pulse generation and control apparatus. The topside system preferably interconnects with cable 810 and/or an embedded conductor drill pipe. The topside system also preferably interconnects with a command control and instrumentation system. Additionally, the command control and instrumentation system is preferably located on the surface, and preferably is a computer or programmable logic controller (PLC)-based. The command control and instrumentation system provides command signals to the power supply to tell the power supply when to turn on and when to turn off. The command control and instrumentation system also preferably comprises the command charge system that accepts the power from the power supply, stores it in a capacitor or inductive energy storage, and then sends the power in a pulse to the bottom hole assembly to initiate a drilling event. The command control and instrumentation system preferably comprises switch triggers that turn on the switches in the bottom hole assembly. The command control and instrumentation system also preferably controls the direction of the drill by controlling the relative firing frequency of the sets of electrodes of a drill bit, in order to keep the drill moving in the desired direction. The command control and instrumentation system preferably controls the relative firing frequency of electrode sets by controlling the relative firing frequency of the switches connected to the corresponding electrode sets.

The command control and instrumentation system preferably acquires data from the downhole instrumentation systems to assess the location of the drill in physical space. For example, the command control and instrumentation system preferably communicates with a microchip-packaged MEMS gyroscope device, a solid-state ring laser gyroscope, or a fiber optic gyroscope, as part of an inertial navigation system, to assess a relative motion of the drill system and hence determine the location of a drill system in three-dimensional space to enable precise control of the drilling trajectory of the drilling system. The command control and instrumentation system also preferably assesses the health and performance of the pulsed power system by measuring the peak voltage and peak current produced during the drilling cycle, the average power consumption of the drill related to drilling rate, the temperature of circuit pulsed power components and fluid systems, fluid pressure at several locations in the bottom hole assembly (to assess the condition of the internal flow of structures and to assess the internal flow rate inside the bottom hole assembly), and other parameters. The command control and instrumentation system also preferably provides bottom hole environmental data, including but not limited to fluid pressure and temperature external to the bottom hole assembly using pressure and temperature transducers, which are transmitted to the command control and instrumentation system at the surface via the data acquisition and communication system.

A downhole control, instrumentation, data acquisition, and communication system preferably provides for the control of the pulsed power system, the directional control and drilling rate of the drill itself, the acquisition of performance data for various subsystems in the BHA, and the communication of that data with a topside control and instrumentation system. The system of this embodiment comprises one or more digital data storage components that acquire data from one or more instrumentation probes and transducers disposed in the bottom hole assembly. The system stores the data collected by the probes and transducers, and then one or more data transmission components transmit the data to the surface over one or more instrumentation conductors or fiber-optic cables of the downhole cable or the instrumentation conductors or fiber-optic cables of the embedded conductor drill pipe as an AC signal superimposed on the DC power current. The data transmission occurs either according to a programmed schedule, continuously, or upon command from the control system located on the surface.

The connection between the bottom hole assembly and the TCI is preferably a direct connection, e.g. via a cable, which enables high data rate transmission. Conventional (non-EC) drills cannot accommodate a direct connection due to rotation of the drill bit. This enables near-instantaneous acquisition of geophysical data, which greatly increases safety of the drilling. For example, if the drill enters a high pressure gas region, a pressure sensor can relay that information to the TCI, which can immediately slow the drilling rate and take precautions against a blowout.

Topside control and instrumentation (TCI) system 800 preferably creates control signals to drive the power supply, the command charge system, and the switch triggers in the bottom hole assembly. The TCI system provides command signals to the power supply to signal to the power supply when to turn on and when to turn off, thereby also controlling drilling rate. The TCI system also provides command signals to one or more switches in a command charge system to accept power from the power supply, store the energy in a capacitor or inductive energy storage, and then, on command, send the energy in a pulse to the bottom hole assembly to initiate a drilling event. The TCI system comprises switch triggers that turn on the switches in the bottom hole assembly. The TCI system can also controls the direction of the drill by controlling the relative firing frequency of the sets of electrode of a drill bit, in order to keep the drill moving in the desired direction. For example, the TCI system controls the relative firing frequency of electrode sets by controlling the relative firing frequency of the switches connected to particular electrode sets.

The TCI system preferably acquires data from the bottom hole data acquisition and communication system to assess the performance of the bottom hole pulsed power and fluid systems 820 and to display key data to an operator. The control signals from the TCI system are preferably fed down the cable or the embedded conductor drill pipe to the bottom hole assembly and hence to one or more switch triggers in the bottom hole assembly. The control signals are also fed to the power supply and the command charge system. Various pulsed power, fluid temperature, and geophysical sensors are fed to the downhole control instrumentation, data acquisition and communication system at the top of the bottom hole assembly and/or fed directly over cable or fiber optic links to the topside control and instrumentation system where the function, health, and performance of the BHA is assessed, along with its physical location in space and the properties of the environment the bottom of the well.

In another embodiment of the present invention, a pulsed power electric discharge apparatus comprises a pulsed power system packaged in a bottom hole assembly that operates downhole at varying depths and temperatures. The pulsed power electric discharge apparatus also incorporates data communication with a surface apparatus. The pulsed power electric discharge apparatus comprises a data acquisition and transmission apparatus that acquires data as to the operating performance and environment of the pulsed power electric discharge apparatus and transmits that data to a surface control and instrumentation apparatus. This data acquisition and transmission apparatus preferably: 1) controls the direction of a drill of the pulsed power electric discharge apparatus while drilling to optimize the intersection of desired formation features; 2) provides information to the operator as to bottom hole temperature and pressure conditions; 3) provides diagnostics on the condition of the pulsed power system in case of an anomaly in drilling rate or a potential malfunction; and 4) maintains a running assessment of the performance of the pulsed power system for future maintenance.

The bottom hole assembly presents a challenge for instrumenting pulsed power signals. The space within the bottom hole assembly is typically confined because of the necessity for drilling a small diameter hole. The operating temperatures and pressures can be high because of the downhole environment. In addition, there is significant vibration and shock from the drilling action itself. Packaging and selecting pulsed power instrumentation for the bottom hole assembly can be different from selecting and packaging pulsed power instrumentation for a conventional pulsed power system because of these factors.

Geophysical instrumentation incorporated into the bottom hole assembly can include, but is not limited to measurement of ambient temperature, measurement of ambient pressure near the bottom hole assembly, and determination of the location of the bottom hole assembly in a three-dimensional space.

Data transmitted from one or more sensors in the bottom hole assembly is transferred to a data acquisition and communication apparatus preferably located near a top of the bottom hole assembly. On command, this data is transmitted to a surface instrumentation and control system via a cable and/or fiber optic links to the surface.

Pulsed current in the pulsed power system, for example, the current used to operate a drill bit, is typically measured by current transformers, B-dot probes, resistive probes, capacitive probes, or probes utilizing optical effects to determine current or the derivative of current. B-dot probes measure the time changing magnetic field produced by the current and integrate that information to provide a measurement of current. An advantage of a B-dot probe is that it does not require physical connection to a high current circuit, thus avoiding a significant installation issue. In an embodiment of the present invention, data from one or more current transformers and/or B-dot current probes is transmitted to a bottom hole assembly data acquisition and communication apparatus and then to a surface instrumentation and control system. Continuous AC current is preferably measured utilizing similar probes. Continuous DC current is preferably measured with resistive probes.

In embodiments of the present invention, pulsed voltage in a pulsed power system is measured with one or more resistive probes and/or one or more capacitive probes. These probes are connected to the component utilizing or providing the high voltage. In another embodiment of the present invention, one or more E-dot probes are used to measure the time changing electric field, which is integrated to yield the time changing voltage. An advantage of an E-dot probe is that it does not require physical connection to the high voltage component, thus avoiding a significant insulation issue. Yet another variation of the E-dot probe is to integrate the probe into a pulse transformer so that the probe measures the output voltage from the transformer, but without requiring physical connection to the high voltage components. In an embodiment of the present invention, pulsed voltage is measure using one or more E-dot probes and/or one or more resistive probes and/or one or more capacitive probes or combinations thereof.

An issue with any pulsed power instrumentation is noise on the data connection wiring to the instrumentation, induced by fast rising voltages and currents in the pulsed power system. In the bottom hole assembly, the connection between the pulsed power instrumentation probes and the data acquisition and communication apparatus is preferably shielded from noise by a coaxial cable or by a fiber optic link or by RF data transmission or by direct laser data transmission or combinations thereof or the like.

In addition to the pulsed power instrumentation, characteristics of the bottom hole assembly flow system are also preferably measured. This can include but is not limited to measurements of flow pressure at key points in the system, from which can be deduced the flow rate through the system. In some circumstances, it is appropriate to measure the flow velocity directly, either by rotating flow meters or by capacitive or inductive meters or venturi-type meters. Embodiments of the present invention comprise one or more flow meters and/or one or more capacitive meters and/or inductive meters and/or venturi-type meters for measuring flow rate and flow pressure. In an embodiment of the present invention a venture-type meter is used to measure flow rate and flow pressure. In an alternative embodiment of the present invention, a flow rate is measured by measuring the RPM of a pump, particularly a positive displacement pump.

A data acquisition and communication apparatus (DAC) is preferably located at the top of the bottom hole assembly, to maximize the distance from the drill bit. The DAC preferably acquires data from one or more various probes, including one or more pulsed power system instrumentation probes and geophysical instrumentation probes and bottom hole assembly fluid dynamics probes, and can store that information until an inter-pulse period, when the DAC can transmit the data to the surface with minimal interference from the operation of the pulsed power system. Specifically, embodiments of the pulsed electrocrushing drill of the present invention fire the drill bit at a rate of approximately 100 pulses per second, with approximately 10 msec between each pulse. Due to noise problems, it is preferable that data is not transmitted during the firing of the bit. Thus, when a signal is sent from the surface to fire an EC pulse, the DAC is turned off and/or ceases transmission of data prior to or simultaneous with the initiation of the pulse. Each firing pulse produces data, such as peak current, peak voltage, striker current and voltage, and sustainer current and voltage, which is acquired by the DAC; the data is then sent to the TCI after the firing pulse is completed. The data enables the system to monitor the performance of the drill. If the communication with the surface is over a fiber optic link, then the DAC can transmit data to the surface continuously.

Direct Charging Embodiments

Figure 54A:
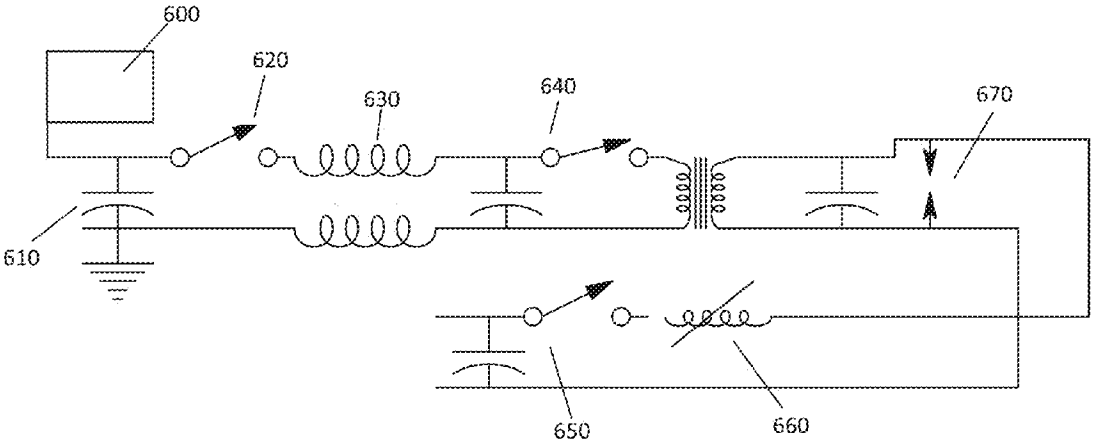
FIG. 54A shows a simplified schematic of an electrical circuit for powering an embodiment of the electrocrushing apparatus of the present invention using a command charge system.
Figure 54B:
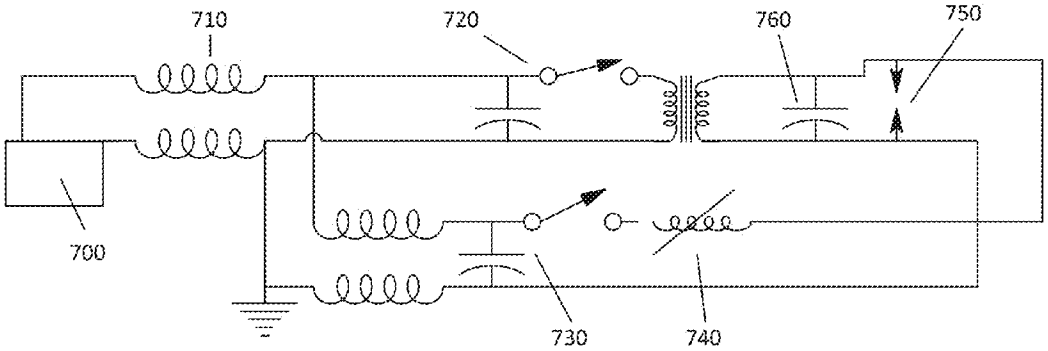
FIG. 54B shows a simplified schematic of an electrical circuit for powering an embodiment of the electrocrushing apparatus of the present invention using a direct charge system.

In some embodiments of the present invention a power supply located on the surface is connected directly to the pulsed power system located in the downhole bottom hole assembly, without the use of the command charge system. This direct charging system is advantageous because for command charge systems it is difficult to manage ground swings. A comparison of representative embodiments of the two configurations is shown in FIG. 54. FIG. 54A shows a simplified circuit for a command charge system. Power supply 600 connects to the command charge system which comprises command charge capacitor 610 and command charge switch 620 for providing power through cable 630 from the surface to the bottom hole assembly, which comprises at least one spiker circuit 640 (some embodiments have three spiker circuits, also called striker circuits) and sustainer circuit 650 which, via magnetic diode 660 provide pulsed power to drill bit 670 as described above. The cable may also connect to the sustainer circuit capacitor through an isolation inductor (not shown). FIG. 54B shows a direct charge system, in which power supply 700 provides power through cable 710 from the surface to the bottom hole assembly, which comprises at least one spiker circuit 720 (some embodiments have three spiker circuits) and sustainer circuit 730 which, via magnetic diode 740 provide pulsed power to drill bit 750 as described above. In alternative embodiments of either system, primary output capacitor 760 can be replaced by the equivalent self-capacitance of the bit, connection structure and other components, which can all be designed to provide the equivalent function of the primary output capacitor.

In some embodiments a switching power supply which utilizes controlled high-frequency current pulses to progressively increase the voltage of the capacitors in the bottom hole assembly, while constantly measuring the charge voltage on those capacitors so as to adjust the current to achieve the desired end state voltage, may be used. This control methodology is suitable for long cable distances, for example 10,000 feet, (typically from approximately 500 feet to approximately 30,000 feet) between the power supply and the capacitors located in the bottom hole assembly.

Alternatively a DC power supply (preferably on the surface) may be utilized to charge the capacitors, preferably while monitoring the capacitor voltage on a separate cable to control the end state voltage. In this embodiment a high voltage probe utilized for monitoring the capacitor voltage could be located in the bottom hole assembly, with only control signals going to the surface. The control signals could alternatively be transmitted to the surface on the power cable as an AC signal superimposed on the DC power current. Such control signals can be inductively coupled into the power cable in the bottom hole assembly and then extracted inductively from the power cable at the surface.

Another embodiment is to locate an AC power supply on the surface and transmit the voltage across the cable as an AC waveform and then rectify it in the bottom hole assembly, utilizing a separate cable for monitoring voltage or, alternatively, transmitting voltage monitoring data at a different frequency along the same cable.

The power supply, together with voltage control circuitry that receives voltage data from the downhole bottom hole assembly capacitors and controls the current and/or voltage output from the power supply, is preferably on the surface. The primary power for the power supply may be an on-site generator, but it can alternatively comprise electrical power from the electric power utility grid or any suitable source of electrical power.

Data Transmission

The cable or the conductive drill pipe utilized to transmit power to the RePED bottom hole assembly also preferably comprises data transmission wires. Coupling between the data transmission wires and the main power wires would likely introduce electrical noise into the data stream. This is especially true with the command charge system because of the higher current involved in pulse charging the bottom hole assembly (BHA). An advantage of the direct charge system is that, while the average current will be the same between the two, the direct charge system will be charging at the average current whereas the command charge system will have a peak current about twice the average current. The higher peak current of the command charge system may induce more noise into the data lines than the direct charge system.

Using a switching power supply direct charge system utilizes high frequency chopping of the power in order to control the state of charge, and hence the voltage on the capacitors being charged. That high frequency chopping may induce noise on the data lines. However, because it is high frequency, it is much easier to shield then a large low-frequency pulse. In addition, over long cable runs it is difficult to control voltage at the capacitor when using a switching power supply. A direct current (DC) power supply does not produce any high frequency noise and provides the charging of the BHA without inducing noise on the data lines. This is advantageous over a switching power supply.

Another embodiment of the present invention comprises a transmitter, preferably a microwave transmitter, located at the top of a well and a receiver, preferably a microwave receiver, located at the top of a bottom hole assembly in the well. The transmitter and receiver preferably transmit power to the bottom hole assembly without the use of a cable or a drill pipe with embedded conductors. The bandwidth of a signal, preferably a microwave signal, preferably provides for data transmission down the hole to the bottom hole assembly, in addition to power transmission. A low-power transmitter installed on the bottom hole assembly preferably transmits data back to the surface. For microwave charging, the resonant frequency of the metallic drill pipe used to conduct drilling fluid to the bottom hole assembly is preferably appropriately matched to the frequency of the microwave system (e.g., a transmitter and a receiver), so that the drill pipe functions as a waveguide for the microwave system to minimize losses and improve power transmission to the bottom hole assembly.

In typical drilling operations, the drilling fluid is aqueous, which being conductive will short the microwave field, thereby blocking microwave charging of the bottom hole assembly. However, embodiments of the present invention utilize a non-aqueous insulating or dielectric drilling fluid, as described above, which is compatible with microwave charging.

Fluid Flow Subsystem

In some embodiments of the invention, a fluid flow subsystem preferably comprises one or more pumps at the surface that pump drilling fluid through a drill pipe down to the bottom hole assembly. At the top end of the bottom hole assembly, a portion of the drilling fluid is preferably diverted by a flow diverter. The diverted portion of drilling fluid preferably cools the high power electrical components. The remaining drilling fluid preferably flows around flow dividers to the drill bit. The drilling fluid flow is then directed through the drill bit, preferably through a flow combiner and through channels in the drill bit where it pushes out bubbles and rock cuttings. Unlike embodiments of the present invention which split the fluid flow into a cooling portion and a clearing portion in order for the fluid to perform both functions, conventional (non-EC) drills typically don't require cooling, and, conversely, well-logging tools don't require bubbles or rock cuttings to be removed. Referring to FIG. 35, the drilling fluid preferably flows radially from the center of the bit out towards to the exterior of the bit. The drilling fluid then flows around the bottom hole assembly and up to the surface. At the top, the drilling fluid preferably flows from the well to a settling pond, where cuttings settle out. The used drilling fluid and cuttings are then preferably transferred to a solids control system where the solids are removed from the drilling fluid. In an alternative embodiment, the drilling fluid can also be transferred to a water extraction system where excess water is removed from the drilling fluid.

The BHA preferably has significant fluid flow through the assembly. The primary purposes of this fluid flow are to stabilize the well in the rock formation and to sweep the cuttings out of the hole. In some embodiments, high flow rates accomplish the cutting sweep-out function. In addition to these functions of the fluid flow, there are number other functions for the fluid flow within the BHA. For example, one function is to clear fluid bubbles out of a bit electrode area. Such bubbles are created by the electrocrushing drilling action of the bit. A flow structure is preferably designed into the bit to direct the flow through the bit electrodes and through the surrounding structure to ensure efficient sweep-out of the bubbles created by the drilling action.

Figure 56:
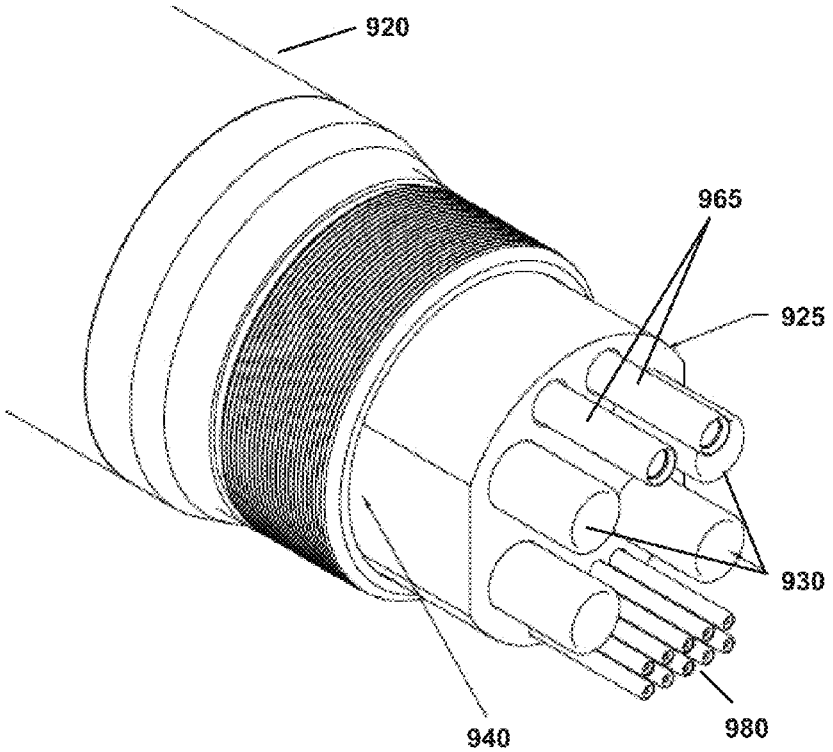
FIG. 56 shows a flow diverter for splitting the flow of drilling fluid in embodiments of the present invention.
Figure 57:
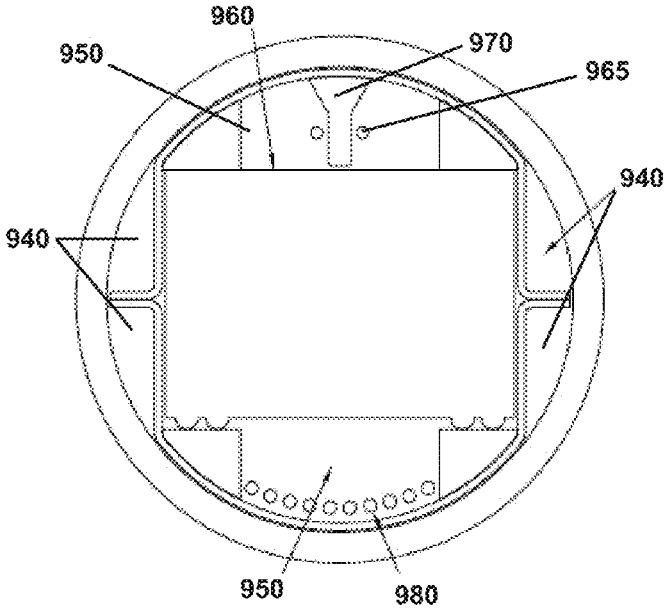
FIG. 57 shows a cross section of a bottom hole assembly of the present invention showing electrical components and cooling paths therein.

In the embodiment shown in FIGS. 56-57, fluid enters (from the right) and flows through bottom hole assembly (BHA) tube 920, preferably cooling the electronics components and pulsed power components within the BHA. The flow system preferably comprises a flow diverter to divert a predetermined amount of flow, for example, about 10% or more, of the total flow, through the electronics components and pulsed power components in order to prevent erosion of the components. The diverted flow, henceforth referred to as cooling flow, flows through one or more low speed flow choke tubes 930 disposed in sustainer section transition insulator 925, then into one or more plenums or passages 950 which direct the flow around and over or adjacent to various electronics and/or pulsed power components, such as sustainer capacitor 960, to cool them. These components preferably comprise cooling structures that provide thermal connection with the cooling flow to cool the components. Channels and flow structures disposed in one or more mounting structures for the pulsed power and electronic components preferably maximize the cooling effectiveness of the cooling flow around the components. The remainder of the flow flows through one or more high speed flow channels 940 to the drill bit. High voltage power lines 965 and signal and housekeeping power lines 980 preferably extend through BHA tube 920 and are preferably disposed in tubes which mate to other sections of the drill to prevent direct contact with the fluid. Spacer 970 preferably separates high voltage lines 965 and holds sustainer capacitor 960 in place.

An optional flow diverter shield (not shown) protects one or more pulsed power components from too much fluid flow, which can cause erosion. One or more components are preferably used to divert the cooling flow into the pulsed power and electronic sections of the bottom hole assembly. One or more other components then preferably merge the cooling flow with a main fluid flow near the drill bit. The flow system of this embodiment merges the cooling flow and the main flow in the bit area to maximize the effectiveness of the total flow in clearing bubbles out of the bit. The flow velocities of the fluid flow in this embodiment are preferably controlled and correlate with component temperature rise and cooling effectiveness to further optimize the cooling flow and its cooling function. Instrumentation and sensors are used to control the flow velocities and correlate the velocities with component temperature rise. Data from one or more sensors is transmitted to the data collection acquisition system (DCAS) which then transmits the data to the surface control and instrumentation system.

Figure 58:
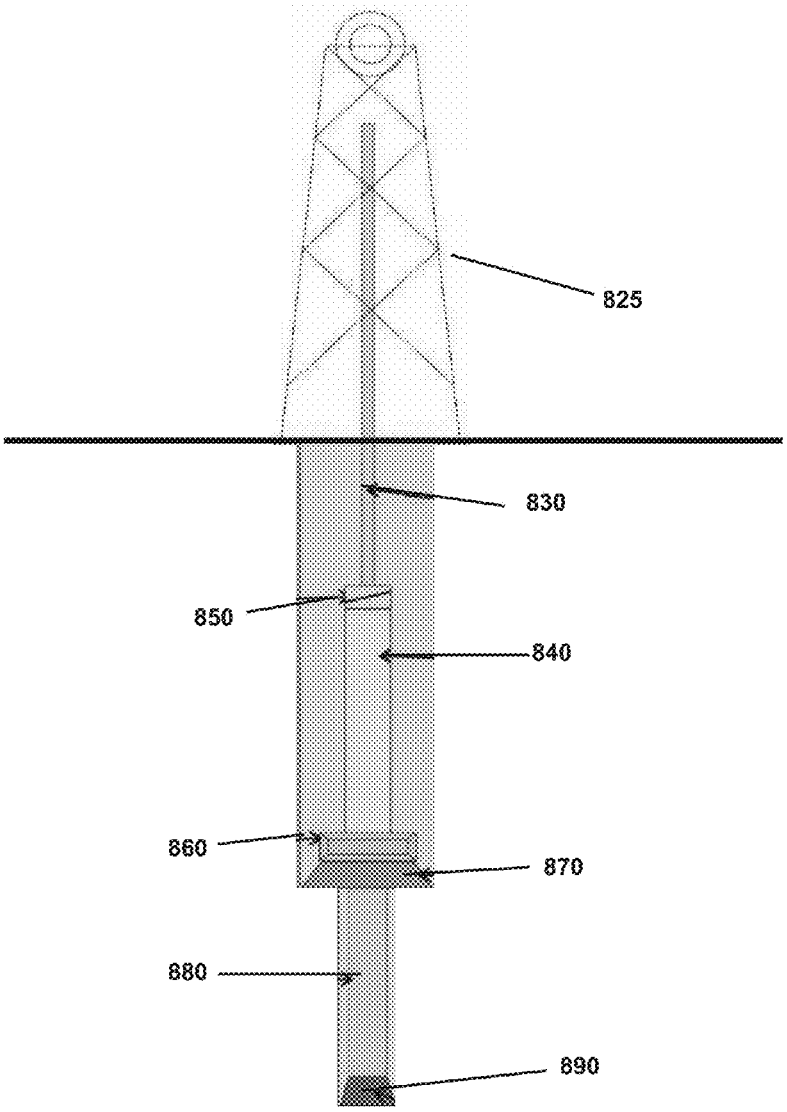
FIG. 58 shows a tiltable drilling apparatus comprising a mud motor.
Figure 59A:
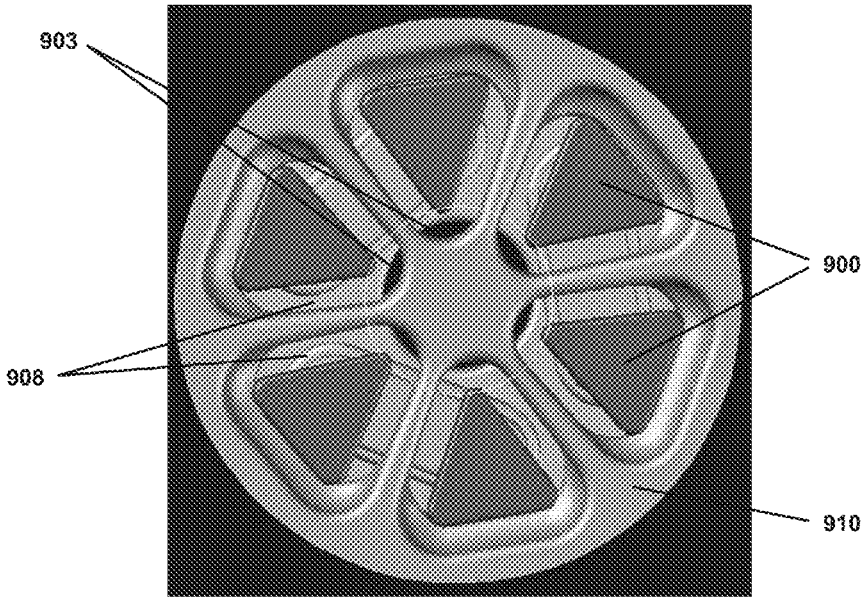
FIG. 59A shows a pie-segment drill bit that comprises radial fluid flow useful for directional control.
Figure 59B:
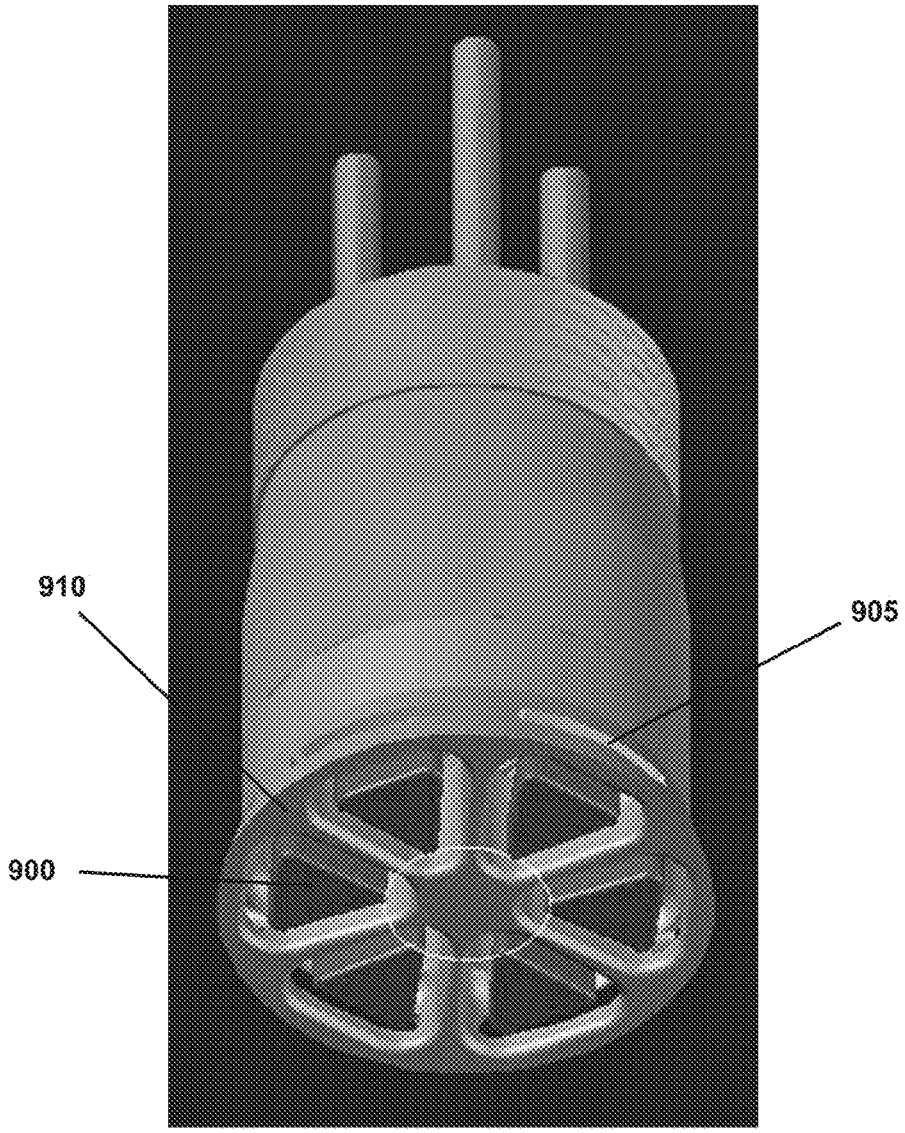
FIGS. 59B, 59C, and 59D are respectively a perspective view, a bottom view, and a top perspective view of the drill bit of FIG. 59A.
Figure 59C:
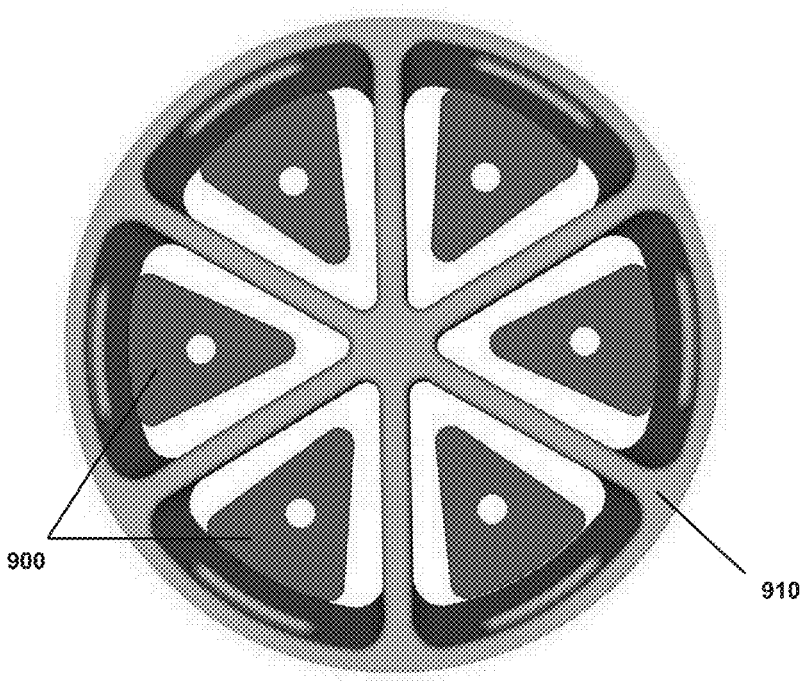
Figure 59D:
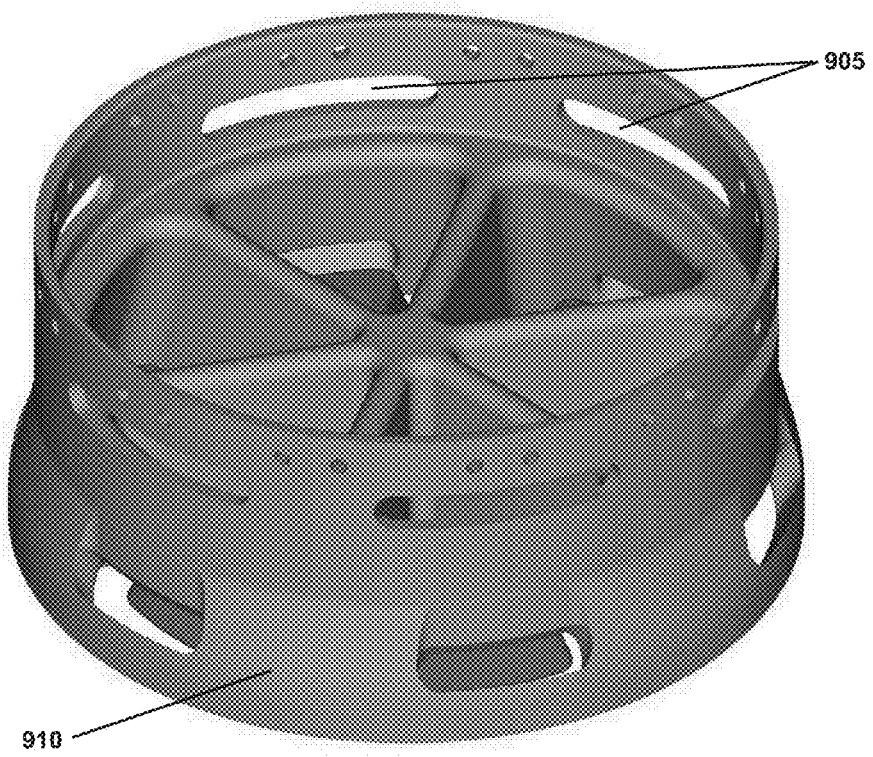

Referring to FIG. 58, in another embodiment of the present invention, a repetitive pulsed electric discharge apparatus comprises derrick 825, drill stem 830, bottom hole assembly (BHA) 840 disposed on the drill stem and tilt mechanism 850. Mud motor 860 and mechanical bit 870 are preferably disposed under BHA 840. Extension pipe 880 is preferably disposed on the bottom of mechanical bit 870. At an opposite end of extension pipe 880, a repetitive pulsed electric discharge (RePED) bit 890 is preferably disposed. Extension pipe 880 preferably houses the pulsed power system cable so it can connect to RePED bit 890. The apparatus of this embodiment extends beyond a mechanical bit to drill out only a center of a hole. In this embodiment, mud motor 860 drives mechanical bit 870. BHA 840 sits above mechanical bit 870 and cables and fluids run to repetitive electric pulsed discharge bit 890. Tilt mechanism 850 is preferably installed above BHA 840 to tilt BHA 840 and one or more bits. (For example, both mechanical bit 870 and repetitive pulsed electric discharge bit 890 can be tilted if both are used.) Repetitive pulsed electric discharge bit 890 can be, but does not need to be, steerable since the entire section tilts. In a preferred embodiment, the repetitive pulsed electric discharge apparatus comprises one spiker.

Drill Bit Design for Directional Control

In order to efficiently excavate or drill a hole using a pulsed power drilling with an electrocrushing process, there is preferably an electric field distribution at the rock face produced by the electrocrushing process. There is also a fluid flow to sweep the rock particles and bubbles out of the electrode region. Embodiments of the present invention as illustrated in FIG. 59 comprise a drill bit, preferably comprising a pie-segment current return structure, that comprises radial fluid flow, in conjunction with linear flow, to sweep the bubbles and rock particles out of the electrode region as quickly as possible with a predetermined fluid flow rate. As used throughout the specification and claims, the term "current return" element means an element which may be grounded and at a ground voltage or instead which may be electrically connected to the ground point but not at the ground voltage due to voltage drops between the element and the ground point (for example due to a long electrical connection). In the specification, the term "ground" may in some places be used interchangeable with the term "current return".

FIGS. 59A-59D illustrate an embodiment of a drill bit comprising a plurality of high voltage electrodes 900 nestled in current return structure 910. Current return structure 910 preferably provides structural strength and integrity to the bit. In this embodiment, fluid flows into the bit at 903 near the inner tips of high voltage electrodes 900, and then flows across the rock face and out openings or slots 905 in the outer rim of the surrounding ground ring (current return structure 910). The fluid thus preferably flows onto the rock surface around high voltage electrodes 900 and out the openings or slots in ground ring 910. Some of the fluid may also escape onto the rock surface through the face of the bit around electrodes 900, especially if an electrode is extended out from the bit face. Each of the high voltage electrodes 900 is preferably compressible and extends out of the plane of the drawing into the rock as the rock is excavated. In addition to sweeping rock particles out of the electrode region, the fluid also must sweep away bubbles created by an arc (typically in regions 908); if not removed, the next arc could short through such a bubble. Such bubbles are typically not produced by a conventional (non-EC) drill, and even if they are they do not affect the drilling process for such a drill.

In this embodiment, pairs of electrodes are preferably connected together to provide three sets of electrodes, each set of electrodes being operated by a separate pulsed power system. This embodiment enables directional control of the bit, by one pulsed power system operating at a lower repetition rate than the other two, thus causing the bit and associated bottom hole assembly to steer towards this lower repetition rate electrode set. This embodiment of tying one or more high voltage electrodes together to provide electrode sets for directional control can optionally be extended to eight electrodes (four electrode sets of two electrodes each) or nine electrodes (three electrode sets of three electrodes each) or other combinations to achieve the desired drilling rate and directional control performance characteristics.

In the embodiment illustrated in FIG. 59, each high voltage electrode 900 preferably extends independently out of the bit and into the rock as the rock is excavated. In another embodiment of the present invention, a plurality of electrodes can be mechanically linked to move as a set instead of individually. In yet another embodiment, all of the electrodes in a bit can electrically be tied together, for those circumstances where the added complexity of directional drilling is not needed, thus requiring only one pulsed power system instead of a plurality of pulsed power systems. In another embodiment of the present invention, a drill bit comprises a central electrode that may or may not be electrically tied to one of the other electrodes or electrode sets to provide more effective excavation of the center portion of the bit.

In yet another embodiment of the bit, one or more of the high voltage electrodes can each be divided into two or more smaller high voltage electrodes without having to modify the current return structure. By having two separate assemblies of high voltage electrodes, for example, greater control can be achieved over the electric field distributions of a particular high voltage electrode or high voltage electrode set relative to the ground ring. That, in turn, can result in greater drilling effectiveness. For example, in FIG. 59, each of the six high voltage electrodes 900 can be divided into two electrodes, with those two electrodes (instead of the original one) disposed in each wedge-shaped opening of current return structure 910, resulting in a total of twelve electrodes for the bit. The division of the electrodes can occur along a radial line and/or a circumferential line, depending on which configuration gives the most desirable electric field distribution. If along a circumferential line, the resulting design can have, for example, six smaller electrodes arrayed near the center of the bit, followed by six more electrodes arrayed closer to the circumference of the bit, for a total of twelve electrodes. As long as portions of a split electrodes are fed from the same circuit (i.e. same voltage), no insulator between them is necessary. Using split electrodes is advantageous because the resulting fluid passages between the electrodes improves the fluid flow, and thus improves the ability of the fluid to remove rock debris and bubbles. In addition, drilling effectiveness is increased, because excavation is typically increased at the electrode corners due to the electric field distribution, and two or more electrodes split from a single electrode have more corners than the single electrode does.

Figure 60:
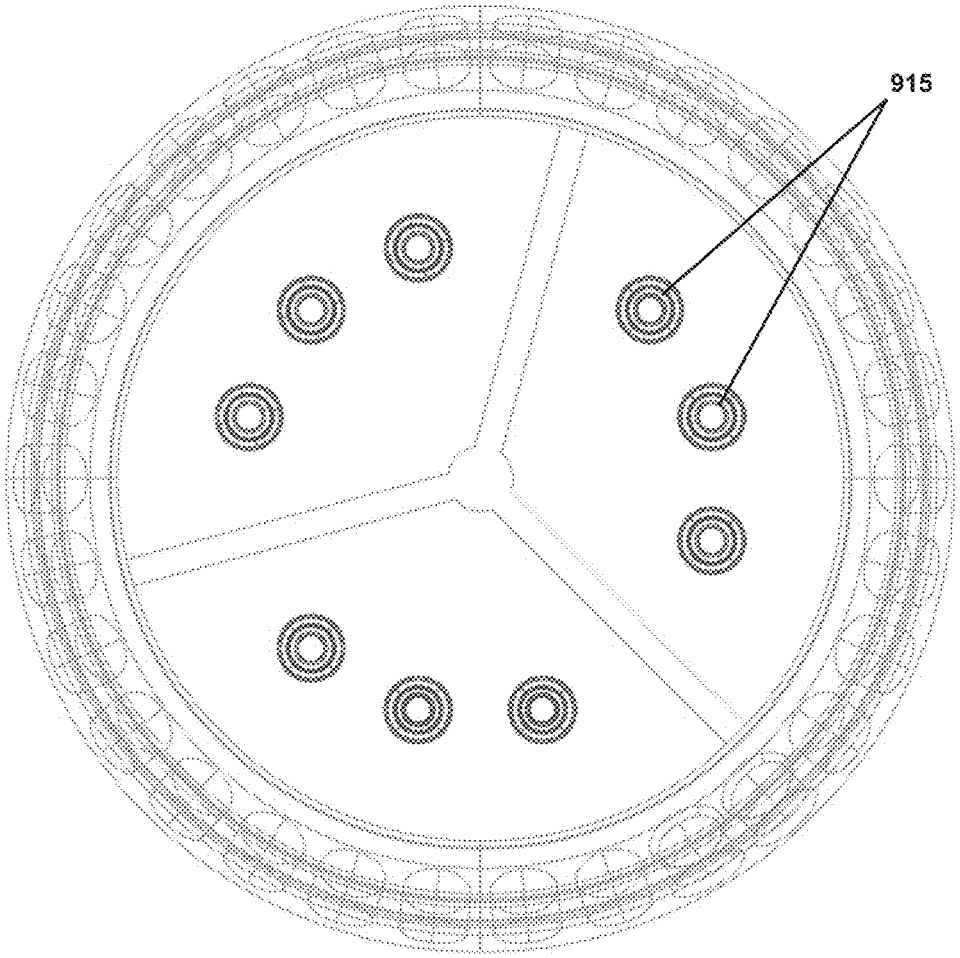
FIG. 60 shows a drill bit comprising a pie shaped current return structure and rod shaped electrodes.

In another embodiment, the bottom view of which is shown in FIG. 60, each opening in current return structure 912 accommodates a plurality of rod shaped electrodes 915. As shown, these may be arranged to form a circle centered on the center of the bit face.

Nutation of Drill Bit

In some embodiments of the present invention, it may be beneficial to rotate the bit with mechanical cutters to provide a more accurate cutting of the gauge of the hole. In such an embodiment, mechanical cutters can be arrayed along a periphery of the bit to provide mechanical cutting of an outer wall of a hole, thereby providing a smoother hole. In other embodiments, the bit can be rotated or nutated back and forth without mechanical cutters, to provide a more rapid and even excavation of the hole.

One of the issues observed in drilling tests with drilling systems is difficulty with completely clearing the hole because of nonuniformity in the excavation process. As the drill propagates through the rock, the non-uniformities in the rock may cause a lip or ledge on the outer rim of the rock hole that prevents the propagation of the drill through the hole. This non-uniformity in the excavation of the hole can be created by the non-uniformity in the drilling process caused by the physical structure of a drill bit. In order to solve the non-uniformity in the drilling process, an embodiment of the present invention comprises turning the drill bit approximately 10° to approximately 45° back and forth around an axis of the bit that is aligned to the direction of drilling. This nutation motion causes various segments of the drill bit to contact different sections of the hole rim that then cause the non-uniformities in the hole rim to be excavated by different segments of the drill bit. The nutation motion preferably enables the bit to completely clear the hole and propagate through the formation.

Figure 61:
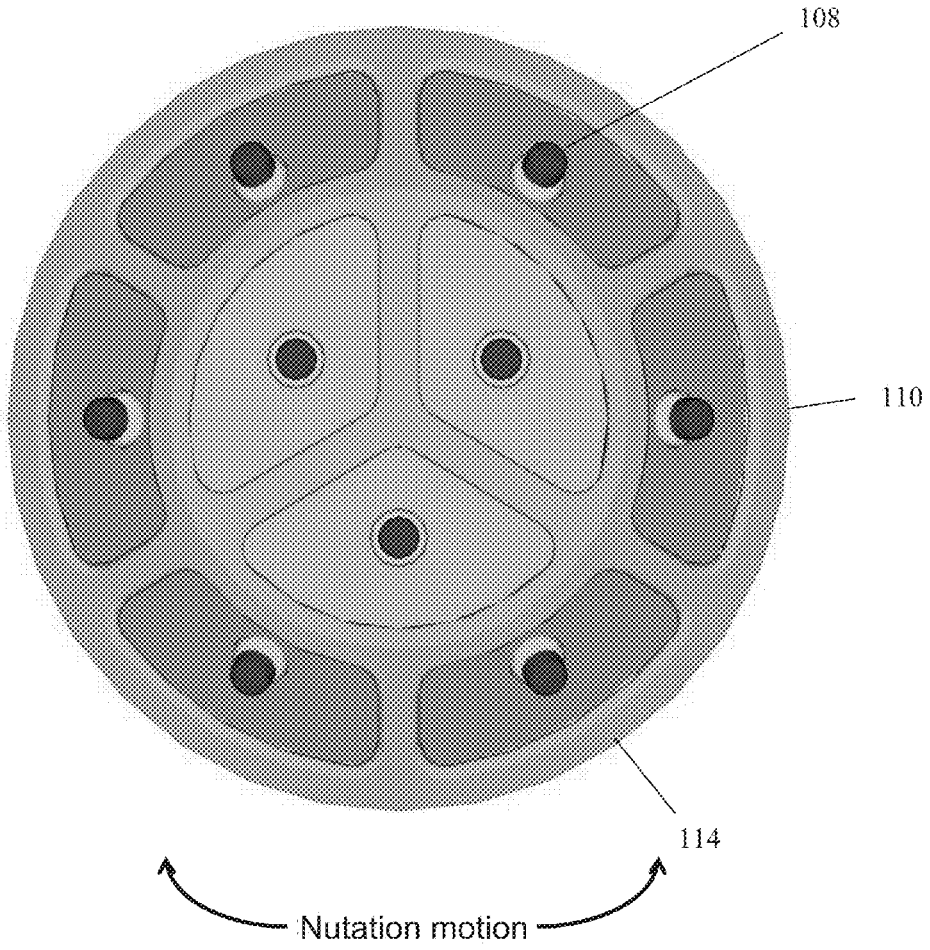
FIG. 61 shows nutation motion of the drill bit of FIG. 35.

Referring to FIG. 61, in one embodiment of the present invention the nutation motion is accomplished by providing a rotational joint at a bit-bottom hole assembly interface. The joint preferably comprises a slip ring, preferably an oil-insulated slip ring, to handle or accommodate the four circuits that are required to feed power to bit 110. In an alternative embodiment, conductors, preferably flexible conductors, are used to accommodate the nutation of the bit. A motor, preferably electrically and/or fluid driven, turns the bit back and forth to clear any non-uniformities at rim 114. Electrodes 108 are preferably designed to accommodate the nutational motion of the bit.

In an alternative embodiment, the bit rotates approximately 10° to approximately 45° back and forth around a point at the end of the bottom hole assembly so that the axis of rotation is substantially perpendicular to the axis of propagation. This embodiment preferably provides a means of physically changing the drilling direction by changing the orientation of the bit.

Unlike grinding drill bits which require rotation or nutation in order to provide the physical mechanism for drilling rock, EC bits do not require motion to drill. For EC bits, nutation smoothes out nonuniformities resulting from the EC process itself on non-uniform rock or from discontinuities in the electrode structure. For example, if the bit pictured in FIG. 59 is used, a portion of the rock will be situated under current return structure 910 rather than an electrode 900; nutation of the bit to bring electrode 900 over that portion of the rock enables it to be drilled.

Structural Subsystem

The structure of the bottom hole assembly preferably protects the internal subsystems from damage from the rock well environment, provides rigidity to control alignment of the internal subsystems and fluid flow systems, provides for easy disconnection of the overall assembly into subassemblies that can be easily transported, and provides for the connection of the bottom hole assembly to drill pipe for fluid flow and cable and/or embedded drill pipe for power and communications connections. The structure preferably comprises a steel tube that protects the internal components from impact or abrasion with the rock wall of the well. The tube also provides rigidity for the bottom hole assembly to maintain alignment of the components. Special connectors are preferably provided to enable the connection of different sections of the bottom hole assembly. The connectors also maintain structural strength and rigidity while providing for reliable connections of the pulsed power and other circuits from one section to the next.

Materials selected for the bottom hole assembly tubing structure provide an overall structural integrity of the system. The preferred materials for the bottom hole assembly tubing structure include but are not limited to steel drill pipe, high strength alloy steel tubing, high-strength metallic tubing of various metal alloys including steel and aluminum, high-strength composite metallic tubing of metal and non-metal constituents, and high-strength abrasion resistant composite tubing incorporating carbon fiber, glass fiber, carbon nanotube structures, Kevlar fibers, other high-strength fibers and the like, or combinations thereof. The specific design of the structure of the bottom hole assembly preferably meets predetermined design requirements for the downhole well environment. In a non-limiting example, a bottom hole assembly structure can be made from 8⅜" OD drill pipe in four approximately 20-30 foot sections for a total overall length of about 90-110 feet. Each section of drill pipe is preferably connected to the other with a turnbuckle, incorporating left-hand and right-hand threads, so that alignment can be maintained of high voltage conductors between the sections of drill pipe without relative rotation. The turnbuckle enables the two sections of drill pipe to be rigidly fastened to each other with screw threads without relative rotation of the two sections of drill pipe. This enables the electrical conductors from one drill pipe to be connected to the other drill pipe without relative rotation, which would cause twisting and distortion of the conductors. The bit is preferably connected to the bottom hole assembly structure using a similar turnbuckle.

Pulsed Magnetic Fields for Downhole Characterization

Embodiments of the present invention are directed to a drill and system for drilling that utilizes a pulsed source of electromagnetic energy downhole. A pulsed power breaking and drill apparatus is also known as a repetitive pulsed electric discharge apparatus. The variant of the pulsed electric drill system designed to produce pulsed magnetic and electromagnetic fields is referred to as the electromagnetic (EM) pulsed electric drill. Pulsed electric drilling technology is suited to provide such a source of electromagnetic energy because in certain systems the pulsed power system is already deployed downhole. The system enables electromagnetic evaluation of a formation downhole, even while drilling. The term "loop" is meant to include a circular or non-circular configuration, and a loop may be nearly closed or only partially closed. For example, a conductor configuration in the form of a square is encompassed in the definition of loop. A configuration that is only half of a square or half of a circle is also encompassed in the definition of loop. The term "loop" also means a coil or plurality of loops. Formation evaluation as described herein can be performed in minerals and mining exploration, oil and gas deposits, oil and gas exploration, water exploration, geophysical exploration, geologic formations and exploration, subsurface mapping, and the like.

Figure 62:
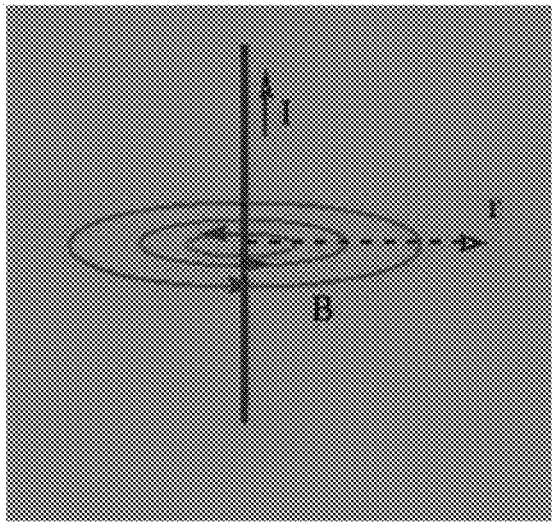
FIG. 62 shows the magnetic field B around the conductor flowing current.
Figure 65:
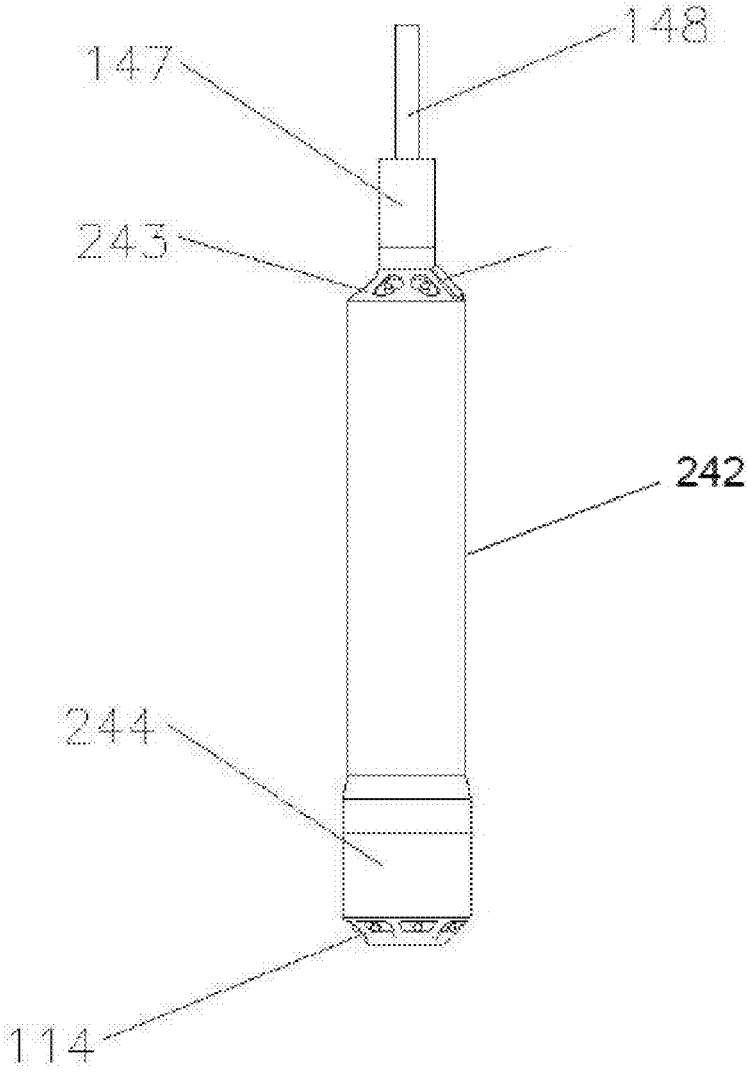
FIG. 65 illustrates an embodiment of the present invention comprising an electromagnetic repetitive pulsed electric drill.

Referring to FIG. 65, one embodiment of the present invention comprises an EM pulsed electric drill used for electrohydraulic or electrocrushing drilling. Bottom hole assembly 242, electrocrushing bit 114, electrohydraulic projectors 243, drilling fluid pipe 147, power cable 148, and pulsed power subsystem 244 comprise the pulsed power system and other components of the downhole drilling assembly (not shown). The drill can be powered by a downhole power source, by a downhole alternator or generator powered by mud turbine, or from the surface by a cable or drill pipe with embedded conductors. The arc produced by the drill either in the rock or in the drilling fluid creates a magnetic field around the arc as shown in FIG. 62. This magnetic field can then be used for formation evaluation and gas pocket detection ahead of the drill, with the appropriate sensors, such as disclosed in U.S. Pat. No. 8,390,471, incorporated herein by reference. Using a pulsed electric drill system to produce the desired EM pulse is advantageous, because the infrastructure (such as power feed, charging scheme, control system, instrumentation, etc.) is already in place. Preferably all that is required is an additional circuit to produce the pulse (e.g. if either one or three spiker circuits are employed by the drill, the pulse circuit would be the second or fourth circuit, respectively). A opposed to the high voltage (e.g. approximately 150 kV) spiker circuits, the pulse circuit preferably operates at relatively low voltage (e.g. tens of kilovolts) and medium current (e.g. a few kiloamps).

Embodiments of the present invention comprises an EM pulsed electric drill having an additional pulsed power subsystem added to bottom hole assembly 242 to create a pulsed magnetic field by conducting pulsed current through a conductor formed in a loop. The pulsed power electromagnetic subsystem 244 preferably has energy storage and source impedance characteristics that are different from the electrocrushing or electrohydraulic pulsed power systems in the pulsed electric drill. The same charging system that is utilized for the rest of the pulsed electric drill bottom hole assembly pulsed power system can also be used for the EM pulsed power subsystem. The same control system that is utilized to control the pulsed electric drill can also be used to control subsystem 244. Subsystem 244 can then be used to drive current through one or more magnetic coils or loops to produce the desired electromagnetic pulsed field. The loop can be constructed with a specific configuration and oriented in a particular direction to provide a pulsed magnetic field with the desired configuration and orientation in space.

Figure 63:
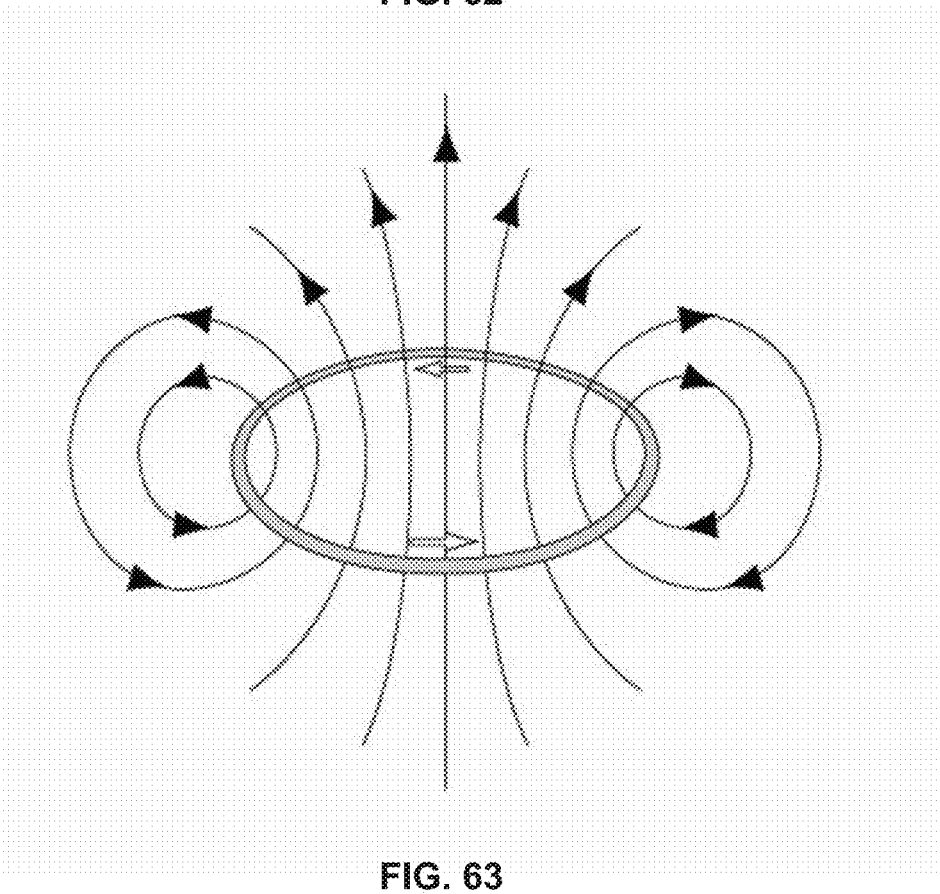
FIG. 63 shows the magnetic field created by current flowing in a loop.
Figure 66:
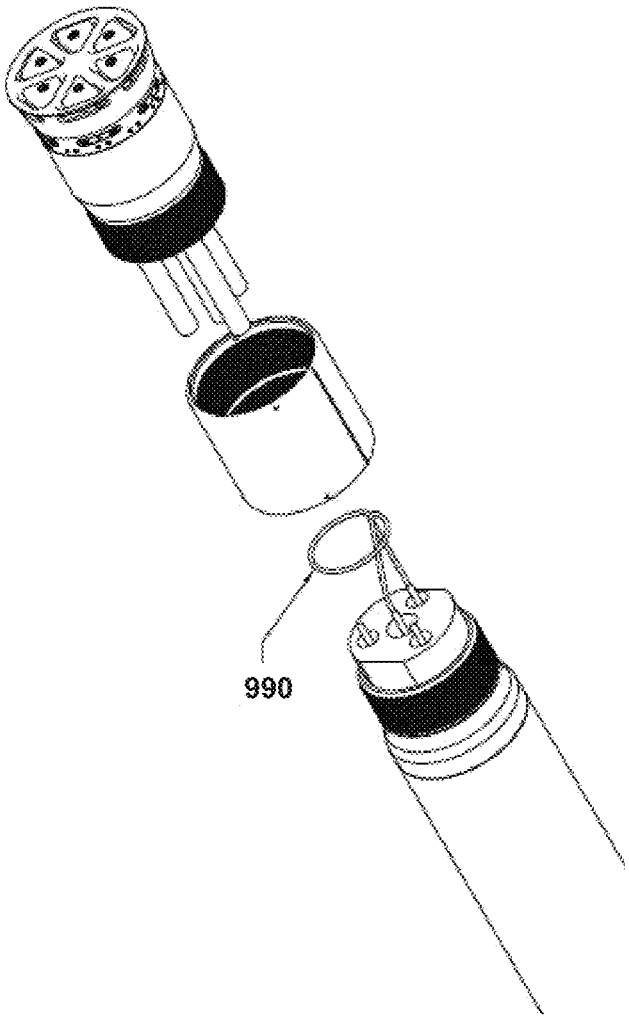
FIG. 66 shows an electromagnetic repetitive pulsed electric drill comprising a current loop for projecting a magnetic field along the axis of the drill system.
Figure 67:
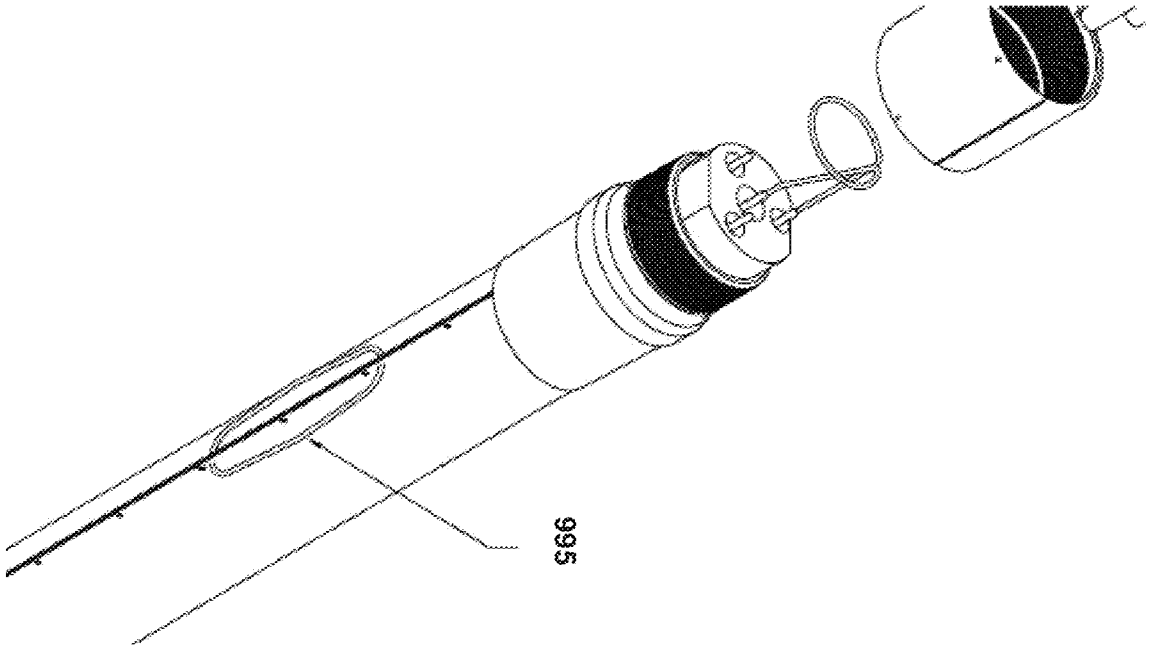
FIG. 67 shows an electromagnetic repetitive pulsed electric drill comprising a current loop for projecting a magnetic field transverse to the axis of the drill system.

For example, the conductor can be physically constructed as a loop around the circumference of bit 114 to minimize the interference of bottom hole assembly 242 on the electromagnetic field pulse, such that the plane of the current loop is perpendicular to the axis of the bottom hole assembly. When the current pulse propagates through the conductor loop, it creates a pulsed magnetic field with an axis of symmetry approximately coincident with the axis of the bottom hole assembly, as shown in FIG. 63. This creates a magnetic field configuration with the peak of the field in the direction of propagation of the electrocrushing drill, thus providing the means to evaluate the formation ahead of the drill, with the appropriate sensors. This evaluation process could be carried out during active drilling or while not drilling. FIG. 66 shows coil 990 for projecting a magnetic field along the axis of the drill system. As shown in FIG. 67, a current loop or coil 995 may alternatively or additionally be built into the side of the bottom hole assembly to create a pulsed magnetic field whose axis of symmetry and whose maximum extent is approximately perpendicular to the axis of the bottom hole assembly, i.e. transverse to the axis of the drill system. Although coils 990, 995 as shown each comprise a single turn coil, a coil comprising multiple turns may be utilized to match the power output of the pulsed power system to the desired magnetic field strength, depending on the desired magnetic field strength and the current and voltage source capabilities of the pulsed power system.

Figure 64A:
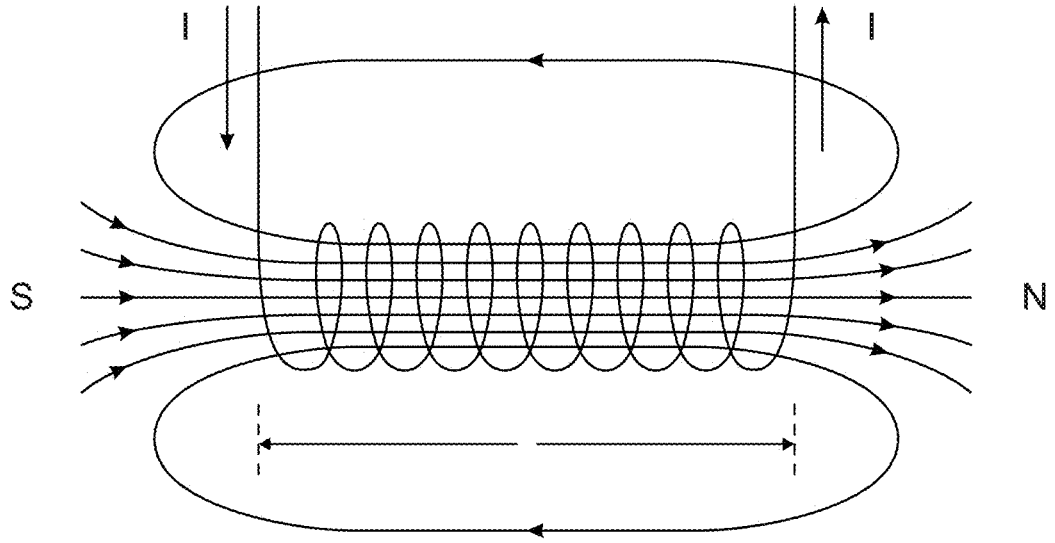
FIGS. 64A and 64B show the magnetic field produced by a multiplicity of current loops arranged in a solenoid or coil.
Figure 64B:
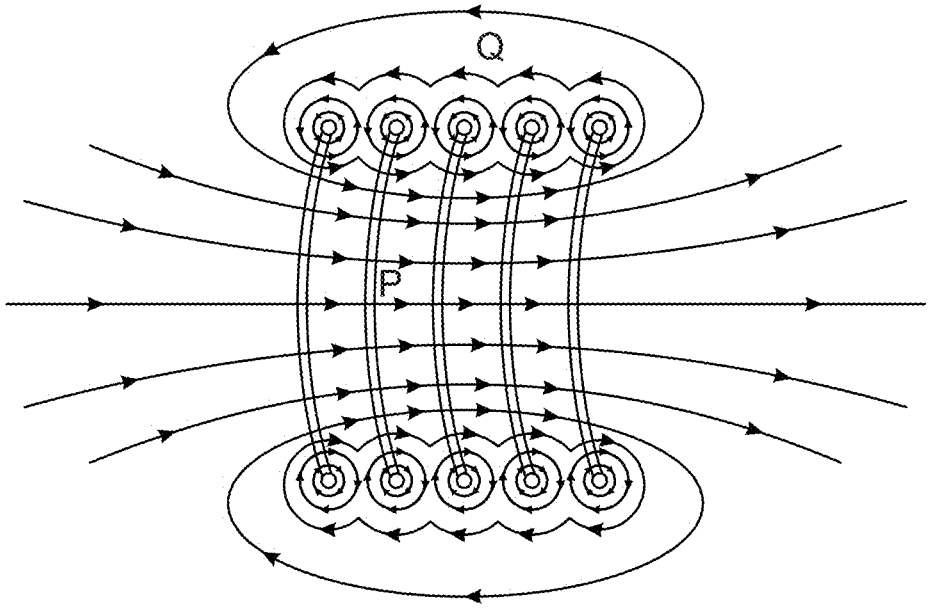

Another embodiment of an EM pulsed electric drill is to take current from one or more of the electrode sets of the EM pulsed electric drill and run the current through one or more magnetic loops or coils to produce a desired pulsed electromagnetic field, as illustrated in FIGS. 64A and 64B. This can be done in series, with returning the current from the loop back to the electrode set to contribute to drilling. It can also be done instead of drilling, with the current circulating only through the loop. A third embodiment is to operate it in parallel with part of the current going through the loop and part of it through the electrode set. Alternatively a plurality of conductor loops can be oriented along the side or wall of the bottom hole assembly or near the bit or near the end of the bottom hole assembly opposite the bit so that, by changing the phasing of the current through the loops, the location of the maxima of the magnetic field can be steered through the formation.

A variation of the EM pulsed electric drill is one designed for formation evaluation and not designed for drilling, which can be used to create a pulsed magnetic field for formation evaluation in the well, or can be located on the surface for formation evaluation from the surface.

Electrocrushing Bits Utilizing Rod Geometries

Bits for electrocrushing drills that utilize rods as the principal electrode geometry are important for electrocrushing drilling of particular rock types. One such hybrid bits comprises both rods and curved surfaces; another comprises concentric arrays of rods. As used throughout the specification and claims, the term "rod shaped" means resembling a rod, rodlike, elongated, cylindrical, and the like. A rod shaped element may have any shape cross section, not just circular.

Figure 68:
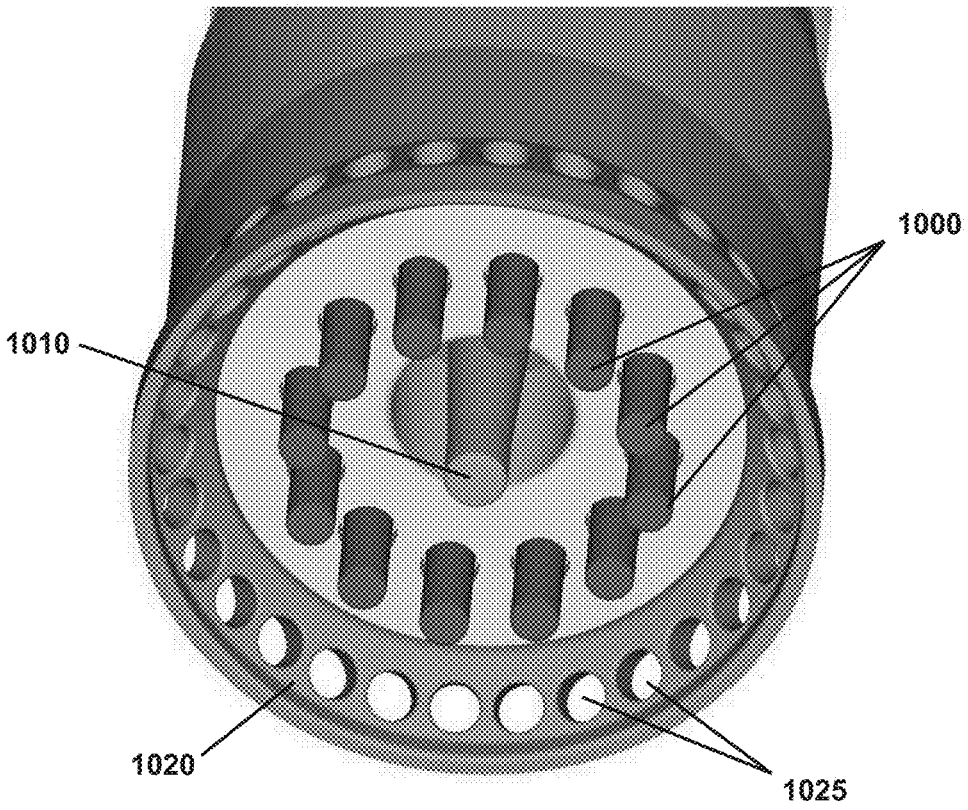
FIG. 68 shows an embodiment of a rod-type electrocrushing bit comprising a continuous ground ring.

FIG. 68 shows an embodiment of an electrocrushing bit comprising a plurality of rod shaped high voltage electrodes 1000, preferably wired in parallel, and central ground rod electrode 1010, which are surrounded by continuous ground ring 1020. Openings 1025 in ground ring 1020 enable drill cuttings to be flushed to the outside of the drill bit and up the wellbore. The excavation process proceeds from one or more of the high voltage electrodes to the central ground electrode or to the outer rim. The outside edge of the bit preferably structurally supports the drill string, and so is preferably strong enough to be capable of withstanding substantial compressive forces. The unique electric field distributions created by the rods substantially enhance the electrocrushing process. Central ground rod electrode 1010 may comprise a single rod or a plurality of rods, in which case the plurality of rods may be arranged in a circular configuration concentric with high voltage electrodes 1000.

Figure 69:
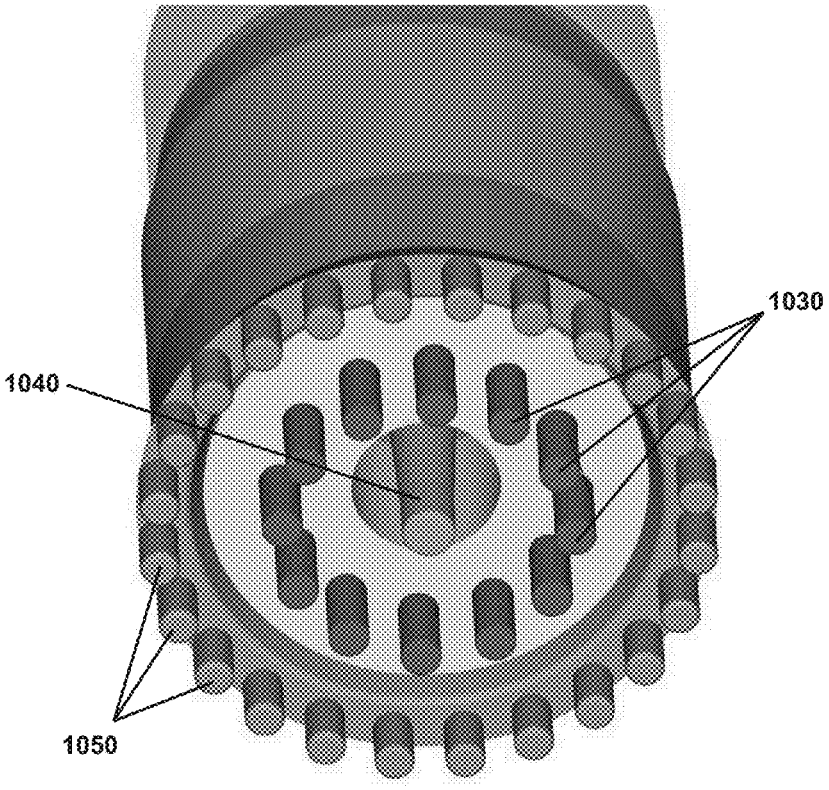
FIG. 69 shows an embodiment of a rod-type electrocrushing bit comprising a plurality of circumferential ground rods.
Figure 70A:
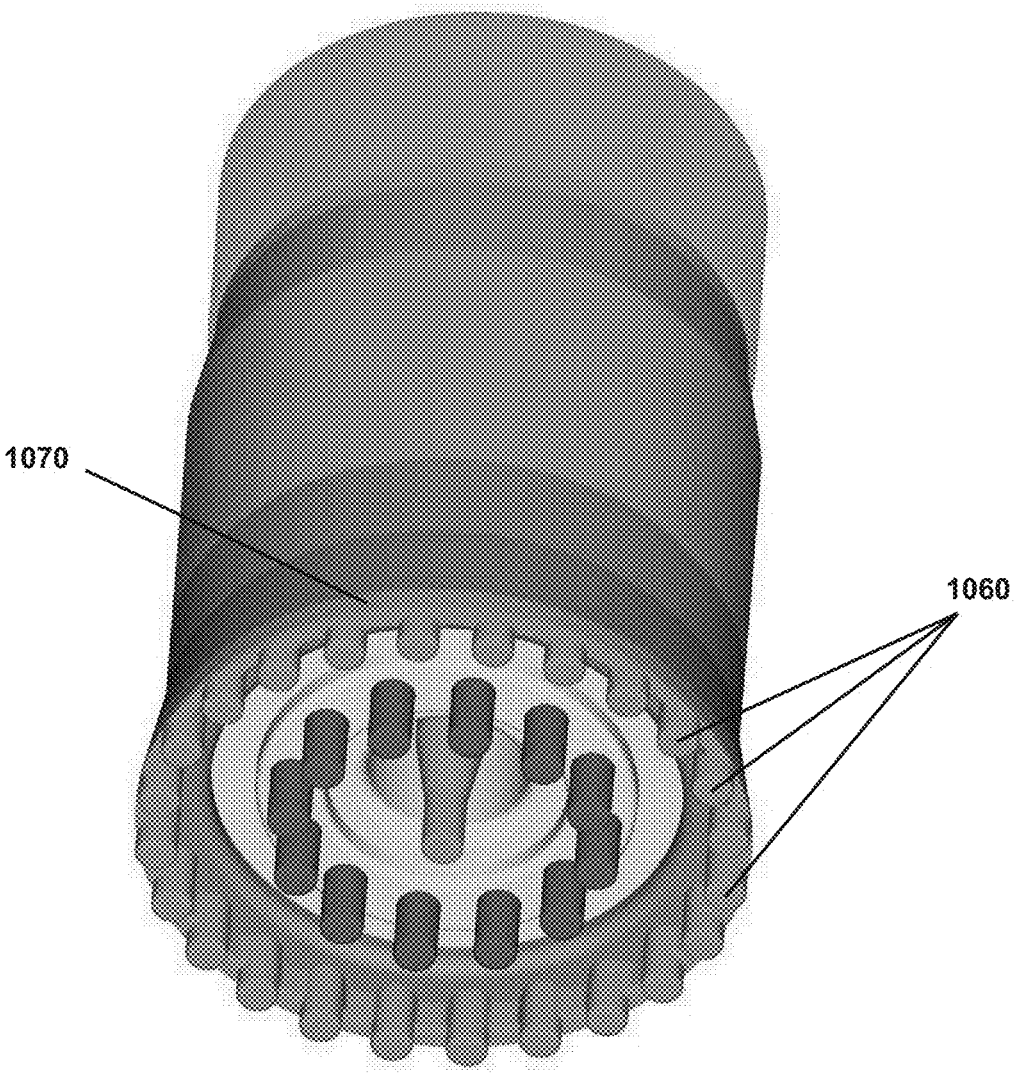
FIG. 70A shows an embodiment of a rod-type electrocrushing bit comprising a plurality of circumferential ground rods integrated with a rod wall.
Figure 70B:
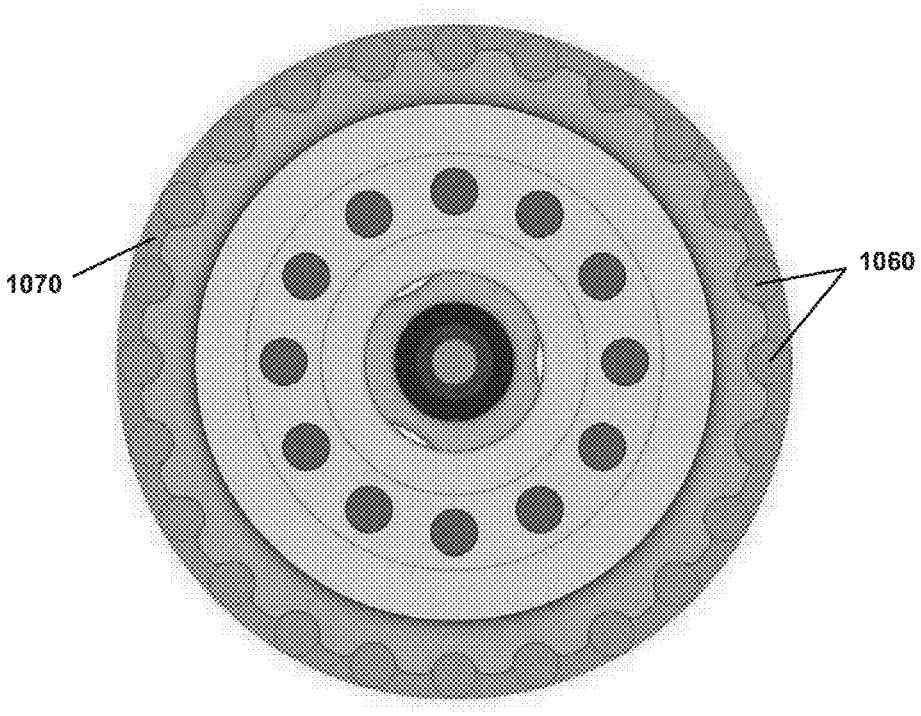
FIG. 70B is a bottom view of the bit shown in FIG. 70A.

FIG. 69 shows another embodiment of a rod-based electrocrushing drill bit comprising a plurality of high voltage electrodes 1030 and central ground rod electrode 1040, which are surrounded by a plurality of ground rods 1050 at the circumference of the bit. Ground rods 1050 are preferably concentric with high voltage electrodes 1030 and are preferably grounded or held at a low voltage. The use of rods at the outside circumference of the bit provides additional control over the electric fields in order to enhance the electrocrushing process. The spacing between the rods preferably enables sweeping out of the cuttings from the drilling process. In this embodiment, the ground rods extend directly from the bit structure. In other embodiments ground rods 1060 can extend out from continuous rim or rod wall 1070, as shown in FIGS. 70A and 70B. In addition to providing additional E-field and flow management, rod wall 1070 enables the production of the same rod-like electric fields of the embodiment shown in FIG. 69 while also providing the structural support capabilities of a continuous rim in order to support the drill string. As more clearly shown in FIG. 70B, rod wall 1070 preferably extends outwardly to the outside circumference of the drill bit, but is sufficiently thin so that ground rods 1060 protrude from the inner edge of the wall towards the center of the bit. The ground rods in both of these embodiments are preferably the same length. As shown in FIGS. 70A and 70B, rod wall 1070 preferably connects ground rods 1060 and comprises a thickness that extends rod wall 1070 radially outwardly as far as or beyond ground rods 1060, but not past them radially inwardly (i.e. toward the high voltage electrodes). Rod wall 1070 may optionally comprise ports (not shown) to remove the cuttings to the outside of the drill.

Figure 71:
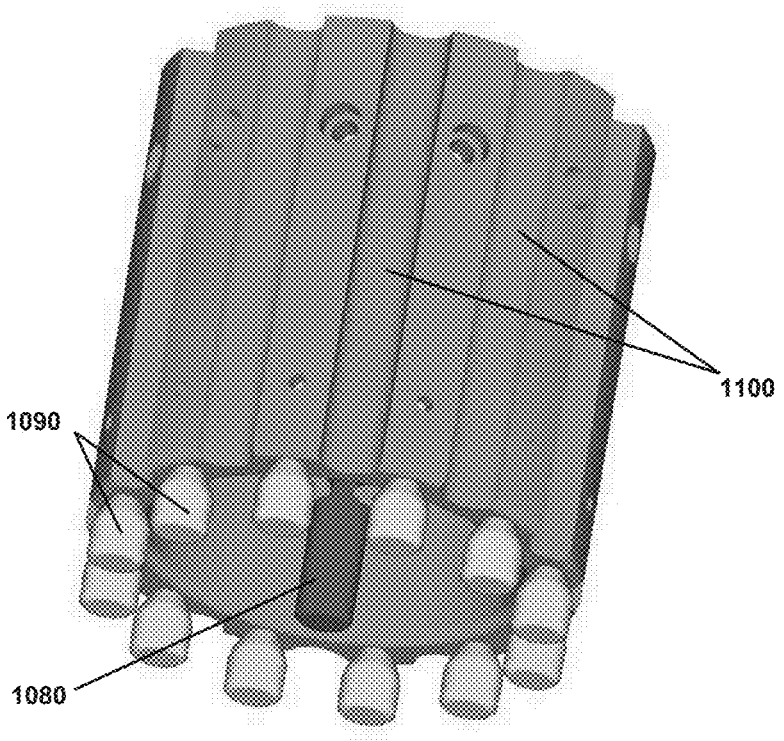
FIG. 71 shows an embodiment of a rod-type electrocrushing bit comprising flow channels.

FIG. 71 shows another embodiment of the present invention with no central ground rod electrode; the bit comprises single high voltage electrode 1080 surrounded by ground rods 1090. The bit also comprises one or more channels 1100 running along the side of the bit to accommodate the flow of cuttings or debris out of the bit and up the hole. Similar channels may be employed in any of the embodiments herein.

Figure 72:
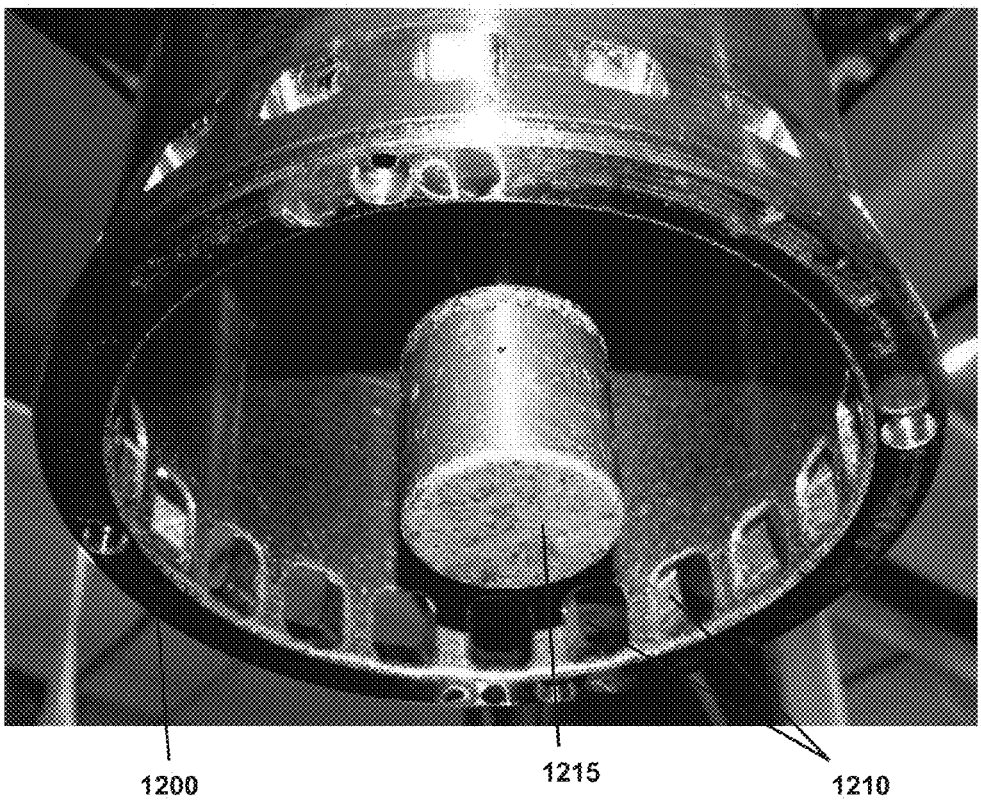
FIG. 72 is a photograph of an embodiment of a drill bit of the present invention comprising a current return ring having a plurality of openings which surrounds a single rod shaped high voltage electrode.

FIG. 72 is a photograph of another embodiment of the present invention comprising current return ring 1200 which comprises a plurality of openings 1210 surrounding a single rod shaped high voltage electrode 1215.

Figure 73:
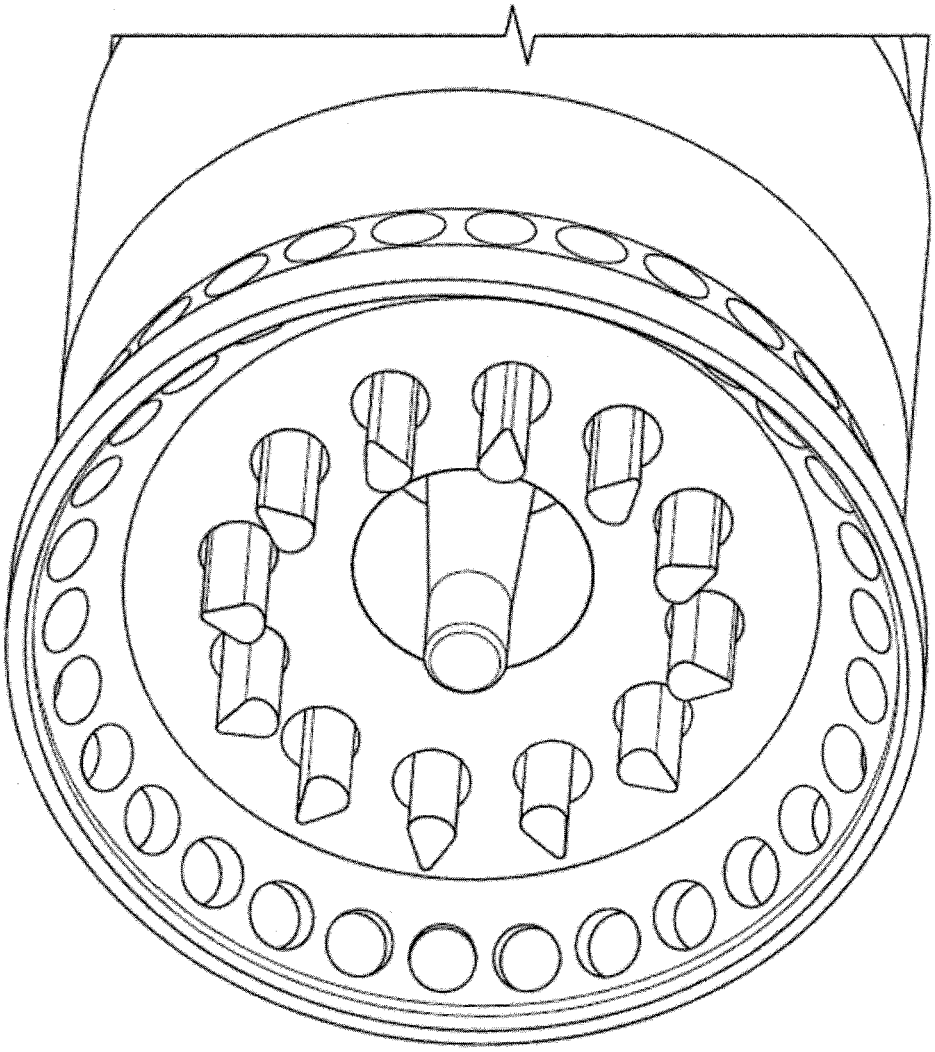
FIG. 73 shows an embodiment of a rod-type electrocrushing bit comprising a continuous ground ring similar to that shown in FIG. 68 but comprising electrodes having an airfoil shaped cross section.
Figure 74:
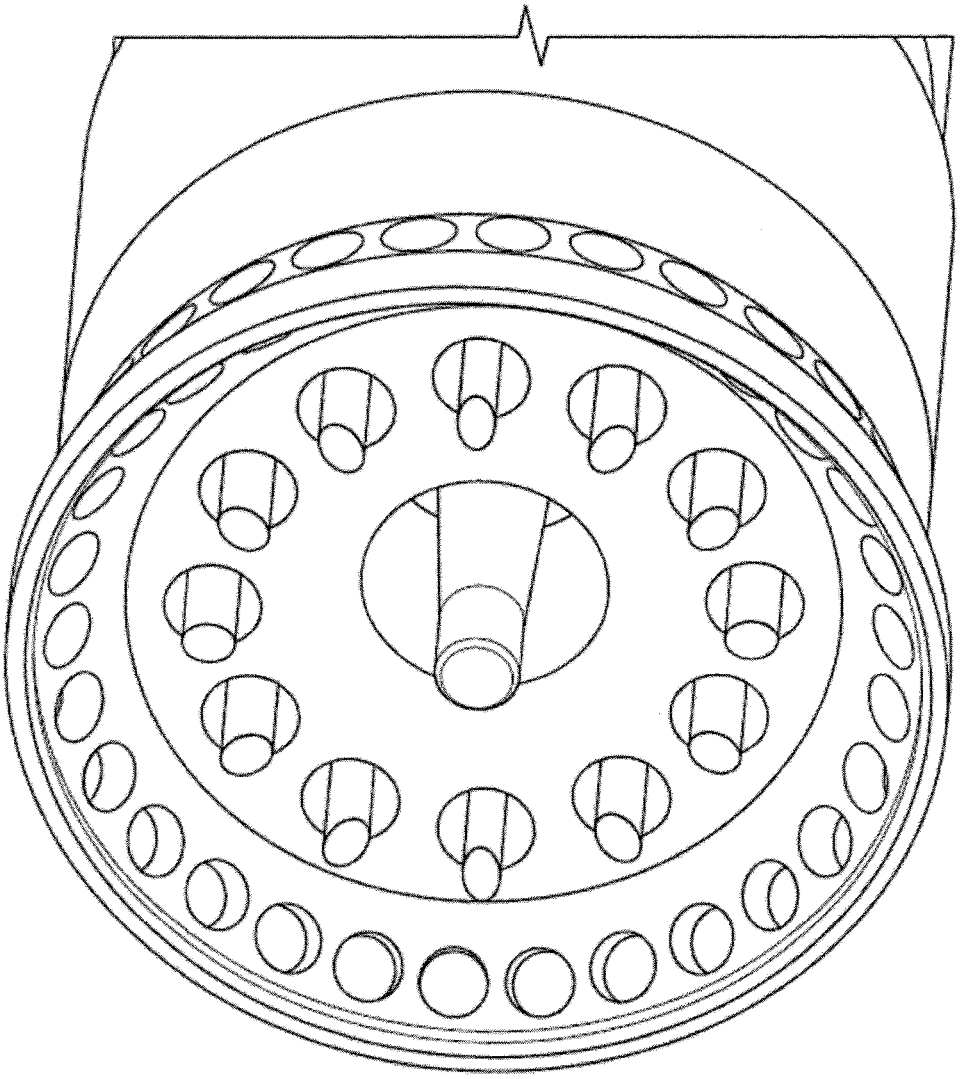
FIG. 74 shows an embodiment of a rod-type electrocrushing bit comprising a continuous ground ring similar to that shown in FIG. 68 but comprising electrodes having an elliptical cross section.

In any of these embodiments, the rods, continuous ground ring, and/or rod-wall may comprise one of many types of structural steel, including but not limited to 4140 stainless steel, high-strength carbon steel, and super alloys that combine high toughness with high-strength and abrasion resistance. The cross section of any of the rods described herein can be circular as shown in FIG. 68, or as shown in FIGS. 73-74, elliptical, airfoil shaped, or comprise any shape to enhance fluid flow out of the center of the drill to the periphery.

The preceding examples can be repeated with similar success by substituting the generically or specifically described components, mechanisms, materials, and/or operating conditions of this invention for those used in the preceding examples.

Although the invention has been described in detail with particular reference to these disclosed embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An electrocrushing drill bit comprising a plurality of cylindrical high voltage electrodes arranged in at least a portion of a circle and surrounded by a current return structure comprising a plurality of circumferential openings for facilitating removal of drilling debris from said drill bit, wherein said high voltage electrodes surround one or more cylindrical central current return electrodes.

2. The drill bit of claim 1 comprising a plurality of said one or more central current return electrodes arranged in at least a portion of a circle concentric with said high voltage electrodes.

3. The drill bit of claim 1 wherein said current return structure comprises a current return ring.

4. The drill bit of claim 1 wherein said current return structure comprises a plurality of cylindrical circumferential current return electrodes located at an outer rim of said drill bit and said circumferential openings comprise spaces between said circumferential current return electrodes.

5. The drill bit of claim 4 wherein said circumferential current return electrodes are concentric with said plurality of cylindrical high voltage electrodes.

6. The drill bit of claim 4 further comprising a wall connecting said circumferential current return electrodes, said wall thinner than a diameter of each said circumferential current return electrode and disposed so that said wall extends radially outwardly as far as an outermost point of said circumferential current return electrode, thereby longitudinally extending an outer wall of the drill bit, but does not extend radially inwardly past said circumferential current return electrodes.

7. The drill bit of claim 6 wherein a height of said wall is shorter than a length of said circumferential current return electrodes.

8. The drill bit of claim 6 wherein said wall and said circumferential current return electrodes are manufactured together to form a single structure.

9. The drill bit of claim 6 wherein said wall comprises a plurality of additional openings to facilitate removal of drilling debris from the drill bit.

10. The drill bit of claim 4 wherein said high voltage electrodes comprise a cross-sectional shape selected from the group consisting of circle, ellipse, and airfoil.

11. The drill bit of claim 1 comprising a single said central current return electrode located approximately at a center of said circle.

12. The drill bit of claim 1 comprising a plurality of channels running longitudinally along an outer surface of said drill bit to facilitate transport of drilling debris up and out of a drilling hole.

13. The drill bit of claim 1 connected to a bottom hole assembly via a rotational joint and a motor for nutating said drill bit.

14. An electrocrushing drill bit comprising one or more high voltage electrodes surrounded by a current return structure comprising a plurality of circumferential openings for facilitating removal of drilling debris from said drill bit;

wherein said current return structure partially covers a bottom face of said drill bit, said current return structure comprising one or more bottom openings along said bottom face, wherein one or more of said high voltage electrodes is disposed within each said bottom opening.

15. The drill bit of claim 14 further comprising an channel at approximately a center of said bottom face for flowing drilling fluid into said bit.

16. The drill bit of claim 15 wherein said current return structure comprises a solid portion disposed near said channel, thereby forcing at least some of the flowing drilling fluid to flow radially from said channel toward and around each said high voltage electrode.

17. The drill bit of claim 15 wherein the flowing drilling fluid sweeps drilling debris and bubbles in said fluid created by operation of said electrodes out of said drill bit.

18. The drill bit of claim 14 wherein said high voltage electrodes are cylindrical.

19. The drill bit of claim 18 wherein the high voltage electrodes are arranged to form at least a portion of a circle centered on a center of said bottom face.

20. The drill bit of claim 14 wherein each said high voltage electrode is compressible and/or extends out from said bottom face.

21. The drill bit of claim 14 wherein two or more of said high voltage electrodes are electrically connected to form one or more sets of connected electrodes, each set powered by a separate pulsed power system.

22. The drill bit of claim 21 wherein preferred operation of one or more of said sets over one or more other of said sets results in directional control of said drill bit.

23. The drill bit of claim 21 wherein electrodes in each set are mechanically linked to move together.

24. The drill bit of claim 14 wherein each said bottom opening is sector-shaped or substantially triangular.

25. The drill bit of claim 24 wherein said high voltage electrodes are substantially triangular or sector shaped and are circumferentially arranged around a center of said bottom face, each high voltage electrode oriented so that one vertex of each high voltage electrode is pointing toward said center.

26. The drill bit of claim 14 connected to a bottom hole assembly via a rotational joint and a motor for nutating said drill bit.

27. The drill bit of claim 26 wherein said motor nutates said drill bit to provide more uniform drilling despite non-uniform electric field distributions produced by said high voltage electrodes.

28. An electrocrushing drill bit comprising a single central high voltage electrode surrounded by a plurality of cylindrical circumferential current return electrodes located at an outer rim of said drill bit;

wherein spaces between said circumferential current return electrodes facilitate removal of drilling debris from said drill bit.

29. The drill bit of claim 28 connected to a bottom hole assembly via a rotational joint and a motor for nutating said drill bit.

30. The drill bit of claim 28 further comprising a wall connecting said circumferential current return electrodes, said wall thinner than a diameter of each said circumferential current return electrode and disposed so that said wall extends radially outwardly as far as an outermost point of said circumferential current return electrode, thereby longitudinally extending an outer wall of the drill bit, but does not extend radially inwardly past said circumferential current return electrodes.

31. The drill bit of claim 30 wherein a height of said wall is shorter than a length of said circumferential current return electrodes.

32. The drill bit of claim 30 wherein said wall and said circumferential current return electrodes are manufactured together to form a single structure.

33. The drill bit of claim 30 wherein said wall comprises a plurality of additional openings to facilitate removal of drilling debris from the drill bit.

* * * * *